US010750911B2

(12) United States Patent
McDonagh et al.

(10) Patent No.: US 10,750,911 B2
(45) Date of Patent: Aug. 25, 2020

(54) SPRING MECHANISM FOR FLUID DISPENSER

(71) Applicant: OP-Hygiene IP GmbH, Niederbipp (CH)

(72) Inventors: Padraig McDonagh, County Sligo (IE); Heiner Ophardt, Arisdorf (CH)

(73) Assignee: OP-Hygiene IP GmbH, Niederbipp (CH)

( * ) Notice: Subject to any disclaimer, the term of this patent is extended or adjusted under 35 U.S.C. 154(b) by 0 days.

(21) Appl. No.: 16/680,158

(22) Filed: Nov. 11, 2019

(65) Prior Publication Data

US 2020/0146514 A1 May 14, 2020

Related U.S. Application Data

(60) Provisional application No. 62/758,817, filed on Nov. 12, 2018, provisional application No. 62/851,878, filed on May 23, 2019.

(51) Int. Cl.
*A47K 5/12* (2006.01)

(52) U.S. Cl.
CPC ..... *A47K 5/1205* (2013.01)

(58) Field of Classification Search
CPC ..... A47K 5/1205; A47K 5/1207; A47K 5/12; A47K 5/00; A47K 5/06; A47K 5/13; B65D 51/242; B65D 90/12; B67D 3/0029; B67D 7/84; B67D 1/06; B67D 1/08; B67D 3/0054; B67D 3/0058; B67D 3/008; B67D 3/0083
USPC ..... 222/173
See application file for complete search history.

(56) References Cited

U.S. PATENT DOCUMENTS

| | | | | |
|---|---|---|---|---|
| 5,810,204 | A * | 9/1998 | Devlin | A47K 5/1209 222/108 |
| 5,862,956 | A * | 1/1999 | Brandenburg | A47K 5/12 222/214 |
| 7,086,567 | B1 * | 8/2006 | Ciavarella | A47K 5/1202 222/105 |
| 10,182,685 | B2 | 1/2019 | Ophardt et al. | |
| 2007/0210110 | A1 * | 9/2007 | Anhuf | A47K 5/12 222/180 |
| 2011/0011890 | A1 * | 1/2011 | Rosenkranz | A47K 5/12 222/153.03 |

(Continued)

FOREIGN PATENT DOCUMENTS

| | | |
|---|---|---|
| EP | 3153081 | 4/2017 |

*Primary Examiner* — Benjamin R Shaw
(74) *Attorney, Agent, or Firm* — Thorpe North & Western LLP

(57) ABSTRACT

A fluid dispenser with a housing, a cover, a cover actuator member, and a biasing mechanism. The cover is movable relative to the housing between a first location and a second location, and the cover actuator member is movable relative to the housing between a first orientation and a second orientation. The cover actuator member engages with the cover to effect movement of the cover from the first location to the second location. The cover actuator member comprises an engagement member that travels in a travel path between a first position and a second position as the cover actuator member moves between the first orientation and the second orientation. The biasing mechanism engages with the engagement member and biases the engagement member towards the first position.

24 Claims, 39 Drawing Sheets

(56) References Cited

U.S. PATENT DOCUMENTS

| | | | | |
|---|---|---|---|---|
| 2013/0292417 | A1* | 11/2013 | Pelkey | E05B 1/0038 222/153.03 |
| 2014/0217123 | A1* | 8/2014 | Ophardt | A47K 5/1217 222/190 |
| 2014/0231460 | A1* | 8/2014 | Pelkey | A47K 5/1207 222/181.3 |
| 2015/0034677 | A1* | 2/2015 | Duncan | A47K 5/12 222/181.3 |
| 2015/0190827 | A1* | 7/2015 | Ophardt | B05B 11/0038 222/153.09 |
| 2017/0119219 | A1* | 5/2017 | Pelfrey | A47K 5/1217 |
| 2017/0120274 | A1* | 5/2017 | Schultz | F16K 15/044 |
| 2018/0111145 | A1* | 4/2018 | Ophardt | G01F 23/292 |
| 2018/0132669 | A1* | 5/2018 | Ophardt | A47K 5/1205 |
| 2020/0085244 | A1* | 3/2020 | Wertheim | A47K 5/1211 |

* cited by examiner

SPRING MECHANISM FOR FLUID DISPENSER

SCOPE OF THE INVENTION

This invention relates to coupling arrangements by which a cover for a fluid dispenser can be moved between open and closed positions and to a novel spring mechanism.

BACKGROUND OF THE INVENTION

Manually operated fluid dispensers are known for dispensing hand cleaning fluid onto a person's hand. Such dispensers typically have a cover to enclose the operational mechanisms of the dispensers. Previously known dispensers suffer the disadvantage that covers for the dispensers are difficult for a user to move between open and closed positions and to remove the cover from the dispenser. To address this problem, U.S. Pat. No. 10,182,685 to Ophardt et al., issued Jan. 22, 2019, which is incorporated herein by reference, discloses a fluid dispenser in which a cover actuator member is provided for moving a cover between an open position and a closed position relative to a housing of the dispenser. The present inventors have appreciated that the dispenser as disclosed in U.S. Pat. No. 10,182,685 can be further improved.

SUMMARY OF THE INVENTION

To at least partially overcome some of the disadvantages of previously known dispensers, in a first aspect the present invention provides an improvement over the fluid dispenser disclosed in U.S. Pat. No. 10,182,685, in which the fluid dispenser is adapted to incorporate a biasing mechanism that biases the cover actuator member relative to the housing. The inventors have appreciated that the biasing mechanism can be configured to assist in the guided movement of the cover actuator member between the open and closed positions, which may improve the user experience.

The biasing mechanism is preferably a spring with a flat planar body, which for example can be made from a resilient plastic. The flat planar body preferably allows the spring to take up a minimal amount of lateral space within the interior of the fluid dispenser. The flat planar body may, for example, include an anchoring portion that is fixed to the housing, an engagement portion that is arranged for engagement with the cover actuator member, and a deflecting portion that is connected to the anchoring portion and the engagement portion, the deflecting portion being resiliently deformable between an unbiased condition and a deflected condition.

Preferably, the spring includes one or more features that assist in maintaining its planar configuration as it moves between the unbiased condition and the deflected condition. For example, the spring may include one or more guide members that extend laterally from the flat planar body for slidably engaging with a spring guide slot in a side wall of the housing. The sliding engagement of the guide member in the guide slot preferably helps to guide the deflection of the spring between the unbiased condition and the deflected condition, so that the spring deforms in the intended manner remaining in a planar configuration rather than twisting or bending laterally. Providing one or more features that assist in maintaining the planar configuration of the spring preferably allows the spring to be made thinner than would otherwise be necessary, and thus take up less lateral space within the interior of the fluid dispenser.

The inventors have appreciated that the spring in accordance with the present invention may useful for a number of different applications, of which biasing a cover actuator member of a fluid dispenser is merely one preferred example. The flat planar body and other features of the spring that preferably allow the spring to take up a minimal amount of lateral space may, for example, be particularly advantageous for applications in which there are space constraints.

Accordingly, in one aspect the present invention resides in a fluid dispenser comprising: a housing for carrying a fluid reservoir and a pump mechanism; a cover coupled to the housing, the cover movable relative to the housing between a first location and a second location; and a cover actuator member coupled to the housing, the cover actuator member movable relative to the housing between a first orientation and a second orientation; wherein, upon movement of the cover actuator member from the first orientation to the second orientation, the cover actuator member engages with the cover to effect movement of the cover from the first location to the second location; wherein: the fluid dispenser further comprises a biasing mechanism that biases the cover actuator member relative to the housing; wherein the cover actuator member comprises an engagement member that travels in a travel path between a first position and a second position as the cover actuator member moves between the first orientation and the second orientation, the engagement member being at the first position when the cover actuator member is in the first orientation, and the engagement member being at the second position when the cover actuator member is in the second orientation; wherein the biasing mechanism engages with the engagement member at least when the engagement member is positioned in a first portion of the travel path; and wherein the biasing mechanism biases the engagement member towards the first position when the engagement member is positioned in the first portion of the travel path.

Optionally, the biasing mechanism engages with the engagement member when the cover actuator member is in the first orientation; and wherein, when the cover actuator member is in the first orientation, the biasing mechanism biases the cover actuator member towards the first orientation.

Preferably, when the cover actuator member is in the first orientation, the cover actuator member engages with the cover to locate the cover at the first location; and wherein, when the cover actuator member is in the first orientation, the biasing mechanism biases the cover towards the first location, through engagement of the biasing mechanism with the cover actuator member, and engagement of the cover actuator member with the cover.

In some embodiments, during movement of the engagement member from the first position to the second position in the travel path, the engagement member travels at least in a first direction from the first position to an intermediate position, and then travels at least in a second direction from the intermediate position to the second position, the first direction being opposite to the second direction; wherein the biasing mechanism biases the engagement member in the second direction when the engagement member is positioned in the first portion of the travel path; and wherein the first portion of the travel path comprises a portion of the travel path in which the engagement member is at the first position or is spaced in the first direction from the first position.

The housing may, for example, have a slotway that extends between a first end of the slotway and a second end of the slotway; wherein the cover actuator member comprises a sliding member that is slidably received by the slotway; and wherein the biasing mechanism biases the sliding member towards the second end of the slotway when the engagement member is positioned in the first portion of the travel path.

Optionally, the sliding member comprises an axle member that is rotatable within the slotway; and wherein movement of the cover actuator member from the first orientation to the second orientation comprises sliding and rotating the axle member within the slotway.

The engagement member may, for example, comprise the axle member.

Optionally, during movement of the axle member from the first position to the second position in the travel path, the axle member travels from the first position towards the first end of the slotway, and then changes direction and travels towards the second end of the slotway to the second position; wherein the first position is located between the first end of the slotway and the second end of the slotway; and wherein the first position is closer to the first end of the slotway than the second position is to the first end of the slotway.

In some embodiments, the biasing mechanism resists movement of the axle member from the first position towards the first end of the slotway, and, at least when the axle member is positioned in the first portion of the travel path, encourages movement of the axle member towards the second end of the slotway.

Preferably, the biasing mechanism comprises a spring member, the spring member comprising: an anchoring portion that is fixed to the housing; an engagement portion with an engagement surface that is arranged for engagement with the engagement member; and a deflecting portion that is connected to the anchoring portion and the engagement portion, the deflecting portion being resiliently deformable between an unbiased condition, in which the engagement portion is arranged at an unbiased position relative to the anchoring portion, and a deflected condition, in which the engagement portion is arranged at a deflected position relative to the anchoring portion; wherein the deflecting portion has an inherent bias to return to the unbiased condition.

The spring member may, for example, be formed from a resilient plastic material.

In some embodiments, the spring member has a hook-like shape with a first arm connected by a resilient bight to a second arm; wherein the first arm comprises the anchoring portion; wherein the second arm comprises the engagement portion; and wherein the resilient bight comprises the deflecting portion.

Preferably, the spring member has a flat planar body with a first lateral side and a second lateral side lying in parallel planes; wherein the anchoring portion comprises a first portion of the flat planar body; wherein the engagement portion comprises a second portion of the flat planar body; and wherein the deflecting portion comprises a third portion of the flat planar body.

In some preferred embodiments, the first lateral side and the second lateral side of the flat planar body remain lying in the parallel planes as the deflecting portion deflects from the unbiased condition to the deflected condition.

The engagement surface optionally extends from the first lateral side to the second lateral side of the flat planar body.

In some embodiments, the engagement surface is perpendicular to the first lateral side and the second lateral side of the flat planar body.

Optionally, the housing has a first side wall, a second side wall, and an interior compartment that is defined between the first side wall and the second side wall; wherein, when the fluid dispenser is in an operative condition, the fluid reservoir is received in the interior compartment of the housing between the first side wall and the second side wall; and wherein the flat planar body of the spring member is positioned in the interior compartment of the housing, with the first lateral side of the flat planar body positioned adjacent to the first side wall of the housing.

In some embodiments, when the fluid dispenser is in the operative condition, at least part of the flat planar body of the spring member is positioned between the fluid reservoir and the first side wall.

Optionally, the spring member deflects from the unbiased condition to the deflected condition without any portion of the spring member moving laterally towards the second side wall of the housing.

The cover may, for example, have a first cover side wall and a second cover side wall, the first cover side wall being positioned laterally outwardly from the first side wall of the housing, and the second cover side wall being positioned laterally outwardly from the second side wall of the housing.

Preferably, the anchoring portion is secured to the first side wall of the housing; wherein, when the deflecting portion is in the unbiased condition, the engagement surface of the engagement portion is disposed in the travel path of the engagement member, the engagement surface engaging with the engagement member at least when the engagement member is positioned in the first portion of the travel path; wherein the engagement of the engagement member with the engagement surface, during movement of the engagement member between the first position and the second position, deflects the deflecting portion against the inherent bias of the deflecting portion from the unbiased condition towards the deflected condition; and wherein, when the engagement member is positioned in the first portion of the travel path, the inherent bias of the deflecting portion biases the engagement member towards the first position.

In some preferred embodiments, the first side wall of the housing has a spring guide slot; wherein a guide member extends laterally from the engagement portion of the spring member, the guide member slidably engaging with the spring guide slot; and wherein the engagement of the guide member with the spring guide slot guides the deflection of the spring member between the unbiased condition and the deflected condition.

The spring guide slot may, for example, extend laterally through the first side wall from a first surface of the first side wall to a second surface of the first side wall; wherein the engagement portion is positioned adjacent to the first surface of the first side wall, with the guide member extending laterally from the engagement portion through the spring guide slot; and wherein the guide member has a head that is positioned adjacent to the second surface of the first side wall, the head being configured to engage with the second surface of the first side wall to prevent the engagement portion from moving laterally away from the first surface of the first side wall.

Optionally, the head has a length and a width, the length of the head being smaller than a length of the spring guide slot and larger than a width of the spring guide slot, and the width of the head being smaller than the length of the spring guide slot and smaller than the width of the spring guide slot; wherein, when the spring member is in an operative position, the length of the head is out of alignment with the length of the spring guide slot, which prevents the head from passing through the spring guide slot; wherein the spring member is rotatable relative to the housing from the operative position to an insertion or removal position in which the length of the head is aligned with the length of the spring guide slot, which allows the head to pass through the spring guide slot; wherein the first side wall of the housing has a head slot for slidably receiving the head of the guide member, the head slot extending laterally from the second surface of the first side wall to a third surface of the first side wall; wherein the head slot has a width that is larger than the length of the head; and wherein a thickness of the head is smaller than a lateral distance from the second surface of the first side wall to the third surface of the first side wall.

In some embodiments, the first side wall of the housing has an anchoring opening that extends from a first side of the first side wall to a second side of the first side wall; wherein an anchor member extends laterally from the anchoring portion of the spring member for engagement with the anchoring opening; wherein the anchor member has a bevelled surface that extends in a longitudinal direction as the bevelled surface extends laterally away from the anchoring portion; wherein the anchoring opening has a catch surface that extends in the longitudinal direction as the catch surface extends laterally away from the first side of the first side wall; wherein the anchoring portion is positioned adjacent to the first side of the first side wall, with the anchor member extending laterally through the anchoring opening; wherein the engagement of the engagement member of the cover actuator member with the engagement surface of the spring member, during movement of the engagement member between the first position and the second position, exerts a longitudinal force on the anchoring portion that biases the anchor member in the longitudinal direction relative to the anchoring opening; wherein the bevelled surface of the anchor member engages with the catch surface of the anchoring opening at least when the longitudinal force biases the anchor member in the longitudinal direction relative to the anchoring opening; and wherein the engagement of the bevelled surface with the catch surface under the bias of the longitudinal force generates a lateral force that biases the anchoring portion laterally towards the first side of the first side wall.

Optionally, the anchor member has a head member that extends in the longitudinal direction from the bevelled surface, the head member being configured to engage with the second side of the first side wall to prevent the anchoring portion from moving laterally away from the first side of the first side wall.

The housing may, for example, comprise a socket that carries a carried portion of the anchoring portion of the spring member, the socket preventing the carried portion of the anchoring portion from moving laterally away from the first side wall.

Optionally, the engagement member has a camming surface for engaging with the engagement surface of the engagement portion; and wherein the camming surface is angled so that, at least when the engagement member is positioned in the first portion of the travel path, the engagement of the camming surface with the engagement surface urges the engagement portion towards the first side wall of the housing.

Preferably, the fluid dispenser further comprises a second spring member having a flat planar body; wherein the flat planar body of the second spring member is positioned adjacent to the second side wall of the housing in the interior compartment of the housing.

Optionally, in at least some configurations of the fluid dispenser, the fluid reservoir is positioned in the interior compartment between the spring member and the second spring member; wherein the spring member has a first lateral extent by which the spring member extends laterally inwardly from the first side wall of the housing; wherein the second spring member has a second lateral extent by which the second spring member extends laterally inwardly from the second side wall of the housing; and wherein the first lateral extent of the spring member and the second lateral extent of the second spring member define a width of the interior compartment available to accommodate the fluid reservoir between the spring member and the second spring member.

In another aspect, the present invention resides in a spring comprising: a flat planar body with a first lateral side and a second lateral side lying in parallel planes, the flat planar body comprising: an anchoring portion for anchoring the spring to a support structure; an engagement portion with an engagement surface for engagement with a movable body; and a deflecting portion that is connected to the anchoring portion and the engagement portion, the deflecting portion being resiliently deformable between an unbiased condition, in which the engagement portion is arranged at an unbiased position relative to the anchoring portion, and a deflected condition, in which the engagement portion is arranged at a deflected position relative to the anchoring portion; wherein the deflecting portion has an inherent bias to return to the unbiased condition.

Preferably, the first lateral side and the second lateral side of the flat planar body remain lying in the parallel planes as the deflecting portion deflects from the unbiased condition to the deflected condition.

In some embodiments, the engagement surface extends from the first lateral side to the second lateral side of the flat planar body.

The engagement surface is optionally perpendicular to the first lateral side and the second lateral side of the flat planar body.

The spring may, for example, be formed from a resilient plastic material.

Optionally, the flat planar body has a hook-like shape with a first arm connected by a resilient bight to a second arm; wherein the first arm comprises the anchoring portion; wherein the second arm comprises the engagement portion; and wherein the resilient bight comprises the deflecting portion.

In some embodiments, a guide member extends laterally from the engagement portion for slidably engaging with a spring guide slot of the support structure.

The guide member optionally comprises: a base that extends laterally from the engagement portion; and an enlarged head that is positioned at a laterally distal end of the base, spaced from the engagement portion.

The head may, for example, have an elongated shape, with a length of the head being larger than a width of the head.

In some embodiments, an anchor member extends laterally from the anchoring portion for engagement with an anchoring opening of the support structure; and wherein the anchor member has a bevelled surface that extends in a longitudinal direction as the bevelled surface extends laterally away from the anchoring portion.

Optionally, the anchor member has a head member that extends in the longitudinal direction from the bevelled surface.

The spring is preferably for biasing a cover actuator member of a fluid dispenser relative to a housing of the fluid dispenser.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Reference is first made to FIGS. 1 to 18, which illustrate a prior art dispenser assembly 10 as disclosed in U.S. Pat.

Figure 2:
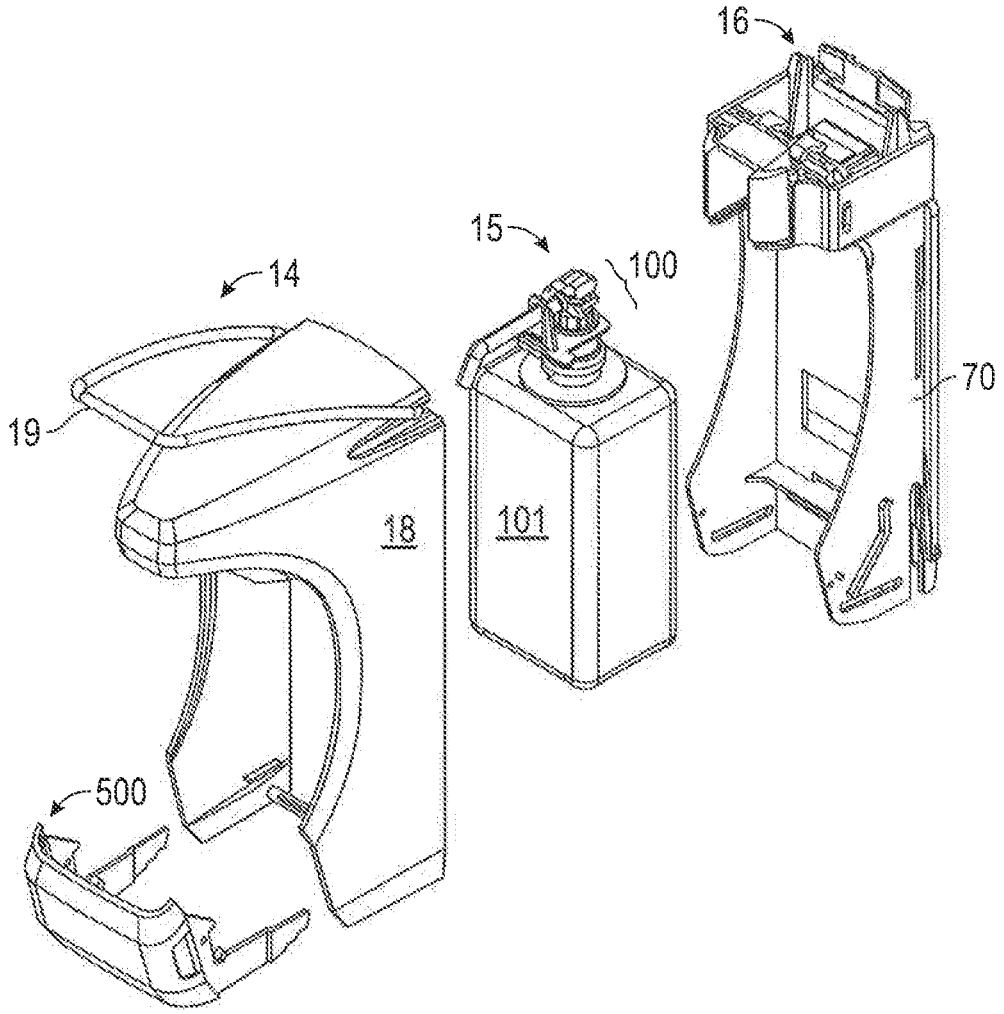
FIG. 2 is a partially exploded pictorial view of the dispenser assembly of FIG. 1.

No. 10,182,685. The prior art dispenser assembly 10 is described first to provide the necessary background for understanding the present invention. As seen in FIG. 2, the prior art dispenser assembly 10 contains four principal components, namely, a cover assembly 14, a cartridge 15, a housing assembly 16 and a lifting or lifter member 500, also referred to as a cover actuator member 500.

Figure 12:
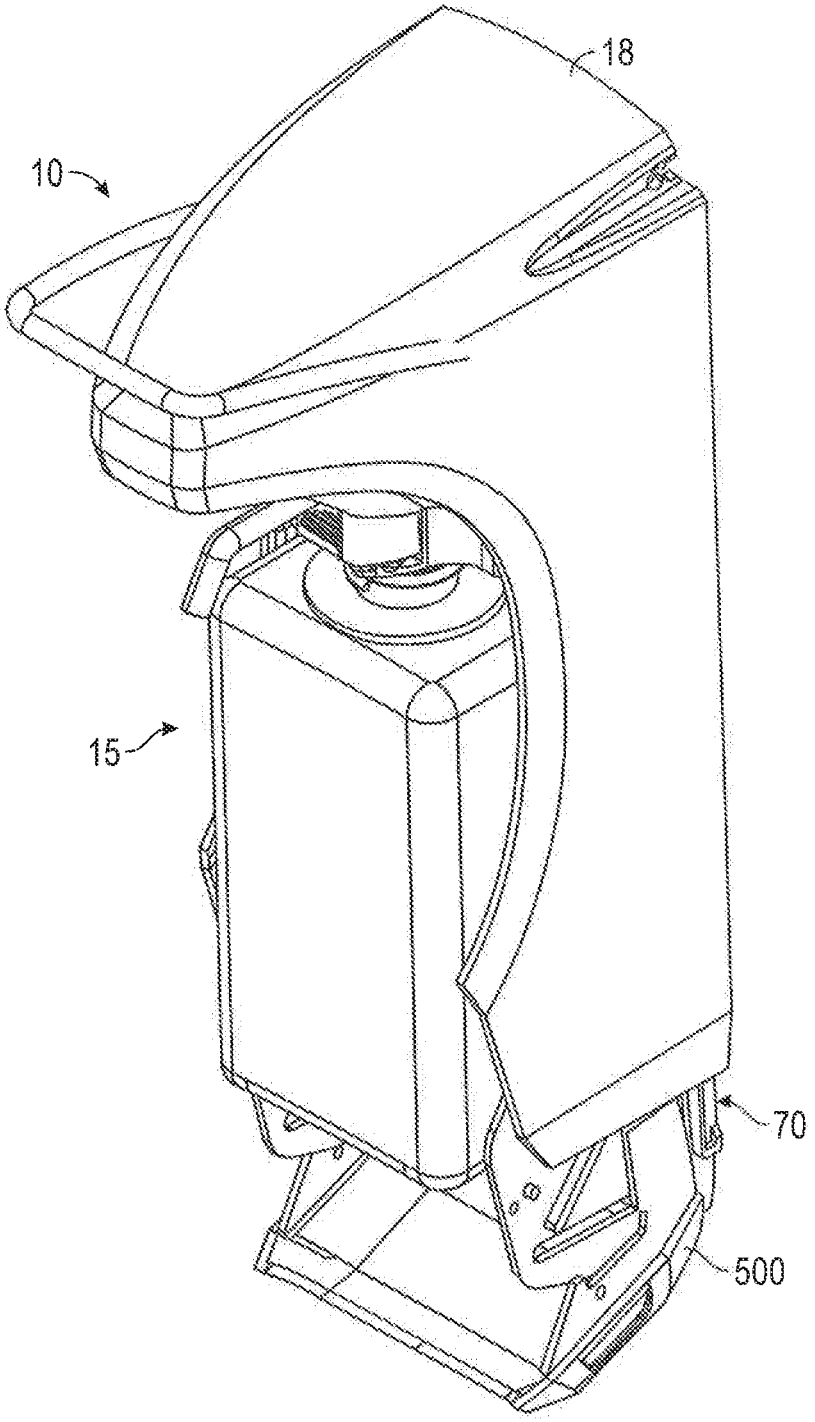
FIG. 12 is a pictorial view of the dispenser assembly of FIG. 1 but with the cover assembly in an upper fully open position with a cartridge coupled to the dispenser.
Figure 13:
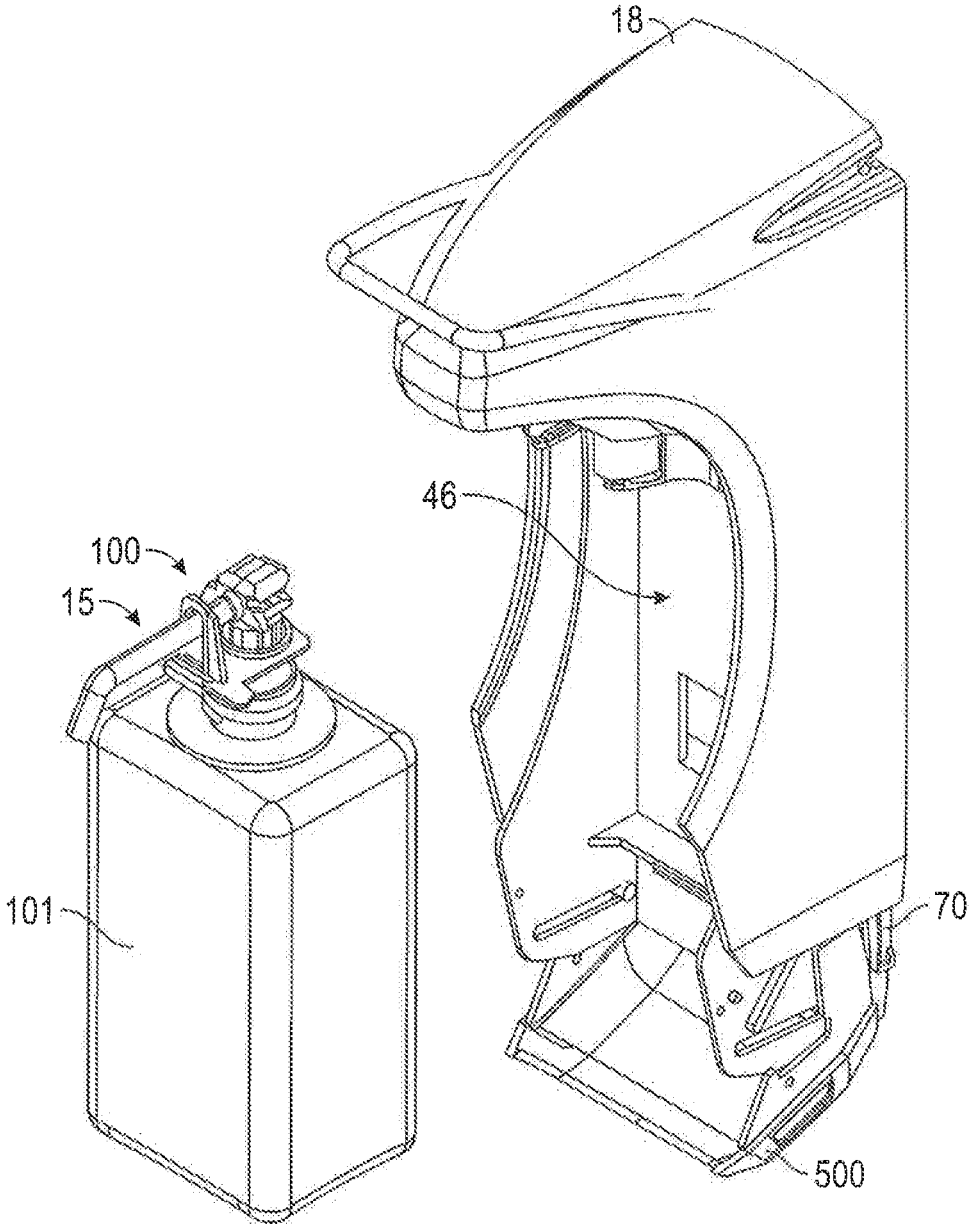
FIG. 13 is a pictorial view of the dispenser assembly of FIG. 12 in which the cartridge has been slid horizontally forwardly to a position to which and from which the cartridge may be slid horizontally, forwardly and rearwardly for respective coupling and uncoupling of the cartridge to the dispenser housing assembly.

The cartridge 15 comprises a pump mechanism 100 and a fluid reservoir 101, also referred to as a containing bottle 101. As illustrated in FIGS. 12 and 13, when the cover assembly 14 is in an upper open position relative to the housing assembly 16, by relative horizontal movement of the cartridge 15, the cartridge 15 may be moved horizontally forwardly and rearwardly between a disengaged uncoupled condition in front of the dispenser assembly 10 as seen in FIG. 13 and to a coupled orientation seen in FIG. 12. With the cartridge 15 in the coupled orientation as in FIG. 12, the cover assembly 14 may be moved relative the housing assembly 16 from the upper open condition of FIG. 12 to a lower closed position of FIG. 1, capturing the cartridge 15 within the dispenser assembly 10 against removal in an operative position for dispensing of fluid from the bottle 101 of the cartridge 15 by activation of the pump mechanism 100 with a lever 19.

Figure 3:
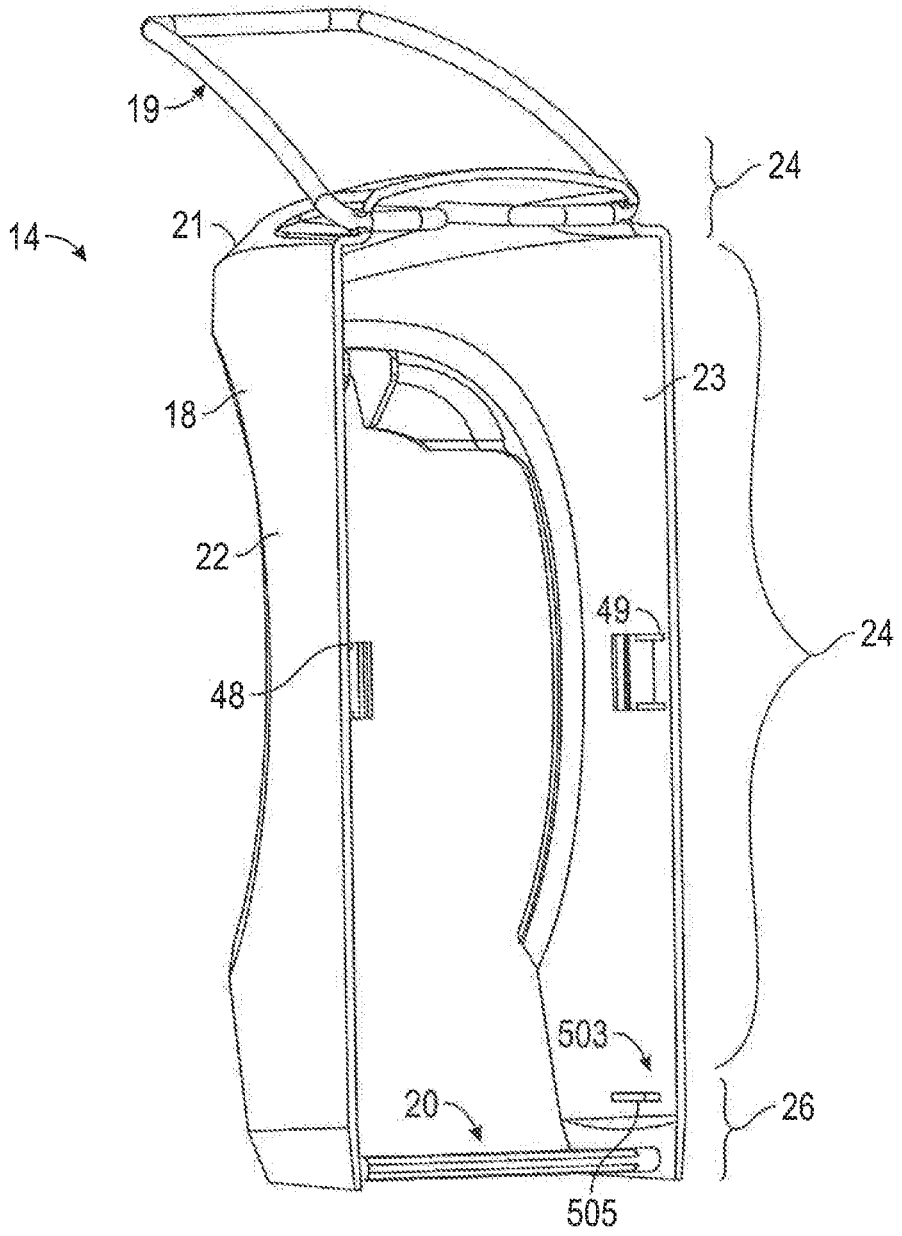
FIG. 3 is a rear pictorial view of a cover assembly of the dispenser assembly shown in FIG. 2.

As seen in FIGS. 2 and 3, the cover assembly 14 includes a cover 18, the lever 19 and a rod member 20. Referring to FIG. 3, the cover 18 includes a top wall 21, a right cover side wall 22 and a left cover side wall 23. The right cover side wall 22 and the left cover side wall 23 are secured together spaced laterally from each other by being connected at an upper end by the top wall 21 and a lower end by the rod member 20. The rod member 20 is a cylindrical member bridging between the side walls 22 and 23 and each end of the rod member 20 is fixedly secured to a lower portion 26 of each of the side walls 22 and 23. Each of the side walls 22 and 23 has a top portion 24 and a lower portion 26 with an intermediate portion 25 bridging between the top portion 24 and the lower portion 26.

Figure 4:
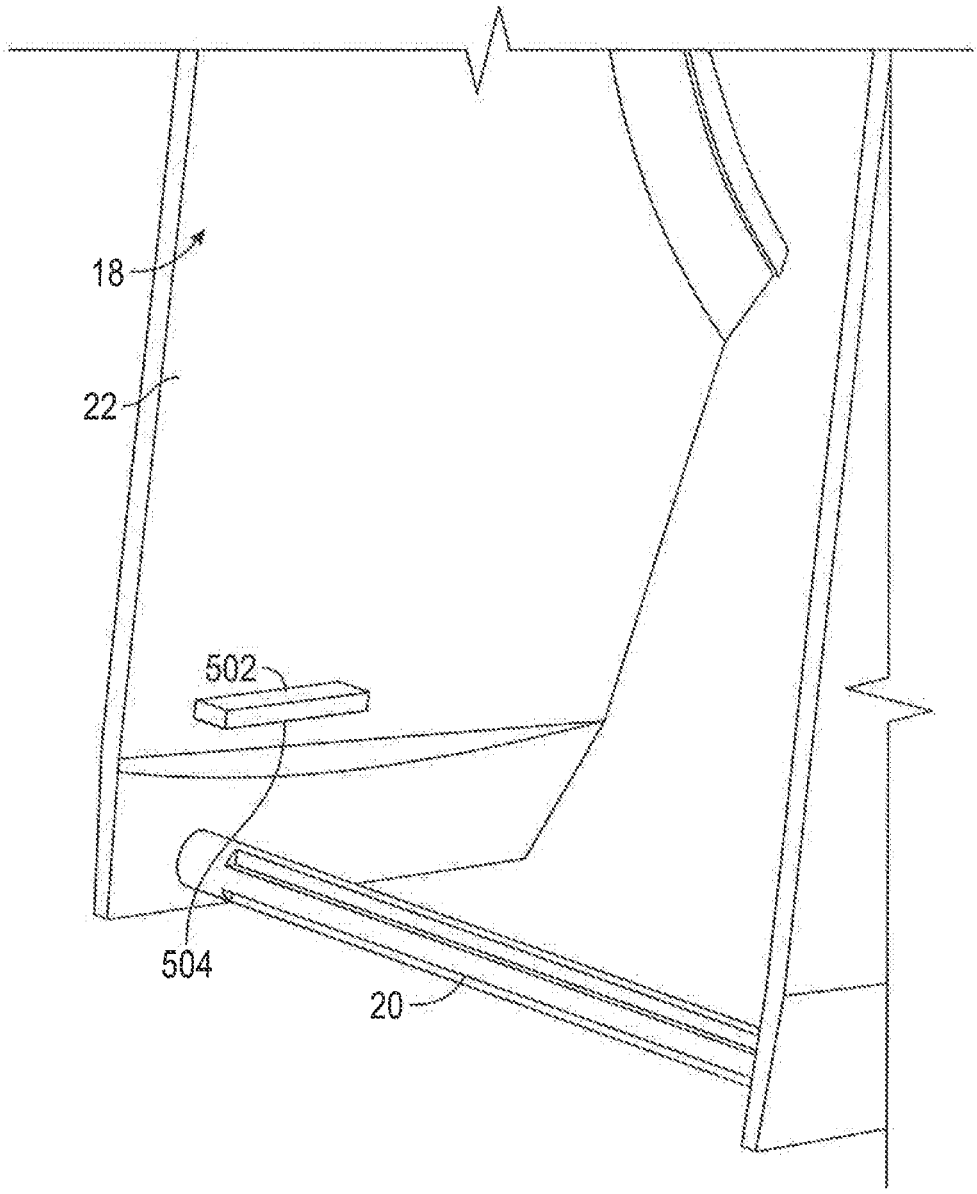
FIG. 4 is a rear pictorial view of a right lift flange on a right cover side wall of the cover assembly of FIG. 3 as viewed downwardly and from above.

Referring to FIG. 3, on the intermediate portion 25 of the right cover side wall 22, there is provided a right latch member 48 and on the intermediate portion 25 of the left cover side wall 23, there is provided a left latch member 49. Each of these latch members 48 and 49 extend laterally inwardly. Referring to FIG. 4, on the lower portion 26 of the right cover side wall 22, there is provided a right lifter flange 502 and on FIG. 3 on the lower portion 26 of the left cover side wall 23, there is provided a left lifter flange 503. Each of these lifter flanges 502 and 503 extend laterally inwardly and each presents a respective downwardly directed lift cam surface 504 and 505, respectively.

Reference is made to FIGS. 5 to 8, which show the housing assembly 16. The housing assembly 16 includes a housing 70 and a pump actuating and holding assembly 205.

The housing 70 has a housing right side wall 200 and a housing left side wall 201 which are fixedly secured together joined by a back wall 202 which bridges between the housing side walls 200 and 201. An interior compartment 46 of the housing 70 is defined between the left and right side walls 200 and 201 for receiving the fluid reservoir 101.

Figure 8:
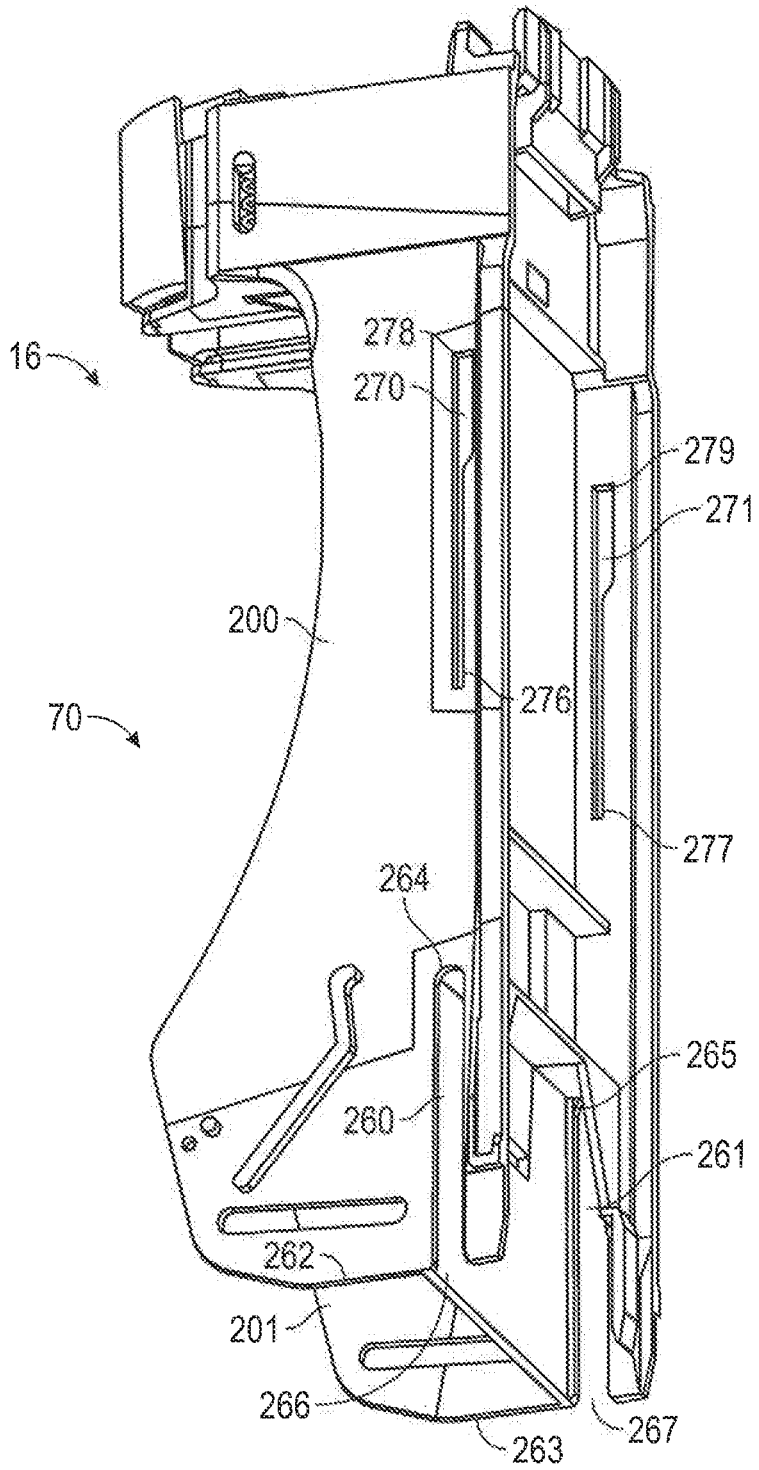
FIG. 8 is a rear pictorial view of the housing assembly of FIG. 5 as seen from the right.

Referring to FIG. 8, each of the right and left housing side walls 200 and 201 carry a respective right and left rod receiving slotways 260 and 261 open at open ends 266 and 267 in bottom edges 262 and 263 of the housing side walls 200 and 201 and extending vertically upwardly to respective blind ends 264 and 265. The rod receiving slotways 260 and 261 are sized so as to receive the rod member 20 of the cover 18 therein and locate the right cover side wall 22 laterally to the right outwardly of the housing right side wall 200 and the left cover side wall 23 laterally to the left outwardly of the housing left side wall 201. When the rod member 20 is within the rod receiving slotways 260 and 261, the slotways 260 and 261 engage the rod member 20 and guide relative sliding movement of the rod member 20 relative to the housing 70. The rod member 20 may pass inwardly and outwardly through the open ends 266 and 267 of the slotways 260 and 261 to disengage the rod member 10 from the slotways 260 and 261 or to engage the rod member 20 in the slotways 260 and 261.

Figure 5:
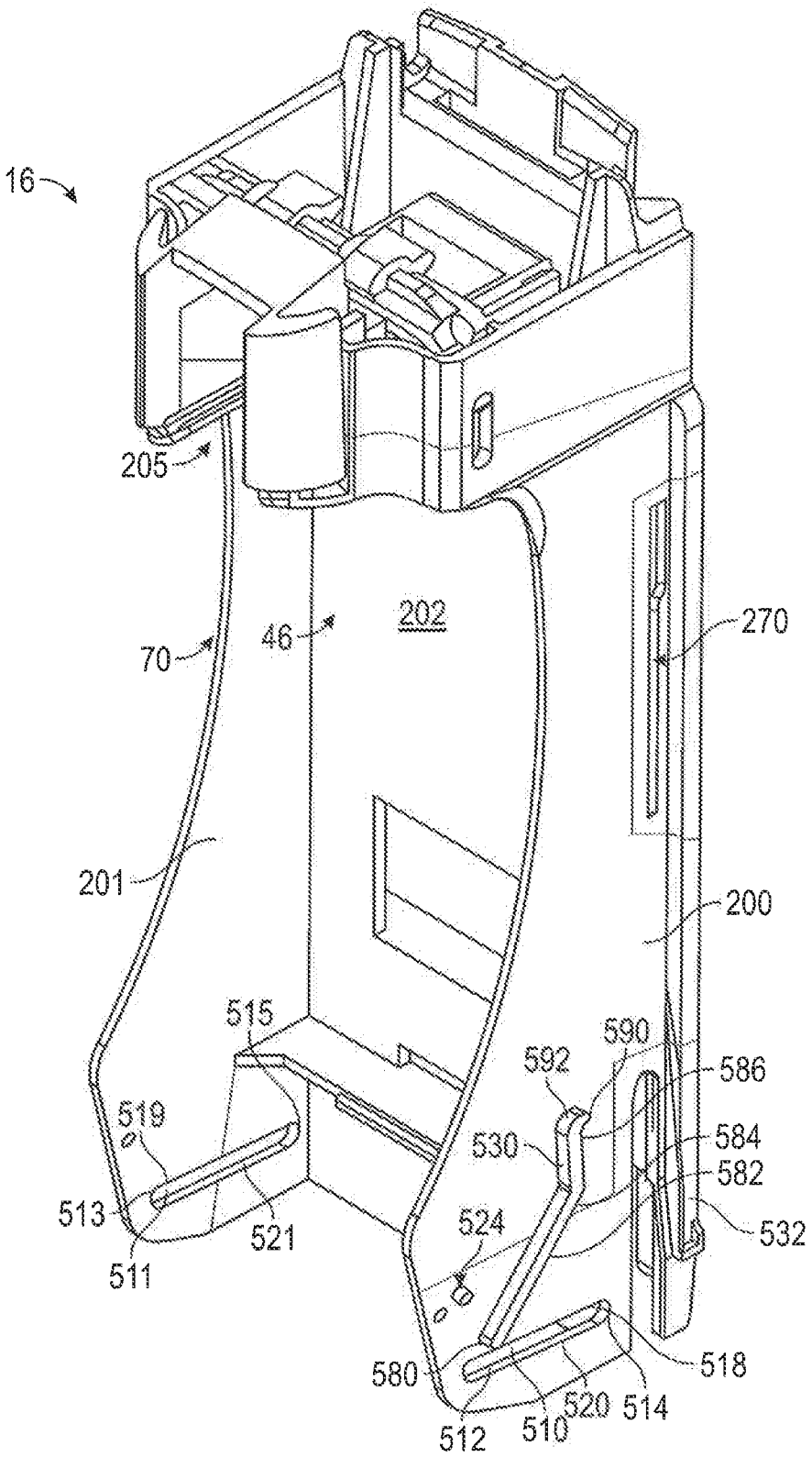
FIG. 5 is a front pictorial view of a housing assembly of the dispenser assembly shown in FIG. 2.
Figure 6:
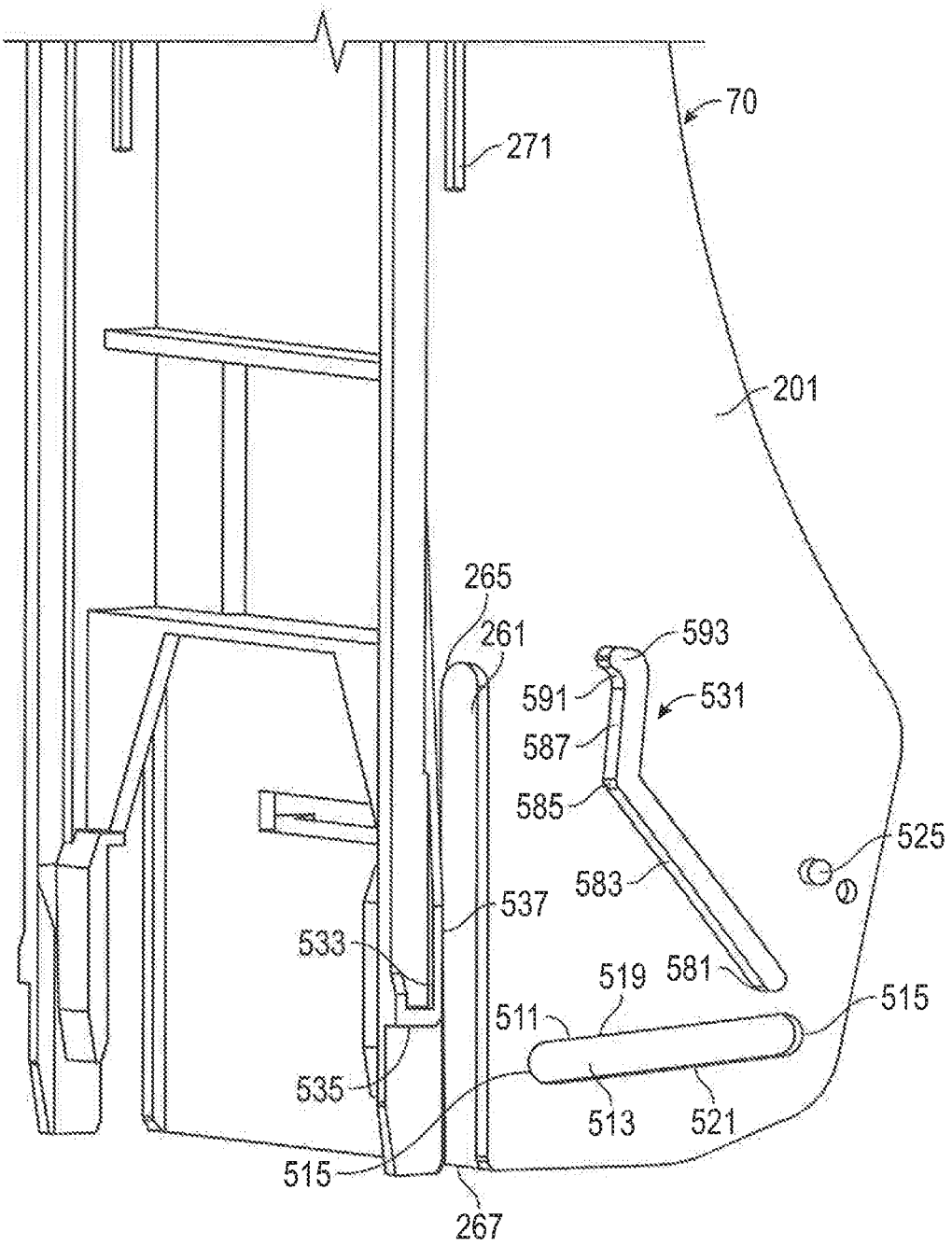
FIG. 6 is an enlarged rear pictorial view of a lower portion of the housing assembly shown in FIG. 5 as seen from the left.

Referring to FIG. 5, each of the left and right housing side walls 200 and 201 carry a respective right and left lifter axle receiving slotway 510 and 511 closed at respective forward ends 512 and 513 and have respective rear ends 514 and 515 with respective upper and lower camming surfaces 518 and 519 and 520 and 521 defining the respective slotways therebetween. As will be described later, the lifter axle receiving slotways 510 and 511 are adapted to receive respective right and left stub axles 522 and 523 of the lifting member 500. Each of the slotways 510 and 511 extend slightly downwardly as each extends rearwardly.

As seen in FIGS. 5 to 8, on the right housing side wall 200, there is provided a rod-like stop button 524 which extends laterally away from the right side wall 200. Also provided on the right housing side wall 200 to extend laterally to the right away from the right housing side wall 200 is a right guide flange 530. The left housing side wall 201 is a mirror image of the right housing side wall 200, and on the left housing side wall 201 there is provided a rod-like stop button 525 which extends laterally away from the left side wall 201 and a left guide flange 531 extending laterally to the left from the left side wall 201 which is an identical mirror image of the right guide flange 530 on the right housing side wall 200.

Figure 7:
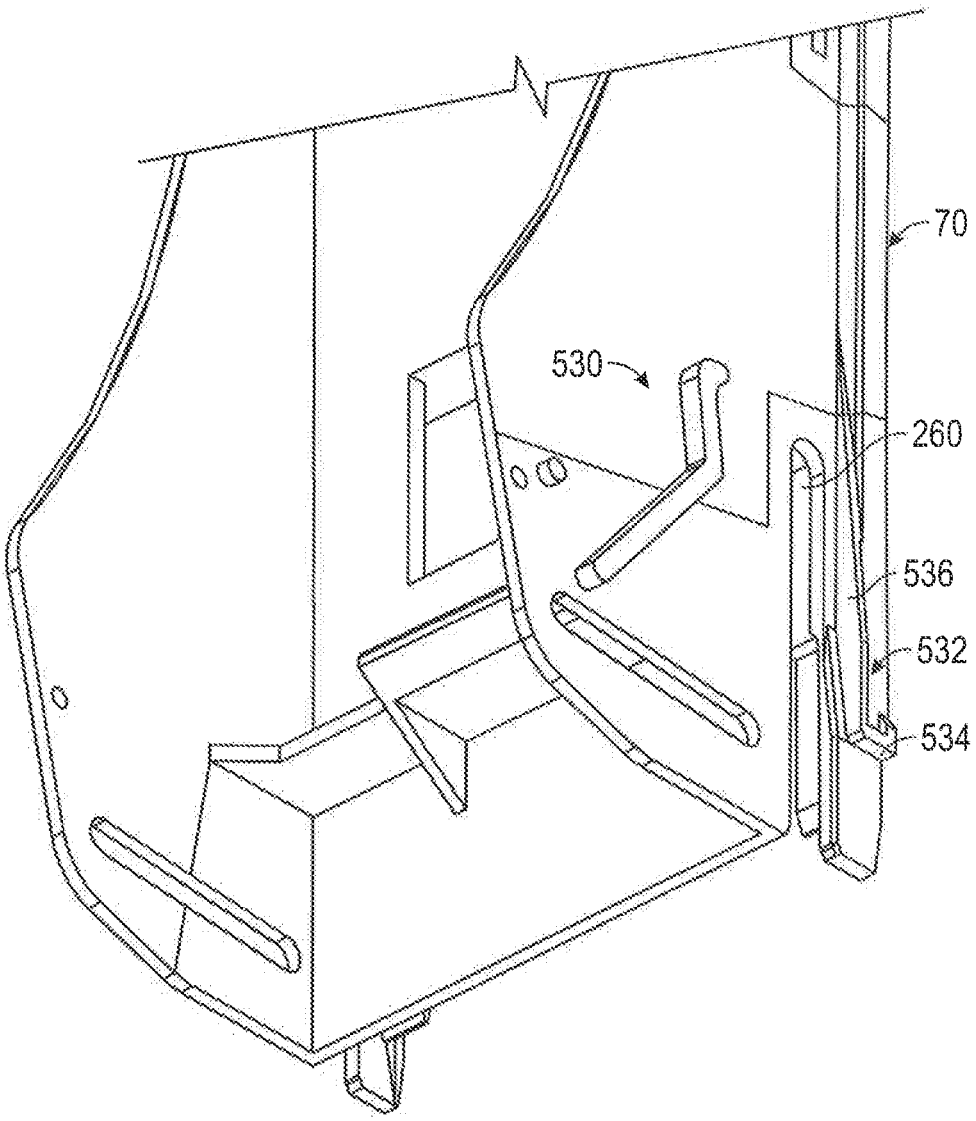
FIG. 7 is an enlarged front pictorial view of the lower portion of the housing assembly shown in FIG. 6 as seen from the right.

Referring to FIG. 7, rearward of the rod receiving slotway 260, the right side wall 200 is provided with a rear guide member 532 which extends laterally to the right of the right side wall 200 so as to present a downwardly directed stop shoulder 534 and a forwardly directed cam shoulder 536. Similarly as seen on FIG. 6, on the left housing side wall 201, there are provided mirror image identical elements, namely a rear guide member 533 which extends laterally to the left of the left side wall 201 so as to present a downwardly directed left stop shoulder 535 and a forwardly directed left cam shoulder 537.

Figure 9:
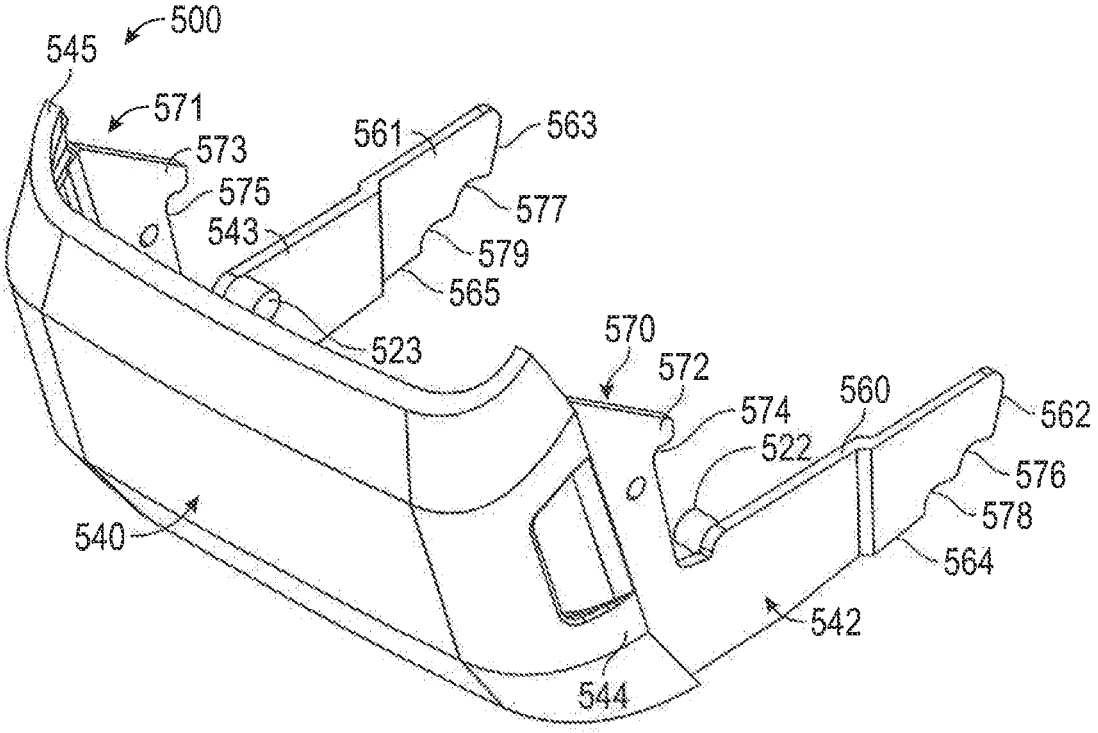
FIG. 9 is a front pictorial view of a cover actuator member or lifting member of the dispenser assembly shown in FIG. 2.
Figure 10:
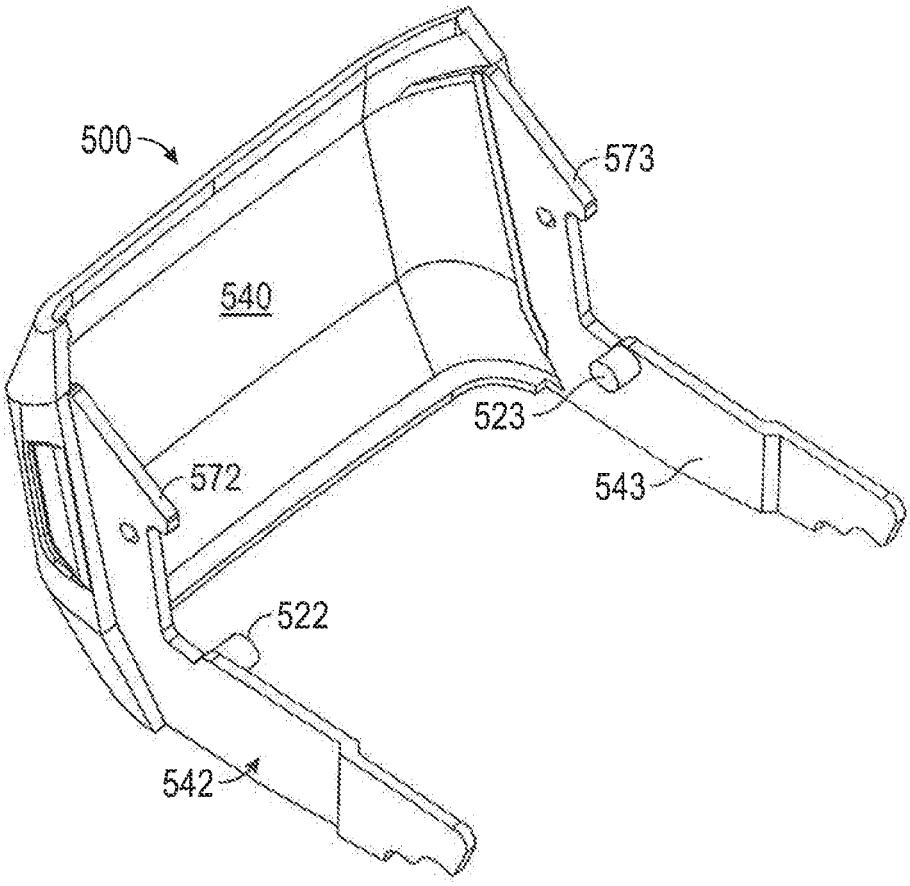
FIG. 10 is a rear pictorial view of the lifting member in FIG. 9 as seen from above.
Figure 11:
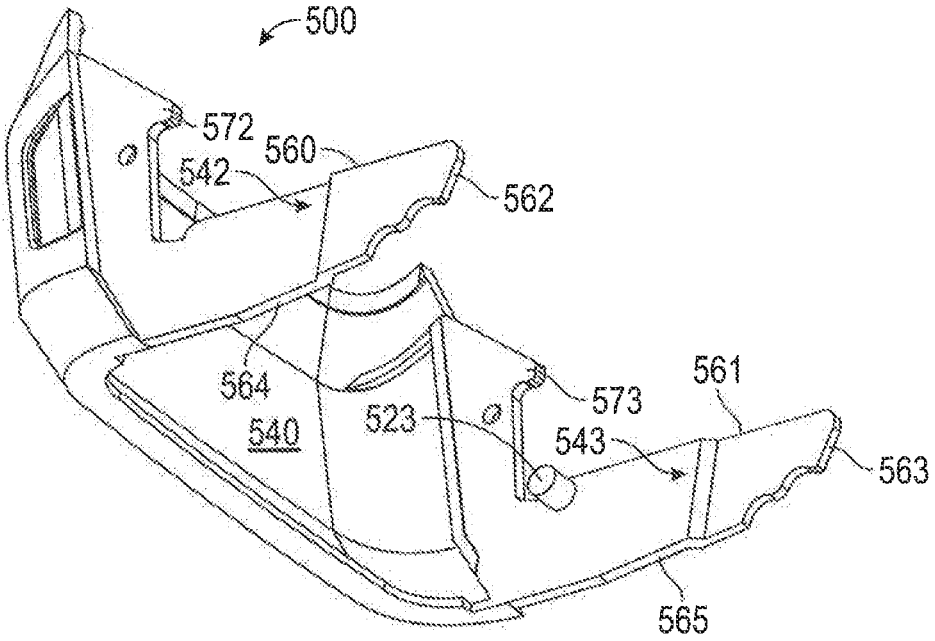
FIG. 11 is a front pictorial view of the lifting member in FIG. 9 as seen from below.

Reference is made to FIGS. 9 to 11 which illustrate the lifting member 500 which is seen to be generally U-shaped having a central forward portion 540 disposed generally vertically on the dispenser assembly 10 in a closed position. The lifting member 500 is symmetrical with a right arm 542 disposed in a generally vertical plane extending rearwardly from a right side 544 of the central forward portion 540 and a mirror image left arm 541 extending forward generally vertically from the left side 545 of the central portion 540. The right stub axle 522 extends laterally inwardly towards the left from the right arm 542 and the left stub axle 523 extends laterally inwardly to the right from the left arm 543. The right arm 542 has an upper surface 560, an end surface 562 and a lower surface 564. Similarly, the left arm 541 has an upper surface 561, an end surface 563 and a lower surface 565. Proximate the forward end of the right arm 542, a right hook portion 570 extends upwardly defining a rearwardly extending hook member 572 extending rearwardly above a bight 574. The hook portion 570 extends downwardly from the bight 574 to merge with the upper surface 564. Similarly, the left arm 541 includes a hook portion 571 with a hook member 573 and a bight 575.

Reference is made to FIG. 8 to describe left and right slide grooves 270 and 271 which extend laterally through the respective left and right housing side walls 200 and 201 rearward of the back wall 202 of the housing 70. Each of the slide grooves 270 and 271 extend vertically from bottom ends 276 and 277 to top ends 278 and 279. The slide grooves 270 and 271 are configured to receive the respective right and left latch members 48 and 49 carried on the right and left cover side walls 22 and 23, and to permit the cover assembly 14 to slide vertically relative to the housing assembly 16 between the upper open position of FIG. 12 and the lower closed position of FIG. 1.

Figure 1:
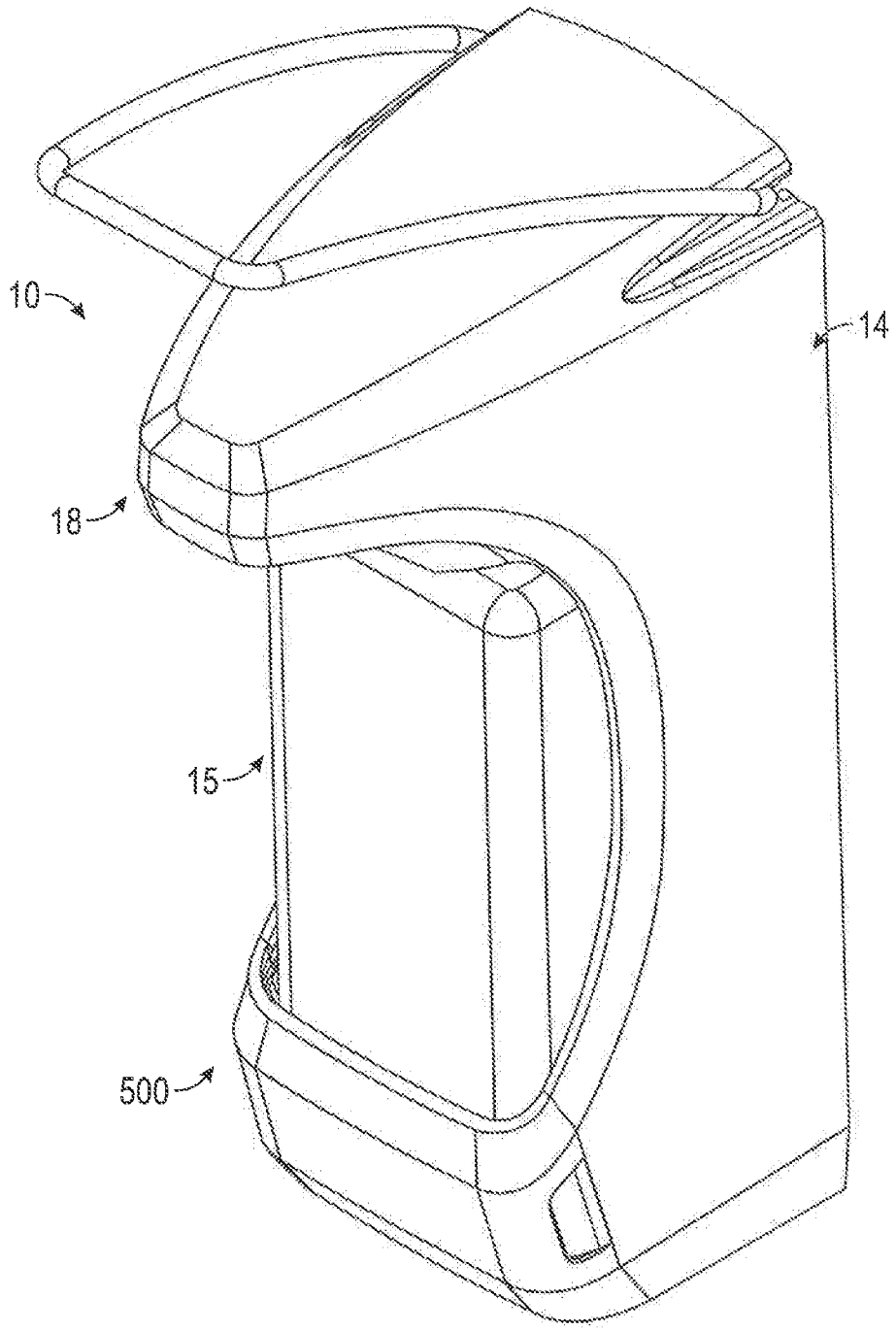
FIG. 1 is a pictorial view of a prior art fluid dispenser assembly in an operative position.

To move the cover assembly 14 relative to the housing assembly 16 between the lower closed position of FIG. 1 and the upper open position of FIG. 12, the user manually engages the lifter member 500 and moves the lifter member 500.

Thus, as explained above, the cover assembly 14 is coupled to the housing assembly 16 for movement between the lower position and an open upper position. The housing assembly 16 has a releasable cover latching mechanism to latch the cover 18 to the housing 70 against vertical movement formed notably by the lifter member 500 and its interaction with the housing 70 and the cover 18, and as well the housing assembly 16 has a lifting mechanism to raise and lower the cover 18 relative the housing 70 formed notably by the lifter member 500 and its interaction as in the manner of a lever mechanism, preferably a cammed lever with multiple pivot points, with the housing 70 and the cover 18.

Figure 14:
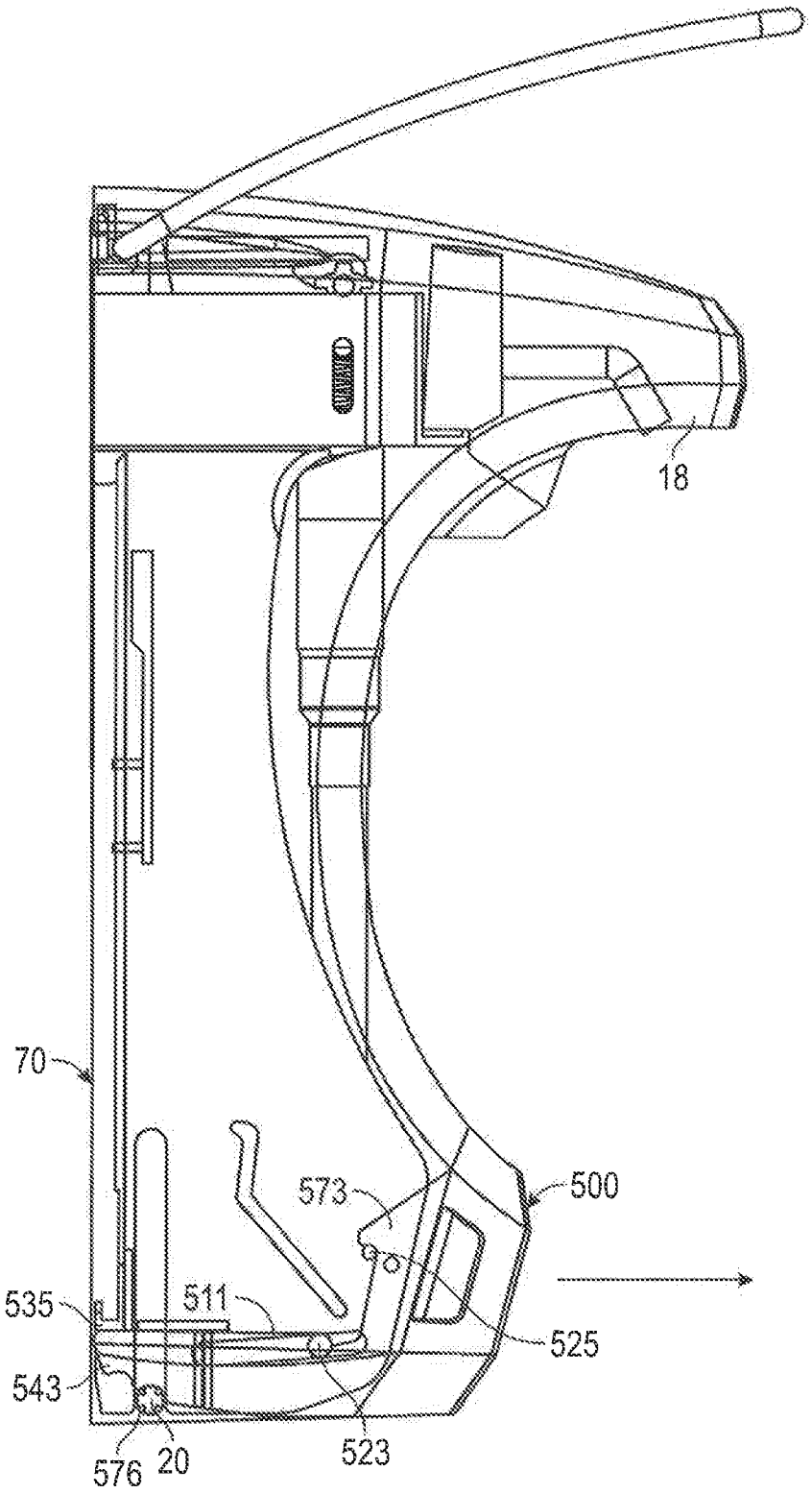
FIG. 14 is a schematic left side view of the dispenser assembly of FIG. 1 with the cover assembly in a lower closed position and a latched condition, and with the reservoir of the cartridge not shown and each of the lifting member and the cover drawn as being transparent.
Figure 15:
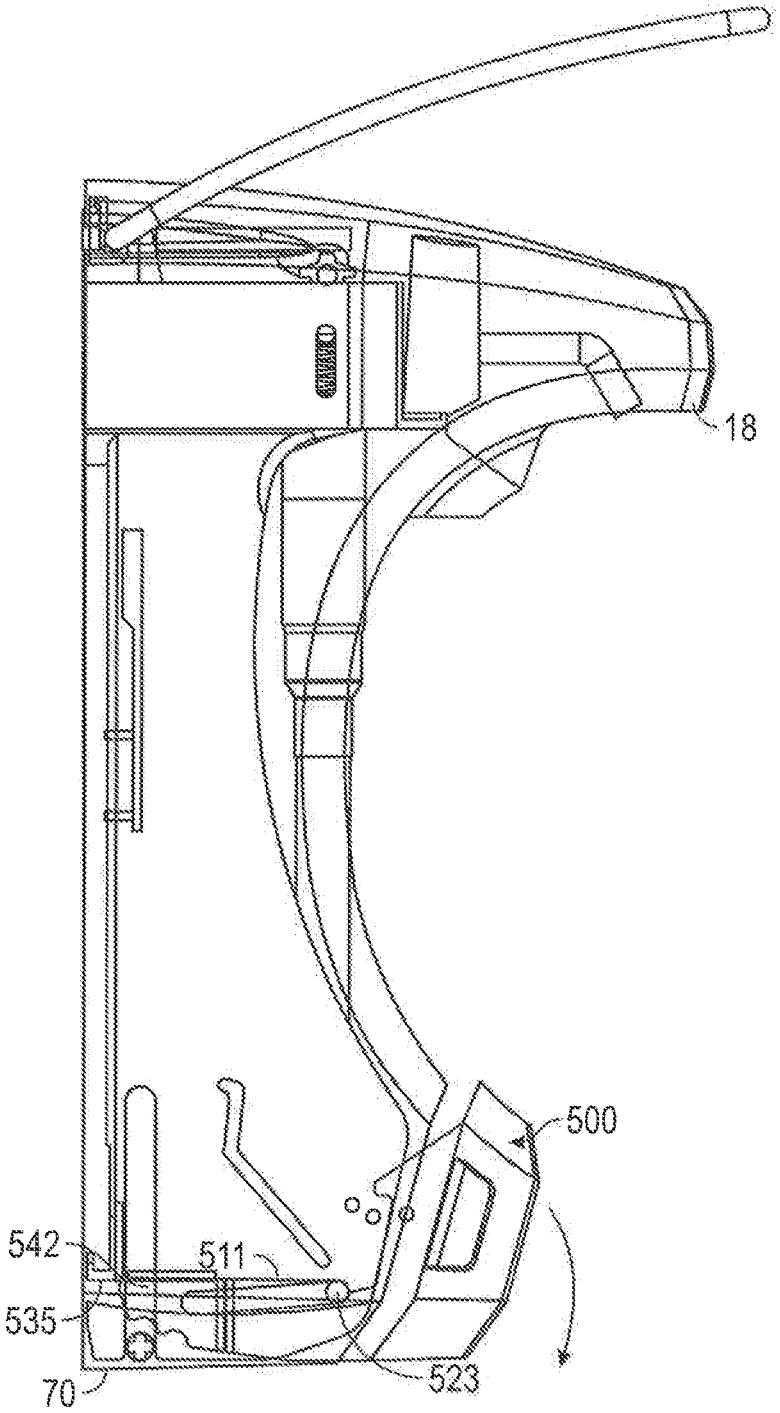
FIG. 15 is a schematic left side view of the dispenser assembly of FIG. 1 with the cover assembly in the lower closed position and an unlatched condition, and the reservoir of the cartridge not shown and each of the lifting member and the cover drawn as being transparent.
Figure 16:
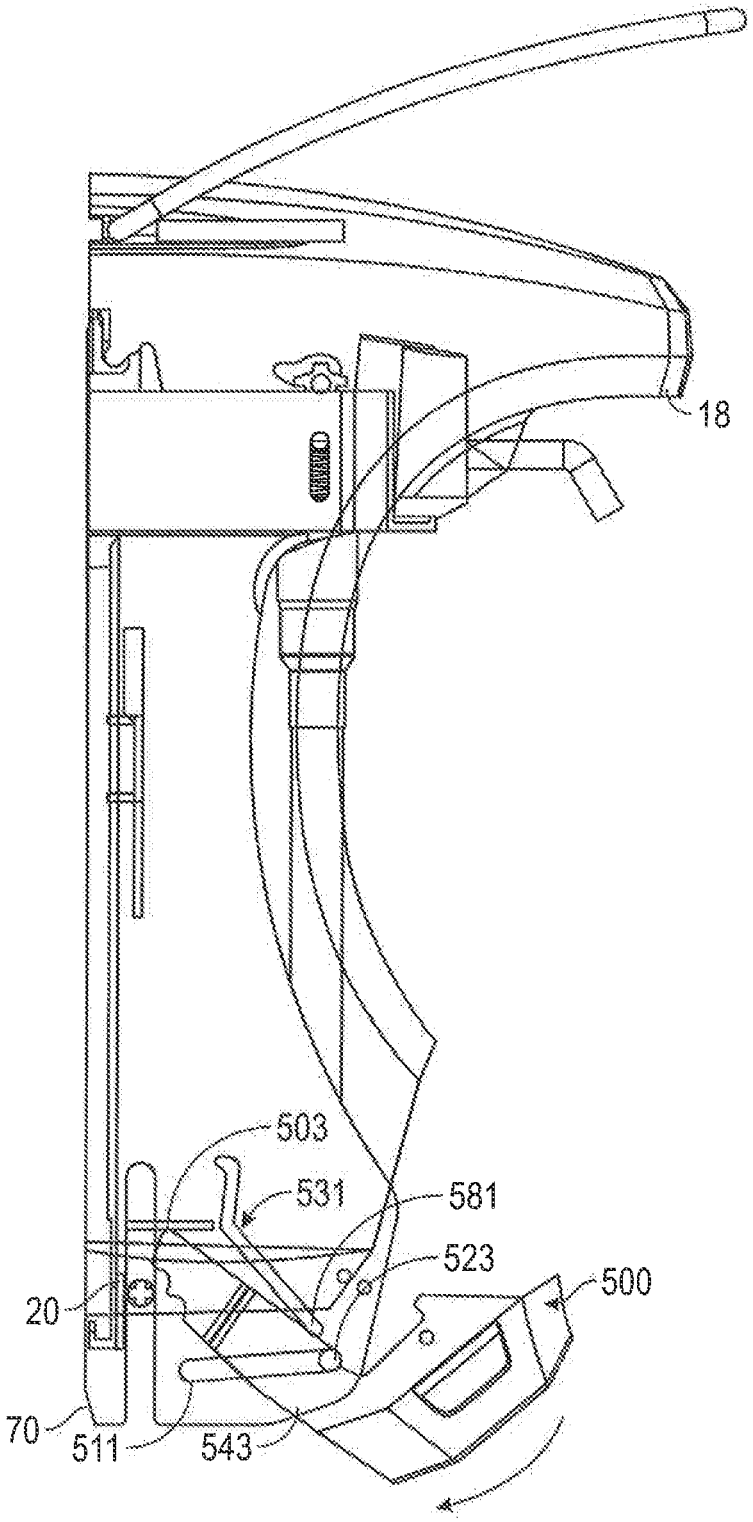
FIG. 16 is a schematic left side view of the dispenser assembly of FIG. 1 with the cover assembly in a first partially open position, and the reservoir of the cartridge not shown and each of the lifting member and the cover drawn as being transparent.
Figure 17:
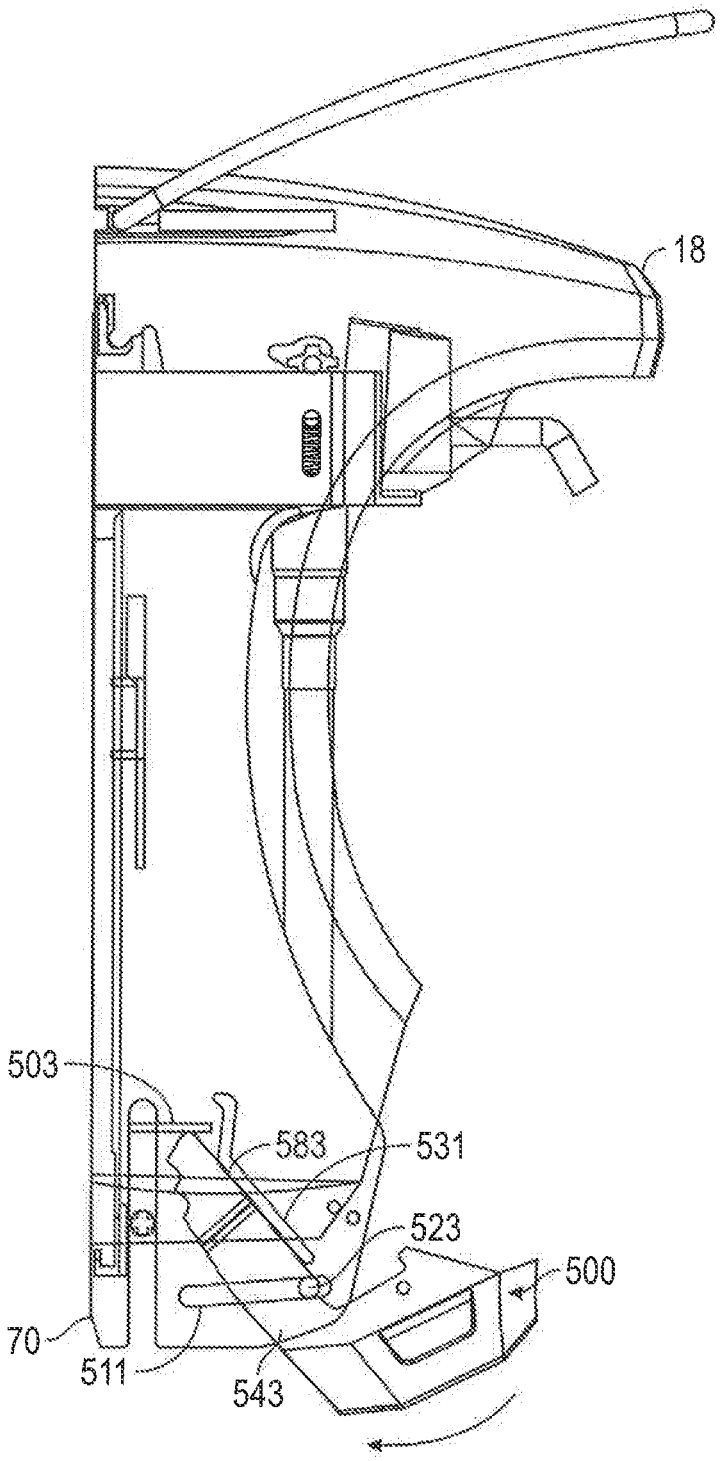
FIG. 17 is a schematic left side view of the dispenser assembly of FIG. 1 with the cover assembly in a second partially open position, and the reservoir of the cartridge not shown and each of the lifting member and the cover drawn as being transparent.
Figure 18:
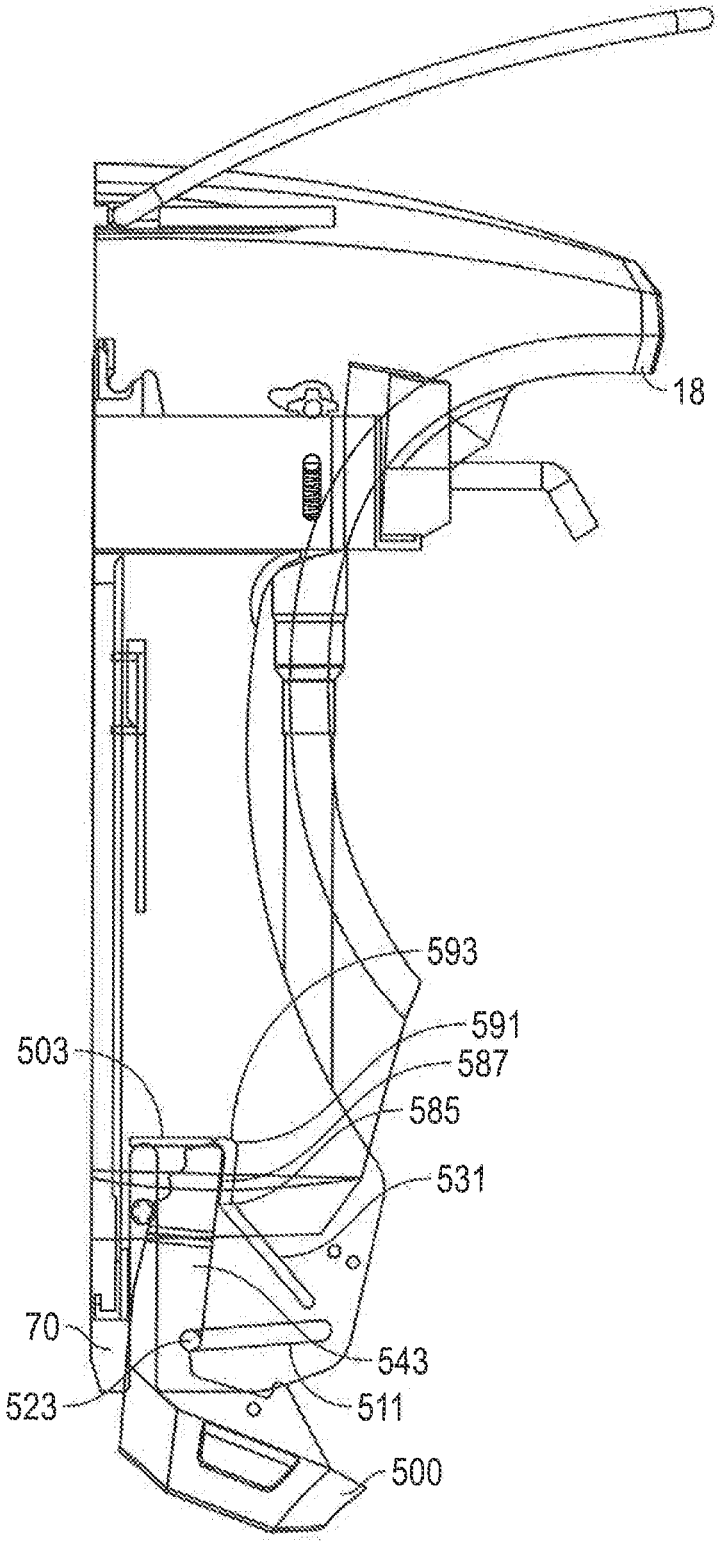
FIG. 18 is a left side view of the dispenser assembly of FIG. 1 with the cover assembly in the fully open upper position and the reservoir of the cartridge not shown and each of the lifting member and the cover drawn as being transparent.

Reference is made to FIGS. 14 to 18, each of which is a schematic left side view of the dispenser assembly 10 of FIG. 1 in different positions of the cover assembly 14 between a lower closed position, as seen in FIG. 14 and FIG. 15, and a fully open upper position as shown in FIG. 18. In each of FIGS. 14 to 18, the bottle reservoir 101 of the cartridge 15 is not shown. The pump assembly 100 is, however, shown. In each of FIGS. 14 to 18, each of the lifting member 500 and the cover 18 are shown as being transparent while the remainder of the components are shown in solid lines. Showing the cover 18 and the lifting member 500 to be transparent assists in understanding, as seen in left side view, the relative juxtaposition of these elements in the different positions and conditions they can assume in movement between the lower closed position and latched condition as shown in FIG. 14 to the lower closed position and unlatched condition in FIG. 15, through the first partially open position of FIG. 16, through the second partially open position of FIG. 17 and to the fully open upper position of FIG. 18. In both FIGS. 14 and 15, the cover 18 remains in a lower closed position. In moving from FIGS. 15 to 18, the cover is successively moved from the lower closed position of FIGS. 14 and 15 successively to the upper fully open position of FIG. 18. As well, it can be seen that in a comparison of FIGS. 15, 16, 17 and 18, the lifting member 500 is from the position of FIG. 15 successively pushed downward and rearwardly with the lifting member 500 both pivoting about horizontal axes and pivot points as well as having its stub axle 523 slide rearward in the slotway 511 of the left housing side wall 201.

In understanding FIGS. 14 to 18, it is useful to understand that the components are being viewed from the left side in which the left side wall 23 of the cover 18 is to the left of the left arm 543 of the lifting member 500 which is to the left of the left side wall 201 of the housing 70. Thus, the left arm 541 is in between the left side wall 201 of the housing 70 and the left side wall 23 of the cover 18.

Referring to FIG. 14, FIG. 14 illustrates the cover assembly 14 in the lower closed position and a latched condition. Absent the lifting member 500, the cover assembly 14 including the cover 18 with its lever 19 and rod member 20 are free to be slid axially upwardly relative to the housing assembly 16 between the lower closed position and upper positions including the fully open upper position of FIG. 18.

In each of FIGS. 14 to 18, the lifting member 500 is coupled to the housing assembly 16 with the stub axles 522 and 523 of the lifting member 500 slidably received within the slotways 510 and 511 of the housing 70. As seen in FIG. 14, the left stub axle 523 is spaced rearwardly from the front end of the left slotway 511 and a rear end of the left arm 543 is located underneath the left downwardly directed stop shoulder 535 of the left rear guide member 533. The left arm 541 overlies the rod member 20 with the rod member 20 engaged in a downwardly directed forward concave recess 579 of the lower surface 565 of the left arm 543. In the position of FIG. 14, the lifting member 500 is considered to be latching the cover 18 against upward movement and thus providing a latched condition to the dispenser assembly 10.

In moving from the position of FIG. 14 to the position of FIG. 15, a user manually pulls the lifting member 500 forwardly as shown by the arrow. As a result, the left stub axle 523 slides forwardly in the slotway 511 to proximate the forward end 513 of the slotway 511 and, in so doing, the rear end 563 of the left arm 543 is moved forwardly of the left rear guide member 533. In the position of FIGS. 14 and 15, the lower surface 505 of the left lifting flange 503 on the left side wall 23 of the cover 18 rests on top of the upper surface 561 of the left arm 543.

In moving from the position of FIG. 15 to the position of FIG. 16, the lifting member 500 is pushed downwardly and rearwardly by a user indicated by the arrow. The lifting member 500 pivots about its left stub axle 523 within the left slotway 511. Proximate the rear end 563 of the left arm 543, the upper surface 561 engages the left lifting flange 503 to slide the cover 18 vertically upwardly relative to the housing 70. The lifting member 500 pivots about its stub axle 523 within the front end 513 of the left slotway 511 until the upper surface 561 engages a lower end 581 of the left guide flange 531 as seen in FIG. 16. In moving from the position of FIG. 16 to the position of FIG. 17, with the lifting member 500 being pushed downward and rearward in the direction of the arrow, the lifting member 500 pivots about the lower end 581 of the left guide flange 531 until the upper surface 561 of the left arm 543 is flush with the long straight section 583 of the left guide flange 531 at which point the left stub axle 523 is ready to move rearwardly in the left slotway 511. The engagement of the end surface 563 of the left arm 543 with the left lifting flange 503 moves the cover 18 vertically upwardly from the position of FIG. 16.

In moving from the position of FIG. 17 to the position of FIG. 18, the lifting member 500 is pushed downwardly and rearwardly as indicated by the arrow. The left stub axle 523 slides rearwardly in the left slotway 511 as the upper surface 561 of the left arm 543 pivots about a pivot point at the corner 585 intermediate the long straight section 583 and the short straight section 587 of the left guide flange 531. The end surface 563 of the left arm 543 engages the left lifting flange 503 of the cover 18 to move the cover 18 upwardly from the position of FIG. 16. The left stub axle 523 moves in the slotway 511 to the rear end 515 of the slotway 511 at a time when the upper surface 561 of the left arm 543 comes to lie flush with the short straight section 587 of the guide flange 531 and into a bight 591 formed between the short straight section 587 of the guide flange 531 and a horizontal end portion 593 of the guide flange 531. The upper end 561 of the left arm 543 engages the lifting flange 503 to move the cover 18 upwardly to the open position shown in FIG. 18. The lower surface 565 of the left arm 543 may engage the forwardly directed rear guide member 533 to prevent further rearward movement of the lifting member 500.

In the condition shown in FIG. 18, the rear end 563 of the left arm 541 engages the lifting flange 503 at an engagement portion vertically forward of the stub axle 523. In this position, the weight of the cover 18 acting vertically downward attempts to rotate the lifting member 500 clockwise about the stub axle 523, that is, in a direction away from a direction that the lifting member 500 must move and rotate to permit movement of the cover 18 from the position of FIG. 18 to the position of FIG. 17.

Moving of the dispenser assembly 10 from an open position as shown in FIG. 18 towards the closed and unlatched position of FIG. 15 is accomplished by a user pulling the front portion 540 of the lifting member 500 upwardly and forwardly. The motion of the lifting member 500 in moving from the position of FIG. 18 to the position of FIG. 15 does not necessarily precisely duplicate the relative motion that occurs as described above in moving from the position of FIG. 15 to the position of FIG. 18. However, in movement from the position of FIG. 18 to the position of FIG. 15, the left arm 543 is maintained above the rod member 20 and constrained to have its end surface 563 forward of the forwardly directed rear guide member 533 at least by engagement with the rear guide member 533. The lower surface 565 of the left arm 543 will be maintained at least proximate its end surface 563 above the rod member 20. In a case where the cover assembly 14 may become stuck and may not under its own weight slide downwardly relative the housing 70, the downwardly directed rear arcuate portion 577 of the lower surface 561 proximate the end surface 563 of the left arm 543 will come to engage the upper surface of the rod member 20 and urge the rod member 20 downwardly thus moving the rod member 20 and hence the cover assembly 14 downwardly.

In the sequence of movement from FIG. 14 to FIG. 18 in moving between the lower closed position of FIG. 14 and the fully open position of FIG. 18, the stub axle 523 moves firstly forwardly in the slotway 201 to a forward position then rearwardly to a rear position. Conversely, in the sequence of movement from FIG. 18 to FIG. 14 in moving between the fully open position of FIG. 18 and the lower closed position of FIG. 14, the stub axle 523 moves firstly forwardly to the forward position then rearwardly toward the rear position.

The dispenser assembly 10 includes a mirror image right side to the left side shown in FIGS. 14 to 18 and, on the right side, the right stub axle 522 of the lifting member 500 is slidably received within the right side slotway 510 of the housing 70 and slides within the slot 511 to the different positions in the same sequence and manner as the left side stub axle 523 slides within the left side slotway 201.

The prior art thus discloses a cover assembly 14 in which the cover 18 slides upwardly and downwardly relative to the housing 70 by the use of a relatively simple lifting member 500 mechanically linked at a lower end of the housing 70 between the housing 70 and the cover 18. The lifting member 500 acts in the manner of a lever in the sense of being pivoted relative the housing 70 about at least one horizontal axis, and preferably about a plurality of different axes at different positions of the stub axles 522 and 523 in the slotways 510 and 511, some of which axes are centered on the guide flanges 530 and 531 as fulcrum or pivot points.

Figure 19:
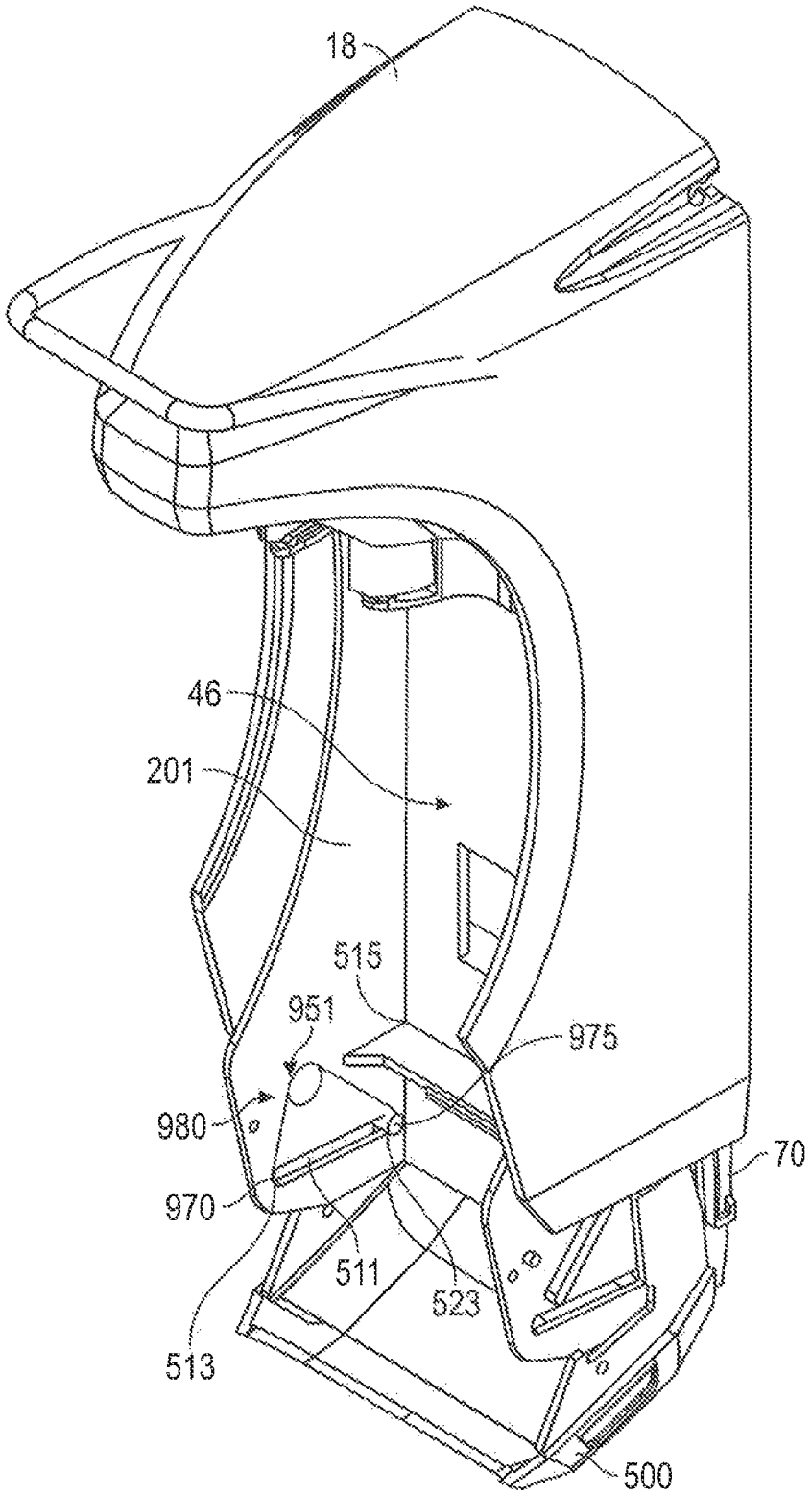
FIG. 19 is a pictorial view of a dispenser assembly in accordance with a first embodiment of the present invention, with a cover assembly of the dispenser assembly in an upper fully open position.
Figure 20:
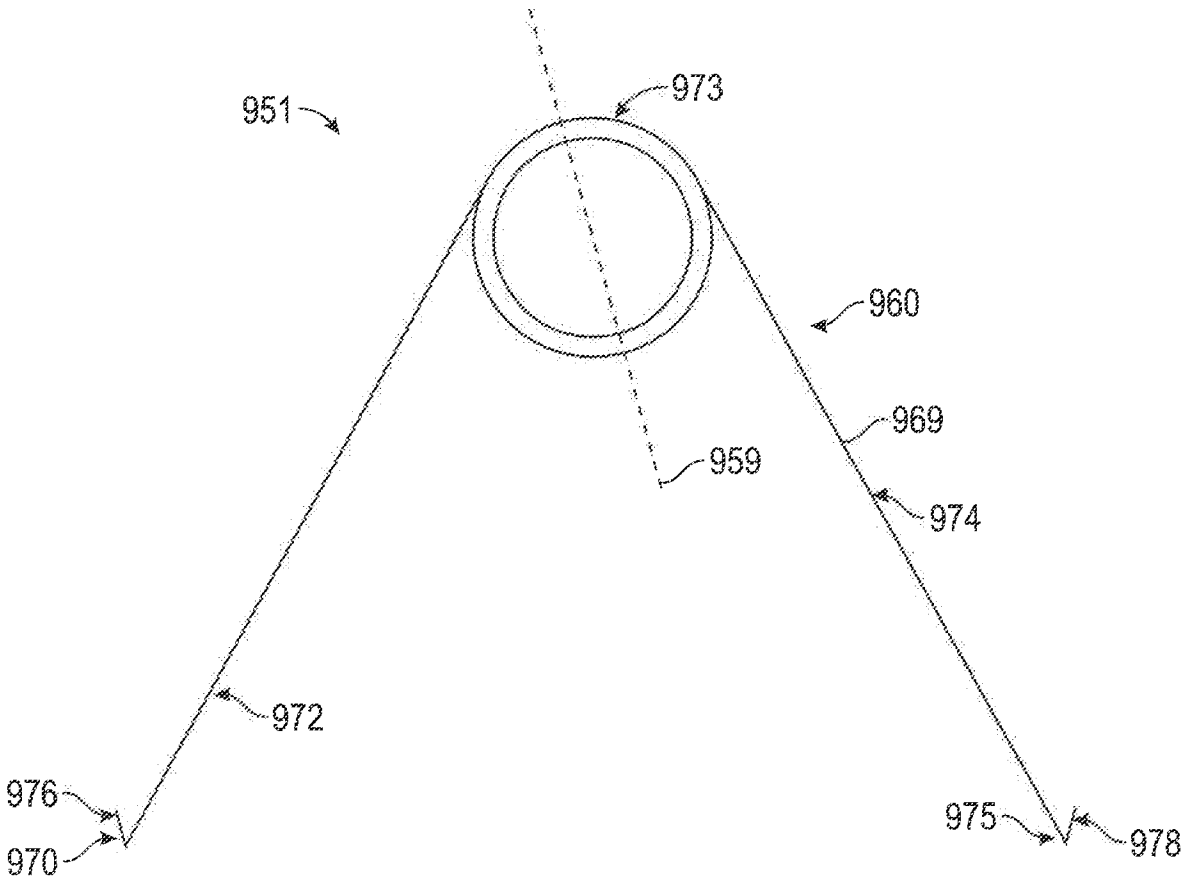
FIG. 20 is a pictorial view of a tension spring of the dispenser assembly shown in FIG. 19.

Reference is now made to FIGS. 19 and 20, which show an improvement over the dispenser assembly 10 as shown in FIGS. 1 to 18 in accordance with a first embodiment of the present invention, wherein like numerals are used to denote like components. As shown in FIG. 19, a left side spring mechanism 951, which is also referred to as a biasing mechanism 951, is provided to bias the left stub axle 523, which is also referred to as an engagement member 523, a sliding member 523, and an axle member 523, rearwardly in the slotway 511 from the forward position towards the rear position and a mirror image right side spring mechanism (not shown) is provided to bias the right side stub axle 523 rearwardly in the slot 510 from the forward position towards the rear position. The spring mechanisms 951 preferably bias each of their respective right and left stub axles 522 and 523 at least as far rearwardly as the position each assumes in the lower closed position as seen in FIG. 14. This has the advantage of the spring mechanisms 951 moving the cover assembly 18 to the lower closed position and holding the cover assembly 18 to the lower closed position unless the bias of the spring mechanisms 951 biasing the cover assembly 18 to the lower closed position is overcome.

Reference is made to FIG. 20 showing a first form of a spring mechanism 951 comprising a known torsion spring 960 formed from a metal wire 969 extending from a first end 970 as a first straight arm 972 to a center coil 973, coaxially about a coil axis 959, and from the coil 973 to a second straight arm 974 that ends at a second end 975. The first end 970 of the torsion spring 960 carries a first end tang 976 which extends normal to the first straight arm 972 and parallel the coil axis 959. The second end 975 of the torsion spring 960 carries a second end tang 978 which extends normal to the first straight arm 972 and parallel the coil axis 959.

As seen on FIG. 19, the torsion spring 960 is mounted on the inside of left side wall 201 of the housing 70 with the first end 970 of the torsion spring 976 being secured to the left side wall 201 proximate the front end 513 of the slotway 511 in a small opening transversely through the left side wall 201 proximate the front end 513 of the slotway 511 and the second end 975 of the torsion spring 960 secured to the left stub axle 523 in a small opening coaxially into the left stub axle 523. The inherent bias of the torsion spring 960 biases the left stub axle 523 toward the rear end 515 of the slotway 511.

Two substantially identical mirror image spring mechanisms 951 are preferably provided to bias the right and left axles 252 and 523 towards the rear in the respective slotways 510 and 511. This has the advantage of assisting in keeping the lifter member 500 to have its arms 542 and 543 maintained in alignment parallel to the right and left side walls 200 and 201 of the housing 70.

Figure 21:
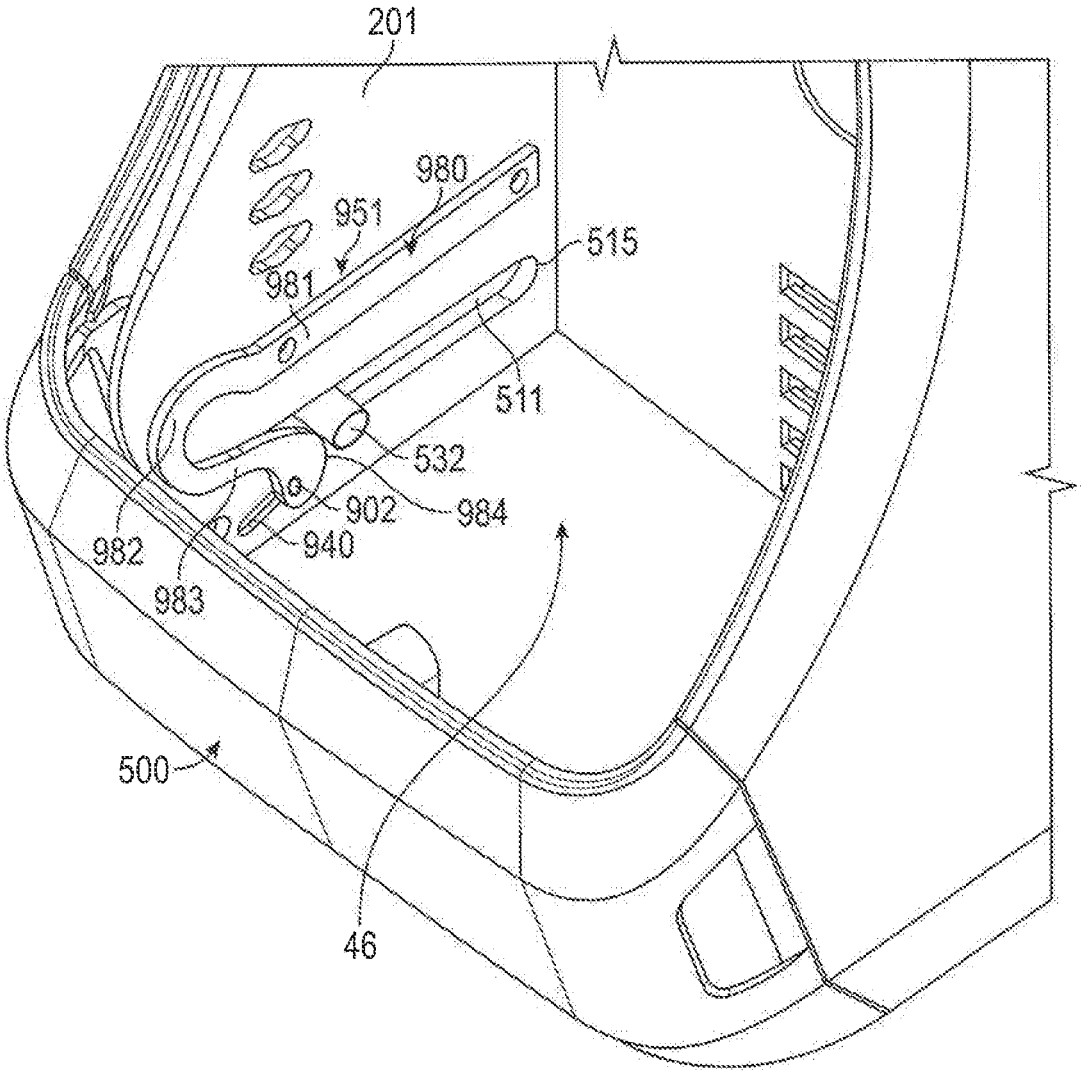
FIG. 21 is a pictorial view of a dispenser assembly in accordance with a second embodiment of the present invention, with a cover assembly of the dispenser assembly in a closed position and showing placement of a flat spring mechanism.
Figure 23:
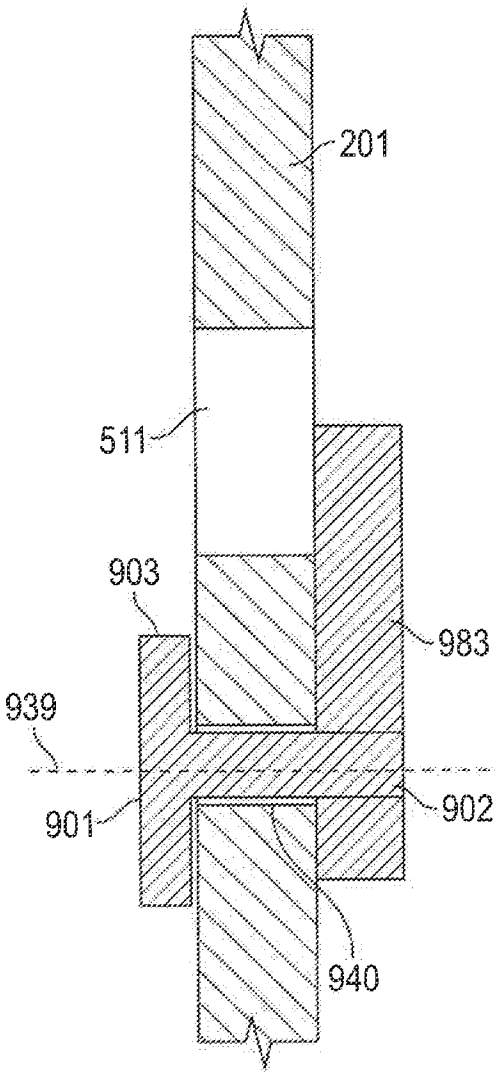
FIG. 23 is a front cross-sectional view of a left side wall and spring member shown in FIG. 21 centrally through a spring stub axle.
Figure 22:
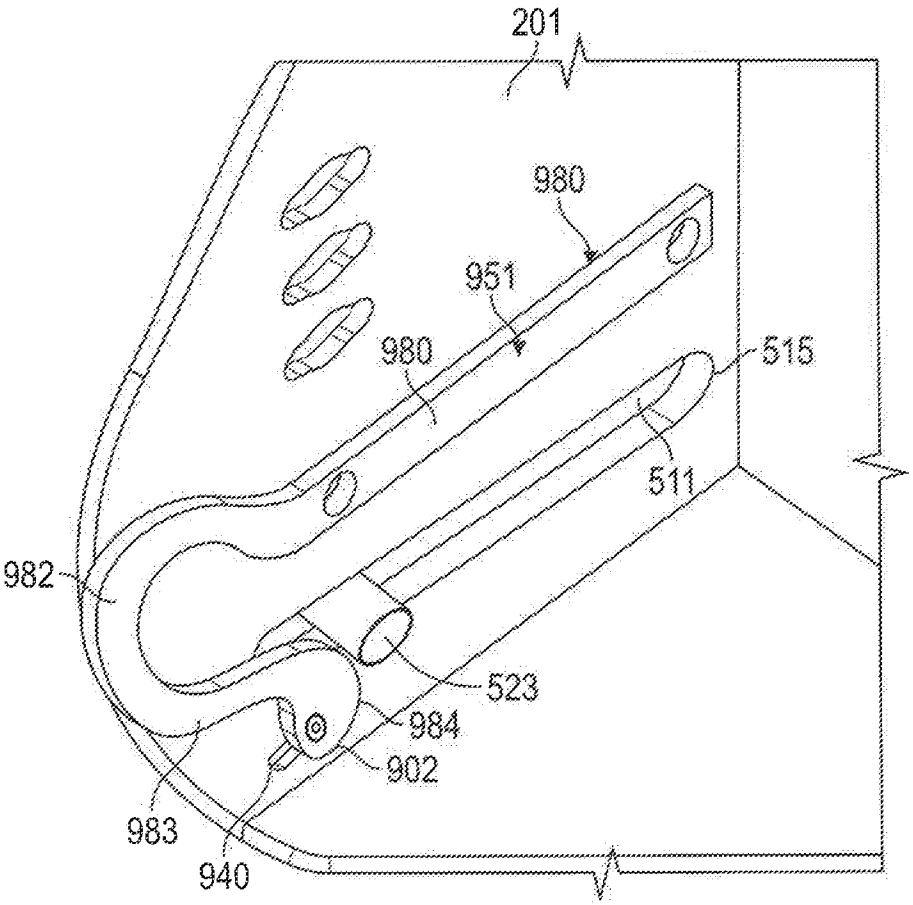
FIG. 22 is a pictorial view of a portion of the dispenser assembly as shown in FIG. 21 with the flat spring mechanism but in a position with the cover assembly partially opened from the closed position shown in FIG. 21.

Reference is made to FIGS. 21 to 23 showing a second form of a spring mechanism 951 in accordance with a second embodiment of the present invention, in which like numerals are used to denote like components. The spring mechanism 951 as shown in FIGS. 21 to 23 comprises a flat spring member 980 that has a flat planar portion 900 or flat planar body 900 such as can be cut from a flat planar sheet of plastic material. The flat planar portion 900 has a right laterally inner side surface 932 and a left laterally outer side surface 933 lying in parallel planes and spaced a uniform thickness. The left laterally outer side surface 933 can also be referred to as a first lateral side 933 and the right laterally inner side surface 932 can also be referred to as a second lateral side 932. The flat planar portion 900 is to be considered to lie in a flat planar central plane between the side surfaces 932 and 933. The flat planar portion 900 has a hook-like shape with an anchoring portion 981 in the form of a first arm 981 connected by a deflecting portion 982 in the form of a resilient bight 982 to an engagement portion 983 in the form of a second arm 983. The first arm 981 is secured to the inside of the left side wall 201 of the housing 70 locating an end surface 984 or engagement surface 984 of the second arm 983 disposed in the path of the left stub axle 523 for engagement between the stub axle 523 and the end surface 984 as the left stub axle 523 slides in the slotway 511 forward from a first engagement position of the left stub axle 523 rearward in the slotway 511 from a position of the left stub axle 523 representing the closed position of the cover assembly 14 in FIG. 14. Movement of the left stub axle 523 in the slotway 511 forwardly from the first engagement position deflects the spring member 980 against its inherent bias with the spring member 980 in attempting to return to an inherent unbiased position biases the left stub axle 523 toward the rear end of the slotway 511 and, for example, as shown in FIG. 21 toward the closed position of the cover assembly 14 in FIG. 14.

FIG. 21 is a pictorial view of the dispenser assembly 10 with the cover assembly 14 in closed position and showing placement of the spring mechanism 951 with the flat spring member 980. FIG. 22 is a pictorial view of but a portion of the dispenser assembly 10 as shown in FIG. 21 but in a position in which the cover assembly 14 is partially opened from the closed position show in FIG. 21 as is represented in FIG. 22 by the left stub axle 523 being moved forwardly in the slotway 511 compared to FIG. 21. As seen in FIG. 22, the second arm 983 has been deflected downwardly and forwardly as the left stub axle 523 engages the end surface 984 and deflects the second arm 983 downwardly and rearwardly. As seen in FIG. 22, the bight 982 of the spring member 980 appears enlarged in spacing between the first arm 981 and the second arm 983 compared to FIG. 21.

The left side wall 201 of the housing 70 is provided with a spring guide slot 940 extending laterally through the left side wall 201 with the spring guide slot 940 extending downwardly as it extends forwardly. A spring rod 902 is secured to the second arm 983 and extends horizontally laterally outwardly from the second arm 983 to be received in and slide within the spring guide slot 940. Engagement between the spring rod 902 and the spring guide slot 940 guides the spring member 980 in its deflection.

Reference is made to FIG. 23 which is a front cross-sectional view through the left side wall 201 of the housing 70 and the spring member 980 as shown in FIG. 21, vertically through a center axis 939 of the spring rod 902. A right hand end portion of the spring rod 902 is fixed to the flat planar portion 900. The spring rod 902 extends outwardly through the spring guide slot 940 to a left hand end portion of the spring rod 902 which carries an enlarged diameter head member 903. The head member 903 has a diameter greater than a vertical width of the spring guide slot 940 so as to engage the laterally exterior side surface 936 of the left side wall 201 and serves to assist in keeping the second arm 983 adjacent the left side wall 201, preferably with the laterally inner side surface 932 of the flat planar portion 900 over the second arm 983 in sliding engagement with a laterally interior side surface 935 of the left wall 201 and thereby assist in maintaining the flat planar portion 900 over the first arm 981, the resilient bight 982 and the second arm 983 disposed in a flat plane parallel to the left wall 201 towards controlling deflection of the flat planar portion 900 of the spring member 980 to be in a desired consistent manner and, preferably, without the flat planar portion 900 when being deflected against its inherent bias from deforming out from between the parallel planes in which the flat planar portion 900 lies when undeflected. Together the spring rod 902 and the head member 903 form a headed spigot 901, which is also referred to as a guide member 901.

In the embodiment shown, the spring member 980 has but a single headed spigot 901 and spring guide slot 940. However, two or more headed spigots 901 and spring guide slots 940 may be provided at different locations on the second arm 983 and/or the bight 982 to further controlling deflection of the flat spring member 980 to be in a desired consistent manner as well as assisting in maintaining the first arm 981, the resilient bight 982 and the second arm 983 disposed in a flat plane parallel to the left wall 201.

The flat spring member 980 as arranged on the left side wall 201 is preferably deflected parallel to the planes in which the side surfaces 932 and 933 of the flat planar portion 900 lies and to apply forces attempting to return the flat spring member 980 parallel to these planes.

The thickness of the flat planar portion 900 between the inner side surface 932 and the outer side surface 933 is preferably selected to resist the flat planar portion 900 when being deflected against its inherent bias from deforming out from between the parallel planes in which the flat planar portion 900 lies when undeflected, and in the selection of the thickness of the flat planar portion 900 to resist the flat planar portion 900 when being deflected against its inherent bias from deforming out from between the parallel planes, consideration also needs to be had to the extent that the headed spigot 901 and the spring guide slot 940 assist in resisting undesired lateral twisting or deflection of the flat planar portion 900 of the spring member 980.

Reference is made to FIGS. 24 to 38 showing a third embodiment of a dispenser assembly 10 in accordance with the present invention.

The third embodiment, other than in providing a modified spring mechanism 951, is identical to the second embodiment of FIGS. 21 to 23 and similar reference numerals are used to refer to similar elements. In the third embodiment, a spring mechanism 951 is provided which is a modified form of the spring member 980 shown in the second embodiment of FIGS. 21 to 23.

Figure 24:
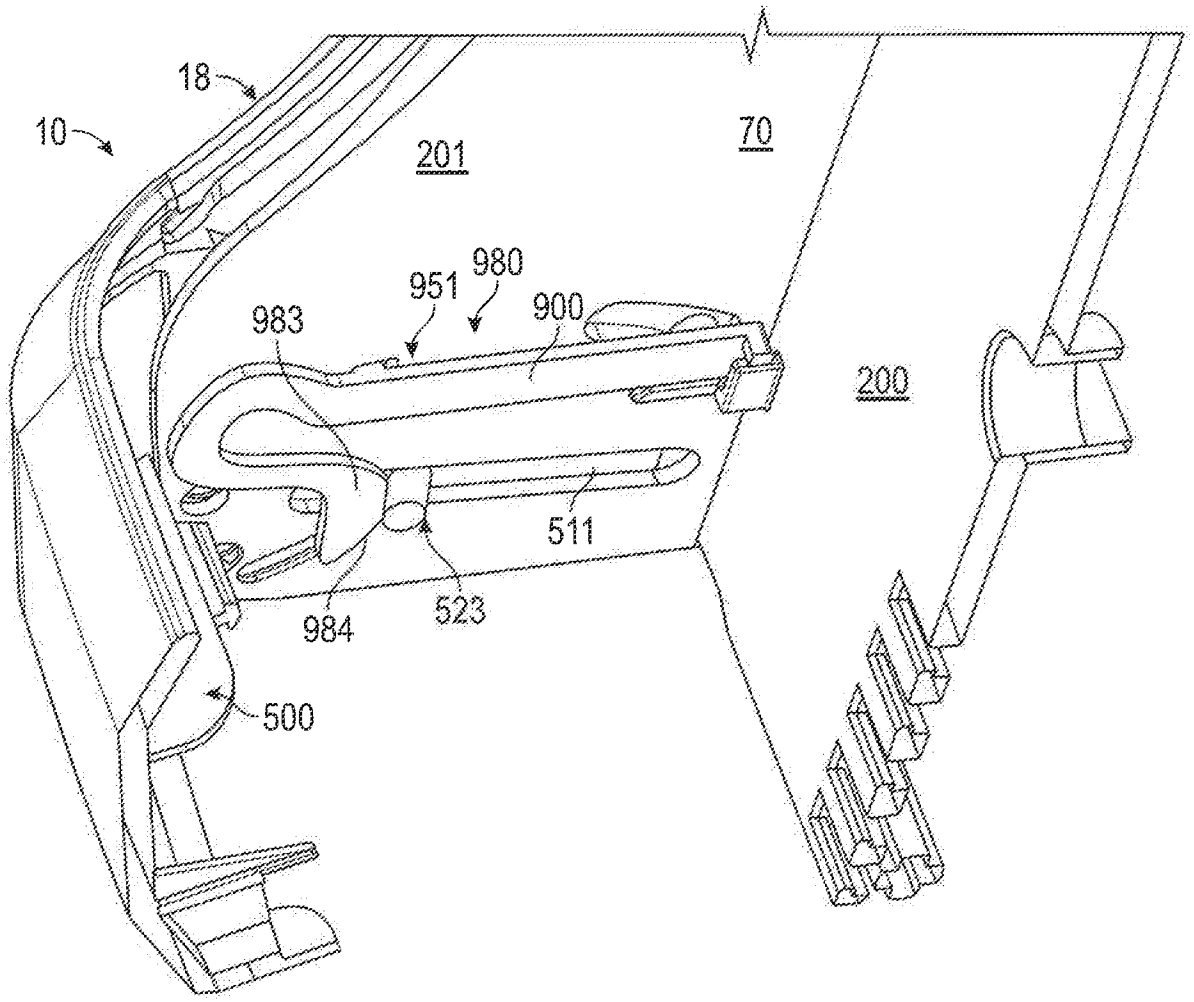
FIG. 24 is a pictorial view of a fluid dispenser assembly in accordance with a third embodiment of the present invention in a closed position showing a lower left portion of the dispenser cross-sectioned along a vertical center plane through the housing and the lifting member and showing a third form of a spring mechanism.

FIG. 24 shows the dispenser assembly 10 in a fully closed position as also seen, for example, in FIGS. 1 and 14. FIG. 24 shows the housing 70, the cover 18, the lifter member 500 and the spring mechanism 951 comprising the spring member 980.

Figure 25:
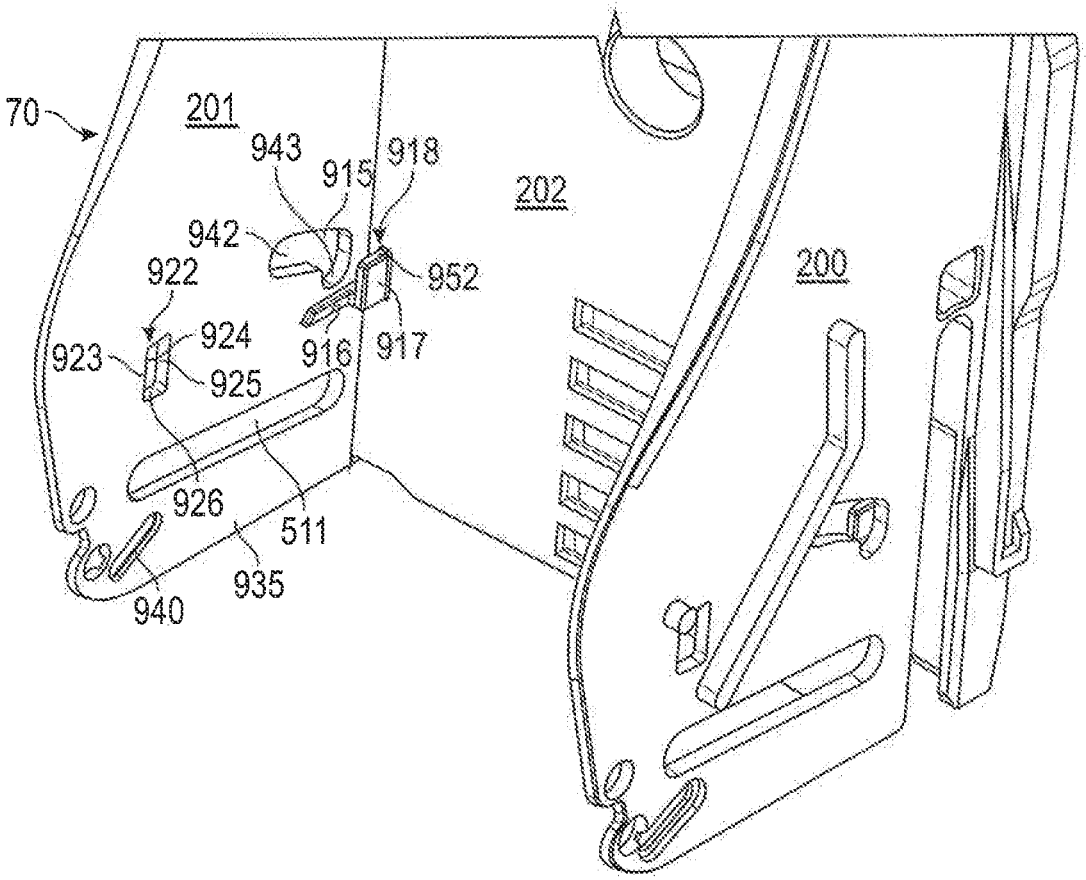
FIG. 25 is a front pictorial view of a lower portion of the housing of the dispenser assembly shown in FIG. 24.

FIG. 25 shows a pictorial view of a lower portion of the housing 70 shown in FIG. 24. The housing 70 has the housing back wall 202 from which the housing right side wall 200 and the housing left side wall 201 extend forwardly. The housing right side wall 200 and the housing left side wall 201 are mirror images of each other. As in the previous embodiments, the housing left side wall 201 has a left lifter axle receiving slotway 511. As in the second embodiment of FIGS. 21 to 23, the housing left side wall 201 includes a spring guide slot 940 that extends downwardly as it extends forwardly.

As can be seen on FIG. 24, as in the second embodiment of FIGS. 21 to 23, the lifter member 500 is coupled to the housing left side wall 201 in a manner that a left stub axle 523 lies within the left lifter axle receiving slotway 511. The spring member 980 is coupled to the housing left side wall 201 in a manner that the end surface 984 of the second arm 983 engages the left stub axle 523 and urges the left stub axle 523 rearwardly thus biasing the lifter member 500 relative to the housing 70 towards the closed position which also biases the cover 18 to the closed position in a manner as described previously.

Figure 26:
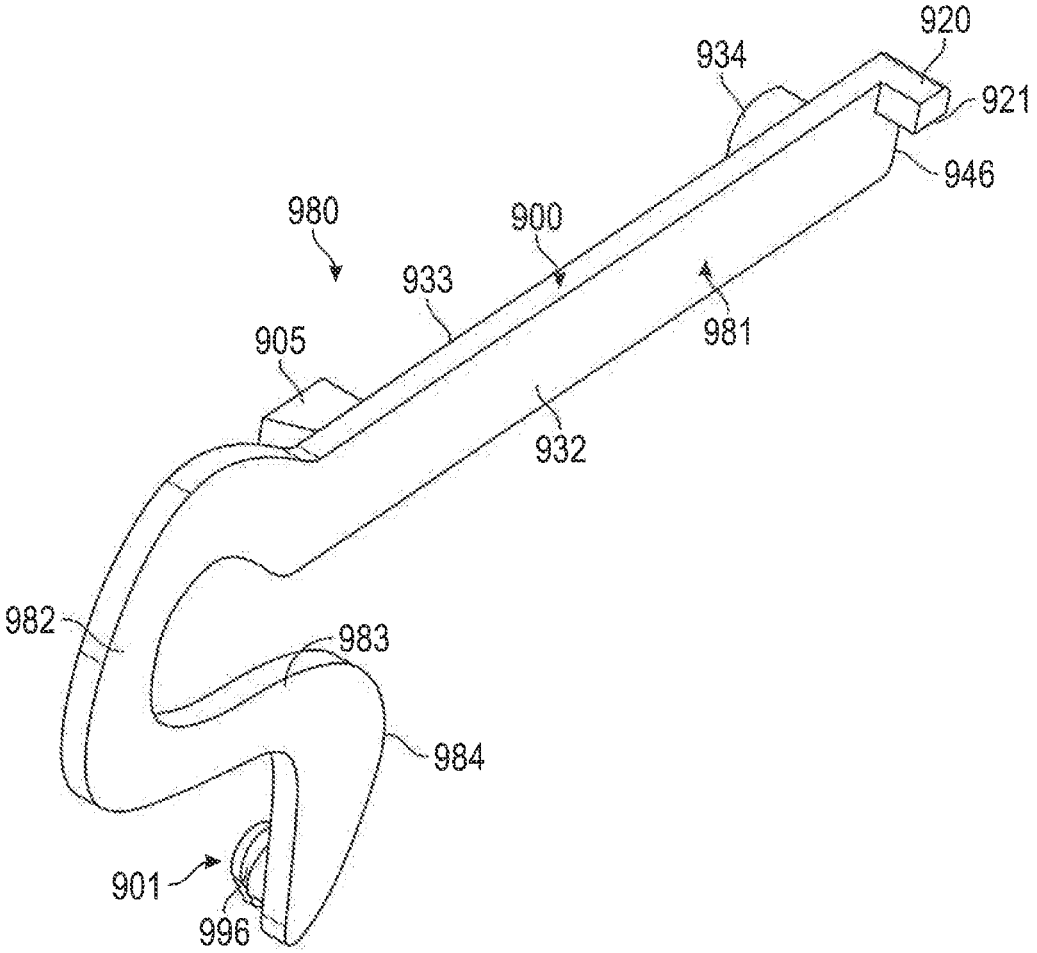
FIG. 26 is a pictorial right side view of the spring member shown in FIG. 24.
Figure 27:
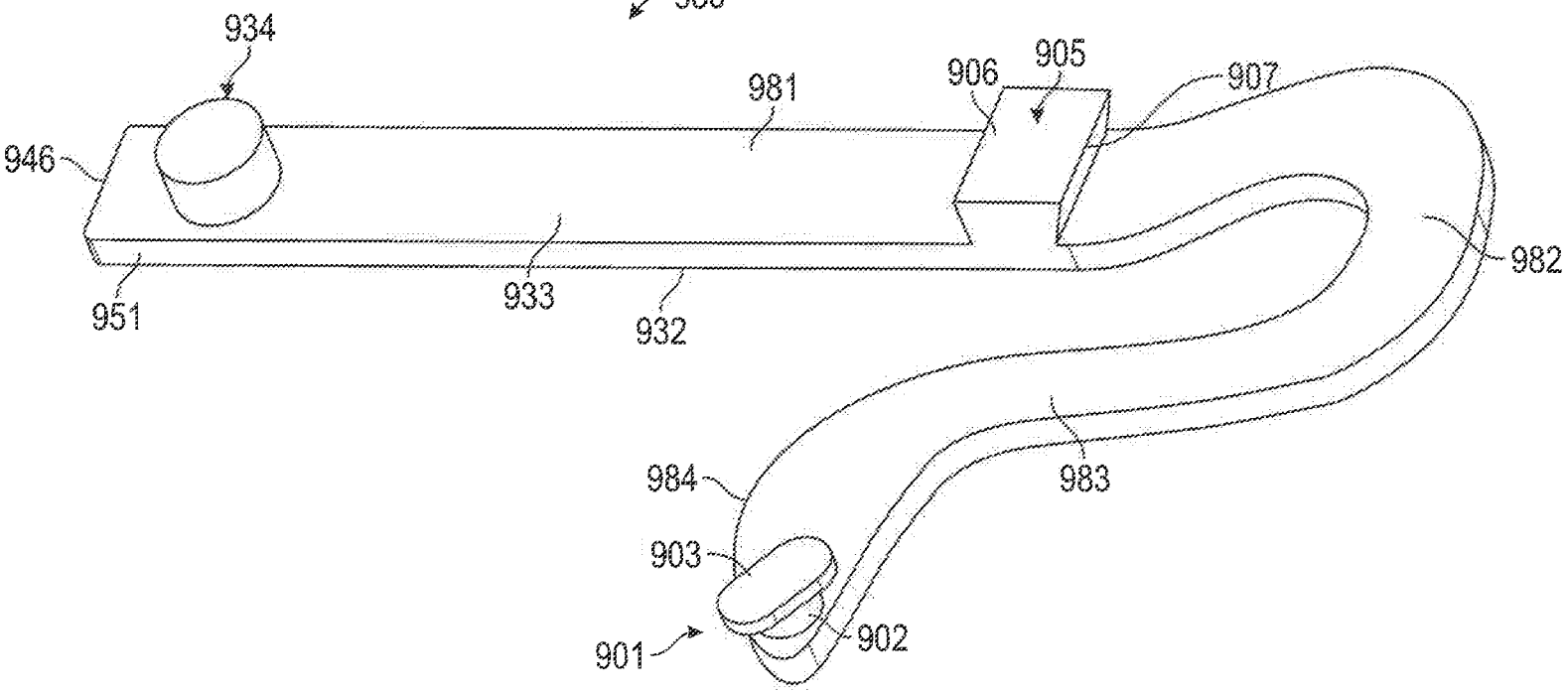
FIG. 27 is a pictorial left side view of the spring member shown in FIG. 26.

FIGS. 26 and 27 show the spring member 980 in pictorial views. The spring member 980 includes the flat planar portion 900 that has the laterally inner right side surface 932 and the laterally outer left side surface 933 lying in parallel planes and placed in a uniform thickness. The flat planar portion 900 is effectively disposed in a flat planar centre plane between the side surfaces 932 and 933 and has a hook-like shape with the first arm 981 connected by the resilient bight 982 to the second arm 983. The second arm 983 carries the end surface 984 adapted for engagement with the stub axle 523, and shown to be rounded as seen in side view.

The second arm 983 carries on the outer side surface 933 a headed spigot 901 which is formed by a cylindrical rod 902 extending from the outer side surface 933 to where it merges with a racetrack shaped head member 903. The head member 903 extends radially beyond the radial extent of the radius of the rod 902. The cylindrical rod 902 extends about an axis normal the outer side surface 933.

Proximate a rear end 946 of the first arm 981, a cylindrical rear boss 934 is provided on the outer side surface 933 extending outwardly towards the left about an axis normal to the outer side surface 933.

On the outer side surface 933, on the first arm 981 of the spring member 980 proximate a forward end of the first arm 981 and spaced forwardly from the boss 934, a dovetail boss 905 or anchor member 905 is provided which extends laterally to the left away from the outer side surface 933 to a boss end surface 906 in a plane parallel to the outer side surface 933. The dovetail boss 905 has a bevelled forward surface 907 which extends forwardly as it extends laterally away from the outer side surface 933.

Figure 30:
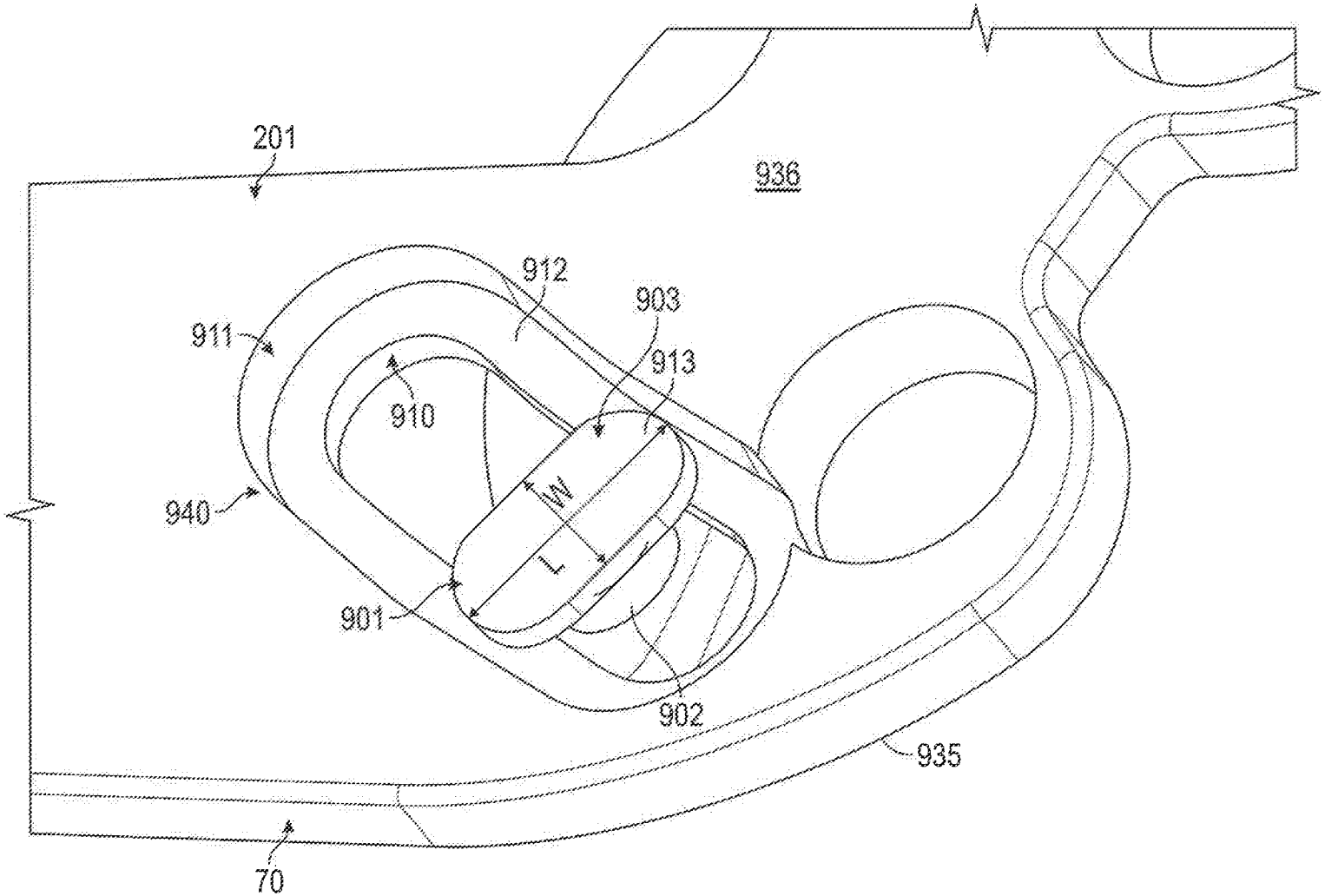
FIG. 30 is an enlarged perspective view of a portion of FIG. 29 showing a lower front end of the spring member engaged in a spring guide slot in the housing.

Referring to FIG. 25, the left side wall 201 of the housing 70 has the spring guide slot 940 that extends downwardly as it extends forwardly. The spring guide slot 940 is adapted to receive the headed spigot 901 in a manner as best shown in FIG. 30. As seen in FIG. 30, the spring guide slot 940 is formed by a combination of a rod slot 910 and a head slot 911. The rod slot 910 extends from the interior side surface 935 of the side wall 201 towards the left into the head slot 911. The head slot 911 extends inwardly from the exterior side surface 936 of the left side wall 201 towards the right to the rod slot 910 effectively providing a shoulder 912 directed laterally outwardly parallel to the exterior side surface 936 of the left side wall 201. The head slot 911 is provided to have a width that permits the head member 903 of the headed spigot 901 to be slidably received and slid therein as seen in FIG. 30. The rod slot 910 is provided to have a width which permits the rod 902 of the headed spigot 901 to slide therein. The head member 903 of the headed spigot 901 is of a racetrack shape with a length indicated as L and a width indicated as W. The headed spigot 901 can be engaged within the spring guide slot 940 and removed therefrom by rotating the spring member 980 about 90 degrees from the position shown on FIG. 30 such that the length L of the head member 903 aligns with a longitudinal of the rod slot 910. With the width W of the head member 903 being less than the width of the rod slot 910, the head member 903 can pass through the rod slot 910 for insertion and removal. The width of the head slot 911 is less than the length L of the head member 903. A laterally inwardly directed inner surface 996 of the head member 903 of the headed spigot 901 shown on FIG. 26 engages the shoulder 912 of the spring guide slot 940 to place the outer side surface 933 of the flat planar portion 900 over the distal end of the second arm 983 closely adjacent to the interior side surface 935 of the left side wall 201. The head slot 911 extends laterally inwardly from the exterior surface of the left side wall 201 a depth greater than a thickness of the head member 903 such that an outer surface 913 of the head member 903 does not extend laterally outwardly to the left beyond the exterior side surface 936 of the left side wall 201 when the spring member 980 is coupled to the housing 70.

As seen on FIG. 25, the housing left side wall 201 carries a rear slot 915 to receive the boss 934 on the rear of the spring member 980. The rear slot 915 includes a forward portion 942 and a rear portion 943. The forward portion 942 extends downwardly as it extends rearwardly and merges into the rear portion 933 which extends downwardly from the rear of the front portion 942. A lower surface 941 of the rear slot 915 over the front portion 942 is generally directed upwardly whereas the lower surface 931 over the rear portion 943 is directed rearwardly. Below the rear slot 915, a horizontal rib 916 extends laterally inwardly from the left side wall 201 and merges with a vertical rib 917 that extends forwardly from the housing back wall 202 spaced inwardly from the left side wall 201 so as to define a vertically open end socket 918 above the horizontal rib 916 and between the vertical rib 917 and the interior side surface 935 of the left side wall 201.

As best seen in FIG. 26, at a rear end 946, the spring member 980 carries a rear flange 920 that extends laterally away from the inner side surface 932 of the flat planar portion 900 and presents a downwardly directed lower stop surface 921.

As seen on FIG. 25, the left side wall 201 includes above the slot 511 and forward of the rear slot 915, a socket opening 922 or anchoring opening 922 which is of a generally rectangular shape and is sized to permit the dovetail boss 905 to slide laterally therethrough. The socket opening 922 is defined by a forward surface 923 or catch surface 923, a top surface 924, a rear surface 925 and a bottom surface 926. Each of the top surface 924, back surface 925 and bottom surface 926 are disposed substantially perpendicular to the side surfaces 935 and 936 of the left side wall 201. The front surface 923 as best seen in FIG. 31, extends forwardly as it extends laterally outwardly from the interior side surface 935 to the exterior side surface 936 of the left side wall 201.

Figure 28:
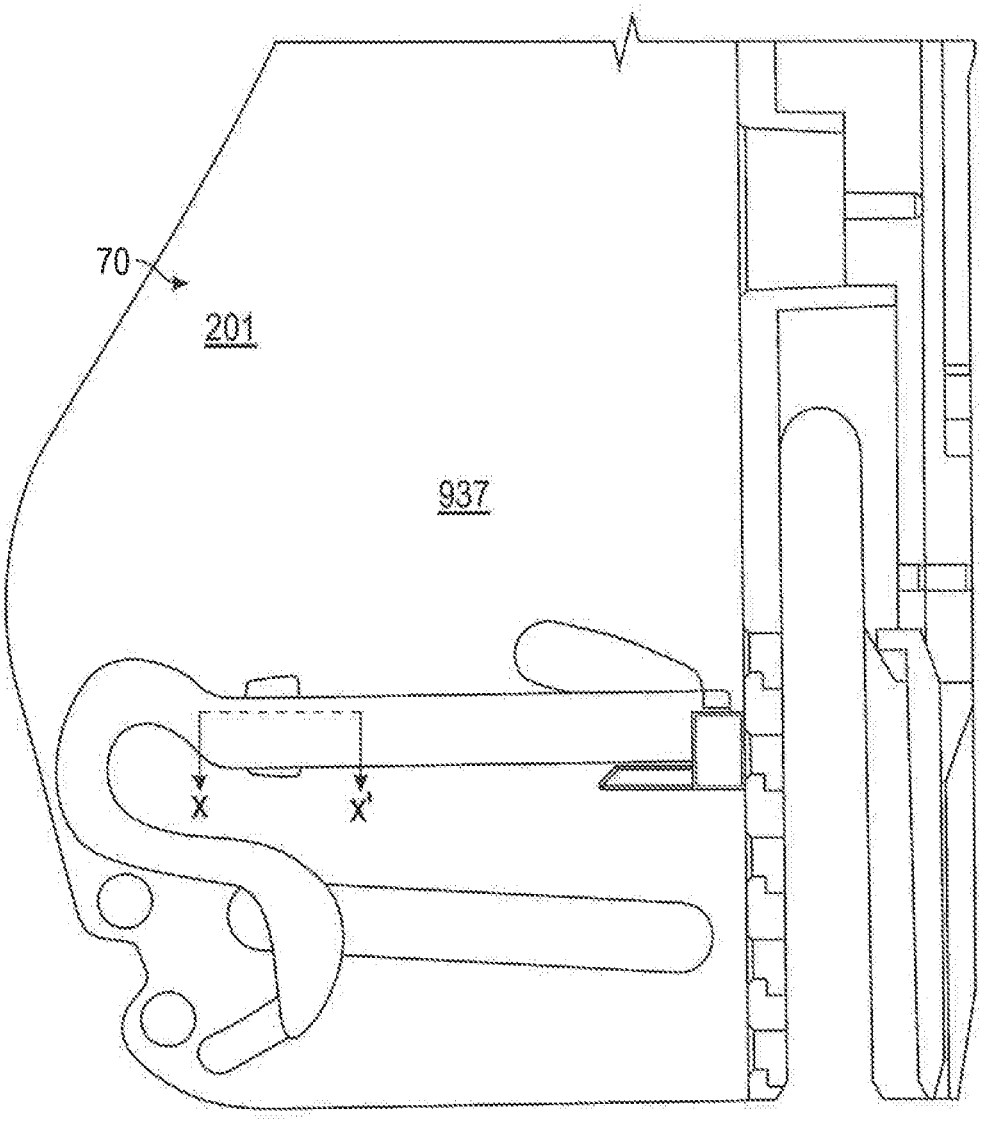
FIG. 28 is a left side view of FIG. 24 merely showing the housing and the spring member coupled to the housing.
Figure 31:
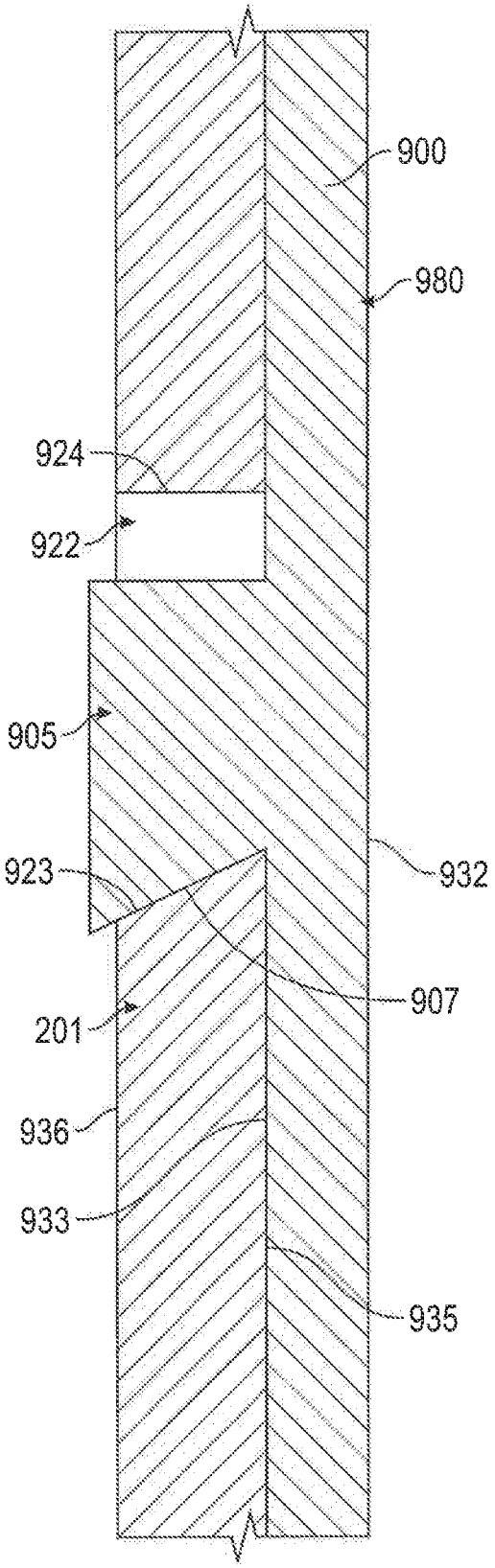
FIG. 31 is a cross-sectional top view through a portion of the housing and the spring member of FIG. 28 along section line X-X' on FIG. 28.

FIG. 31 is a cross-sectional view along section line X-X' on FIG. 28 and shows a configuration in which the dovetail boss 905 on the spring member 980 is biased forwardly into the left side wall 201 such that the bevelled forward surface 907 of the dovetail boss 905 is urged forwardly into the forward surface 923 of the socket opening 922. As seen in FIG. 31, the engagement of the bevelled forward surface 907 on the dovetail boss 905 with the forward surface 923 of the socket opening 912 will apply forces urging the spring member 980 laterally outwardly, that is, urging the outer side surface 933 of the spring member 980 into the interior side surface 935 of the left side wall 201.

Figure 29:
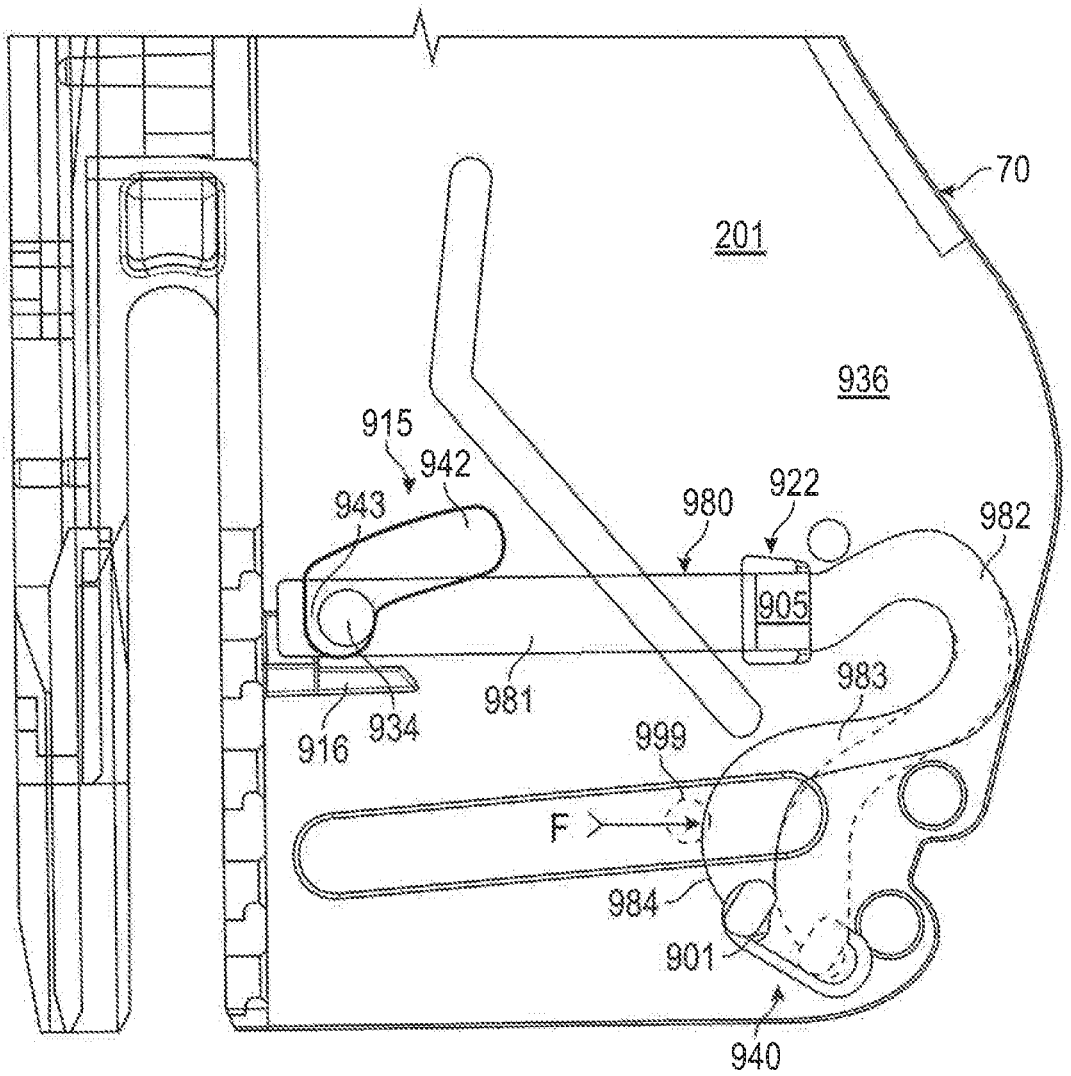
FIG. 29 is a right side view of the housing and spring member shown in FIG. 28 with the housing being drawn as being transparent.

The various features on the housing 70 and the various features of the spring member 980 permit the spring member 980 to be removably coupled to the housing 70 in the following manner. Firstly, the spring member 980 is located with the flat planar portion 900 disposed vertically laterally inside the left side wall 201 with the head member 903 of the headed spigot 901 disposed at an angle that the head member 903 may be moved laterally outwardly and pass through the rod slot 910 of the spring guide slot 940 and into the head slot 911, at which point the spring member 980 is pivoted about the rod 902 with the rod 902 within the spring guide slot 940 until the dovetail boss 905 comes to be located laterally aligned inwardly of the socket opening 922 and the rear boss 904 comes to be located laterally aligned laterally inwardly of the rear slot 915. The spring member 980 is then moved laterally outwardly such that the dovetail boss 905 is moved laterally into the socket opening 922 and the rear boss 934 is moved laterally into the rear slot 915 placing the outer side surface 933 of the spring member 980 in engagement with the interior side surface 935 of the left side wall 201. With subsequent downward movement of the rear end 946 of the first arm 981 of the spring member 980, the rear end 946 slides downwardly into the end socket 918 with a lower stop surface 951 of the first arm 981 to engage the horizontal rib 916 and the lower stop surface 921 on the rear flange 920 of the spring member 980 engaging a top stop surface 952 of the vertical rib 917. The rear boss 934 first becomes engaged within the front of the forward portion 942 of the rear slot 915 and following such engagement the rear slot 915 engages the boss 904 and guides the boss 904 and thereby the rear end 946 of the spring member 980 downward and rearwardly in the forward portion 942 and into the rear portion 943 of the rear slot 915 such that boss 904 comes to be received in the rear portion 943 with the spring member 980 coupled to the left wall 201 of the housing 70 as shown in FIGS. 28 and 29. In FIG. 29, the housing 70 and its left side wall 201 are drawn as being transparent such that the spring member 980 may be seen therethrough.

In FIGS. 28 and 29, the spring member 980 is shown in solid lines coupled to the side wall 201 in an unbiased condition of the spring member 980 as schematically illustrated in FIG. 29. By the application of a forwardly directed force F indicated by the arrow F on FIG. 29 to the rounded end surface 984 of the second arm 983, the spring member 980 will deflect from the unbiased inherent position shown in solid lines to deflected positions including the deflected position shown in dashed lines on FIG. 29. As seen in FIG. 29, in the spring member 980 deflecting from the unbiased position shown in solid lines to the deflected position shown in dashed lines, the headed spigot 901 slides within and is guided in its movement by the spring guide slot 940. The spring member 980 has an inherent bias to return from the deflected condition shown in dashed lines on FIG. 29 to the unbiased condition shown in solid lines on FIG. 29.

As seen on FIG. 29, when the forwardly directed force F is applied to the spring member 980, the spring member 980 as coupled to the housing 70 is generally urged forwardly relative to the housing 70 and, as can be seen on FIG. 31, the dovetail boss 905 is urged forwardly within the socket opening 922 urging the bevelled forward surface 907 of the dovetail boss 905 forwardly into the bevelled front surface 923 of the socket opening 922.

The manner in which the spring member 980 is coupled to the side wall 201 of the housing 70 assists in maintaining the flat planar portion 900 of the spring member 980 disposed in a flat plane and with its outer side surface 933 in close sliding engagement with the interior side surface 935 of the left side wall 201. In this regard, the engagement of the dovetail boss 905 with the socket opening 922 draws the flat planar portion 900 laterally outwardly into the side wall 201, the engagement of the rear end 946 of the first arm 981 of the spring member 980 within the end socket 918 places the outer side surface 933 in engagement with the interior side surface 935 of the left side wall 201, and the length of the rod 902 of the headed spigot 901 is selected to place the inner surface 996 of the head member 903 of the headed spigot 901 in engagement with the shoulder 912 of the spring guide slot 940 with the outer side surface 933 in engagement with the interior side surface 935 of the left side wall 201.

Figure 32:
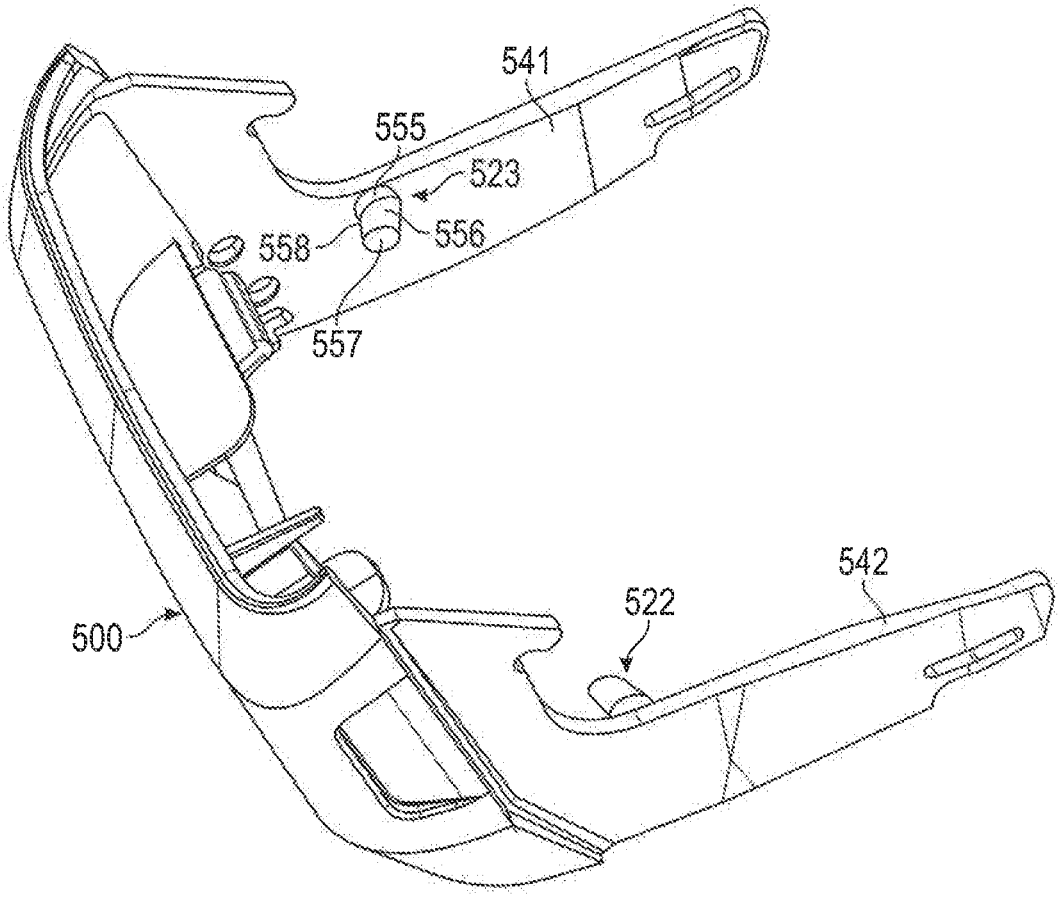
FIG. 32 is a pictorial top view of the lifting member of the dispenser assembly shown in FIG. 24.

In accordance with the present invention, the lifter member 500 used with the third embodiment of the invention can be identical to the lifter member 500 shown in FIGS. 9 to 11. However, in the third embodiment, a preferred lifter member 500 is shown and preferably used. As seen in FIG. 32, the lifter member 500 includes the central portion 540 from which the left arm 541 and the right arm 542 extend rearwardly. The left arm 541 carries the left stub axle 523 extending laterally inwardly therefrom and the right arm 542 carries the right stub axle 522. As is the case with the previous embodiments, in the third embodiment, the lifter member 500 is to be engaged with the housing 70 and the cover 18 with the left stub axle 523 to be slidably received within the left lifter axle receiving slot 511 in the housing side wall 201 and the right stub axle 522 is to be slidably received within the right lifter axle receiving slotway 510.

It is to be noted that on the lifter member 500 of the previous embodiments, each of the left stub axle 523 and the right stub axle 522 are cylindrical members which extend laterally inwardly disposed about a common horizontal axis. The lifter member 500 as shown, for example, in FIGS. 9 to 11 can be used as the lifter member 500 with the housing 70 and cover 18 of the third embodiment with the cylindrical left and right stub axles 523 and 522 to be disposed within the axle receiving slotways 511 and 510 with operation to be substantially the same as that described with the previous embodiments in respect of interaction of the housing 70, lifter member 500 and the cover 18 and in respect of the spring member 980 as described with reference to the second embodiment of FIGS. 21 to 23.

Figure 33:
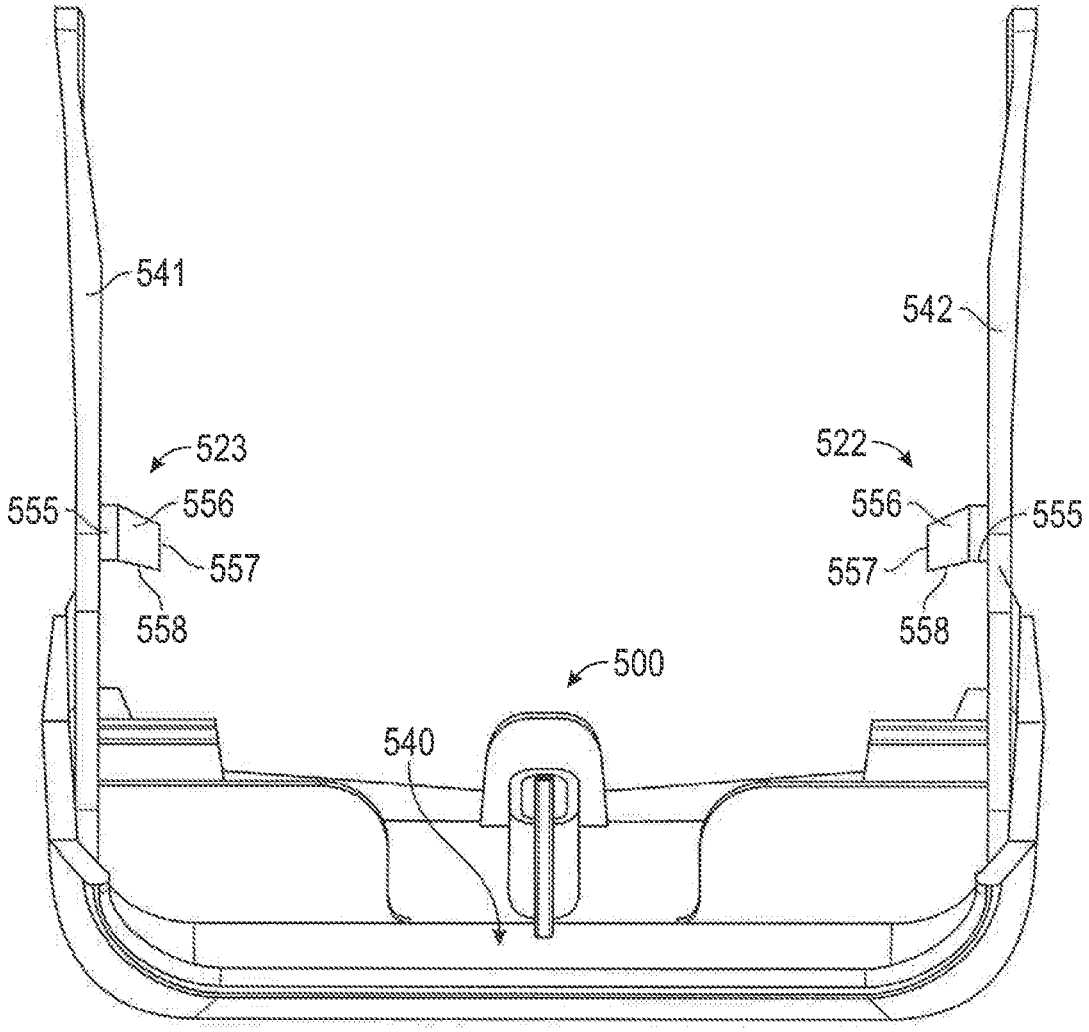
FIG. 33 is a top view of the lifter member shown in FIG. 32.

However, in accordance with the third embodiment, as best illustrated in FIGS. 32 and 33, each of the left stub axle 523 and the right stub axle 522 are formed with a proximate portion 555 and a distal portion 556. The proximate portion 555 is cylindrical and disposed about a horizontal axis. The proximate portion 555 is adjacent the interior surface of the respective left arm 541 or right arm 542. The proximate portion 555 merges at its lateral inner end into the distal portion 556. The distal portion 556 ends at a distal end 557 shown as parallel to the inside surfaces of the left and right arms 541 and 542. The distal portion 556, as best seen in FIG. 33, has a forwardly directed camming surface 558 which extends forwardly as it extends laterally inwardly. The distal portion 556 may be considered to approximately represent a frustoconical member disposed about an axis located in a horizontal plane that extends forwardly as it extends laterally inwardly. However, the configuration of the distal portion 556 is notably only important so as to preferably have an orientation that its camming surface 558 extends forwardly as it extends laterally inwardly in any position that the lifter member 500 assumes in operation while the distal portion 556 is in engagement with the end surface 984 of the second arm 983 of the spring member 980.

Figure 34:
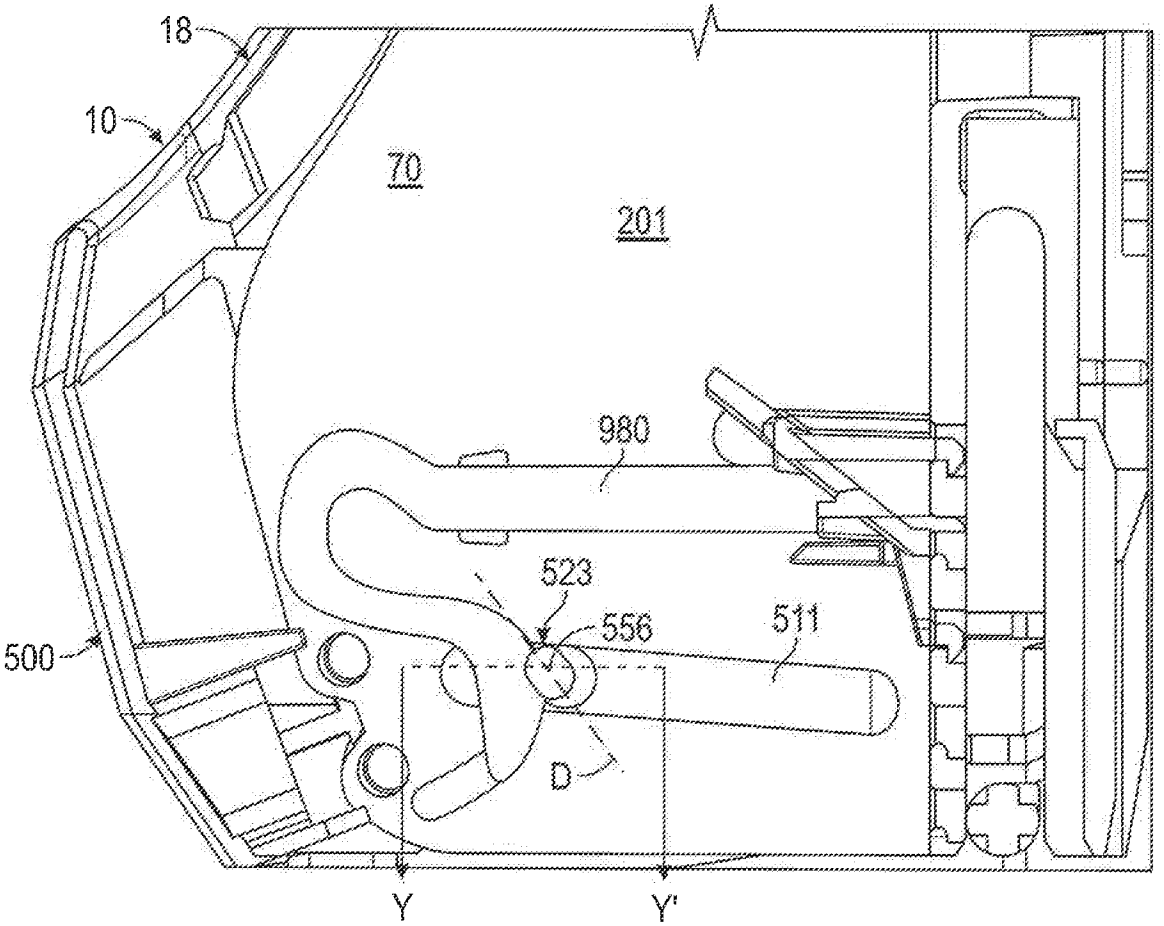
FIG. 34 is a right side view of the dispenser assembly of FIG. 24 in the closed position as shown in FIG. 24.
Figure 38:
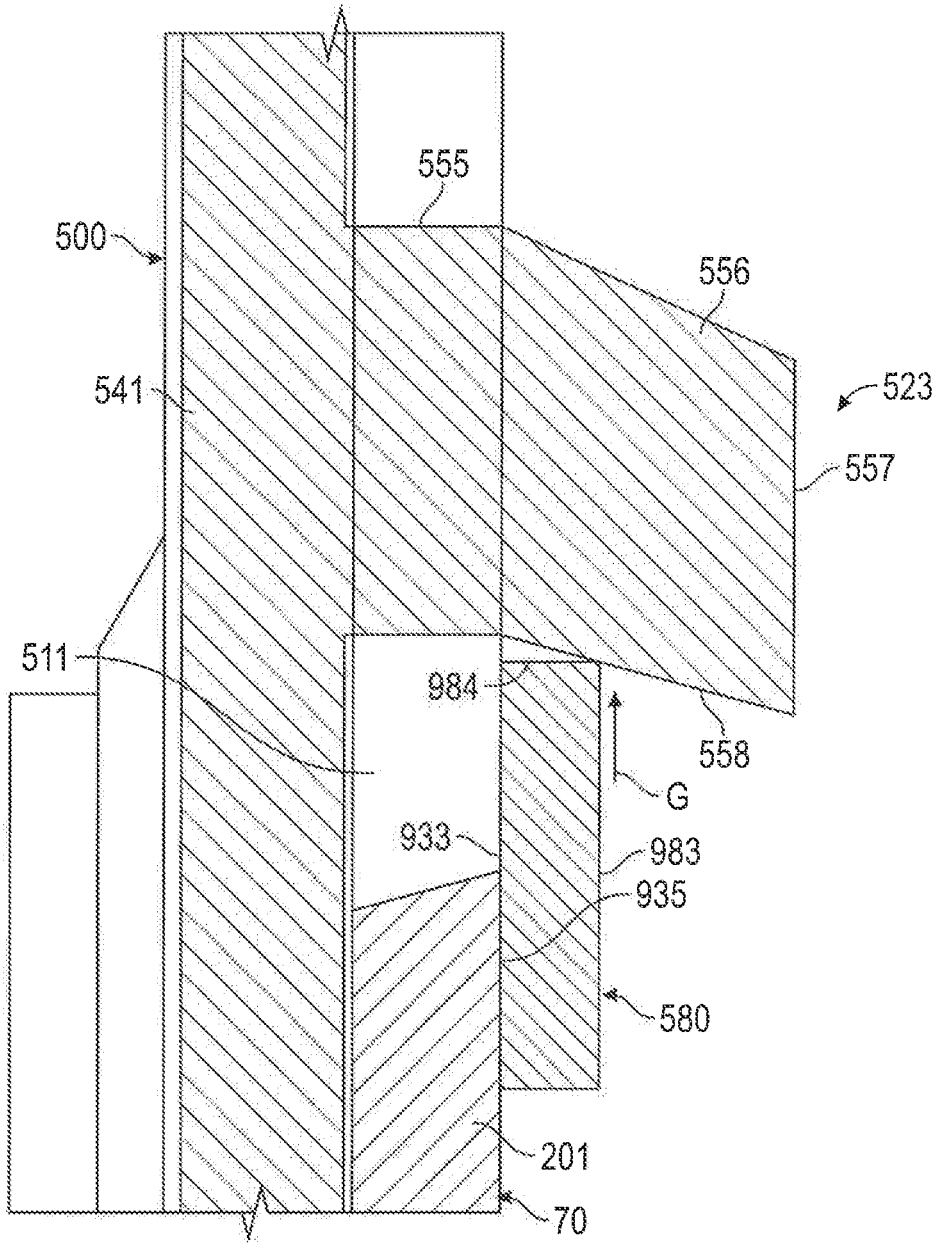
FIG. 38 is a top cross-sectional view of the lifter member in FIG. 32 along section line Y-Y' on FIG. 34.

Reference is made to FIG. 38 which shows a top cross-sectional view along section line Y-Y' in FIG. 34 illustrating engagement between the left stub axle 523 and the spring member 980 in which the spring member 980 is in a deflected position and in inherently attempting to return to an unbiased position is applying forces in a direction of the arrow G shown on FIG. 38 onto the left stub axle 523. As seen on FIG. 38, the lifter left arm 541 is disposed parallel to and adjacent the left side wall 201 of the housing 70 with the left stub axle 523 extending through the slotway 511 and with the end surface 984 of the second arm 983 of the spring member 980 biased rearwardly into the distal portion 556 of the left stub axle 523.

As seen in FIG. 38, the cylindrical proximate portion 555 of the left stub axle 523 is disposed within the slotway 511 such that engagement between the slotway 511 and the proximate portion 555 guides the left stub axle 523 in movement relative to the housing left side wall 201. The distal portion 556 of the left stub axle 523 is disposed laterally inwardly from the left side wall 201 and presents its forwardly directed camming surface 558 for engagement with the end surface 984 of the second arm 983 of the spring member 980.

By reason that the forwardly directed camming surface 558 is bevelled and extends forwardly as it extends laterally inwardly, engagement between the forwardly directed cam surface 558 and the rearwardly directed end surface 984 of the second arm 983 urges the second arm 983 laterally outwardly towards the left urging the outer side surface 933 of the planar portion 900 into engagement with the interior side surface 935 of the left side wall 201 of the housing 70.

Reference is made to FIG. 34 which shows a side view of FIG. 24, that is, with the dispenser assembly 10 in a closed position with the spring member 980 coupled to the left side wall 201 of the housing 70 and engaged with the left stub axle 523 of the lifter member 500 biasing the left stub axle 523 rearwardly whereby urging the lifter member 500 and the cover 18 into the closed position as is schematically shown, for example, in FIG. 14.

As seen on FIG. 34, the distal end 556 of the left stub axle 523 appears as a racetrack shape and, on FIG. 34, a dashed line D represents a longitudinal through the distal end 556.

Figure 35:
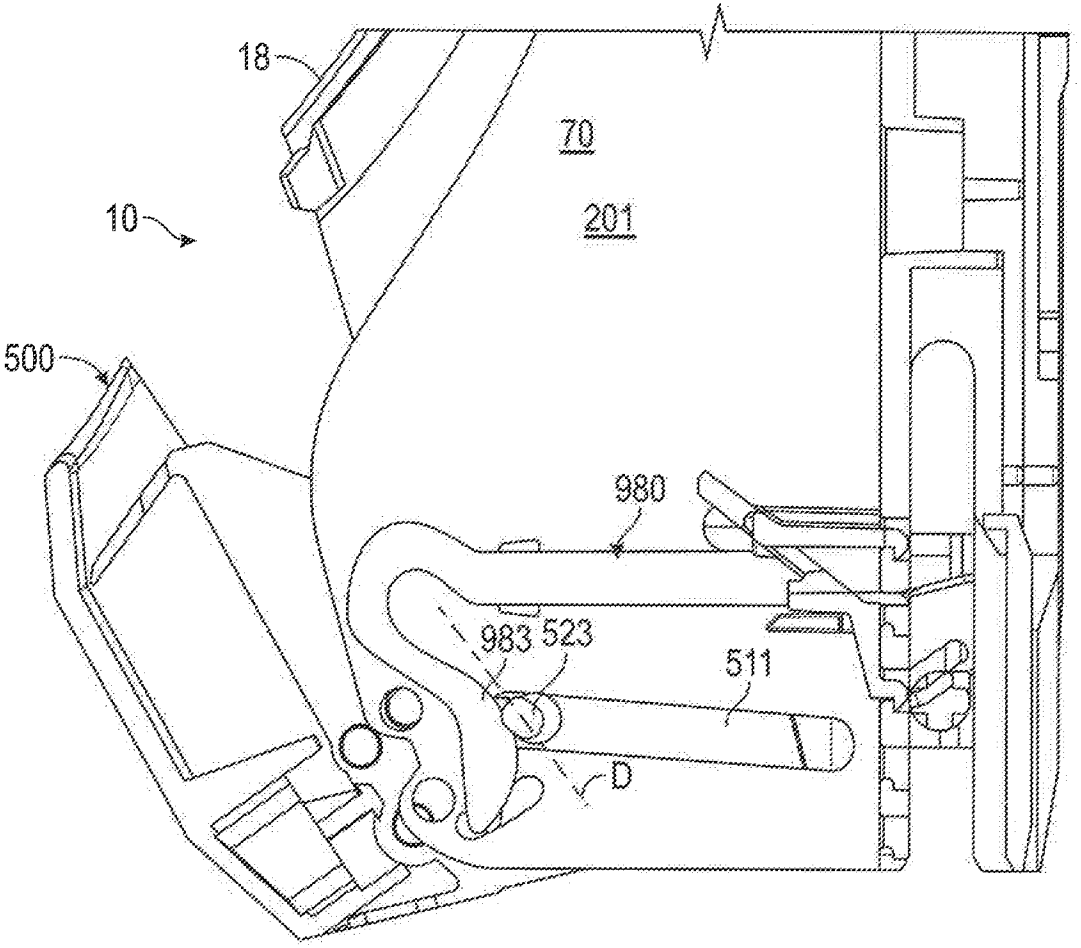
FIG. 35 is a view the same as FIG. 34 but with the lifting member and cover in a first partially open position relative the housing.

FIG. 35 illustrates a view the same as FIG. 34 but in which the lifter member 500 has been moved from the closed position of FIG. 34 to a first partially open position representing a position between the positions shown in FIGS. 15 and 16. In moving from the closed position of FIG. 34 to the first partially open position of FIG. 35, the left stub axle 523 has moved forwardly within the slotway 511 against the bias of the spring member 980 deflecting the second arm 983 of the spring member forwardly and downwardly. As can be seen on FIG. 35, the lifter member 500 has become rotated about a horizontal axis relative to the housing 70 as shown by the relative position of the longitudinal D of the stub axle 523 in FIG. 35 being rotated counter-clockwise from the position shown in FIG. 34.

Figure 36:
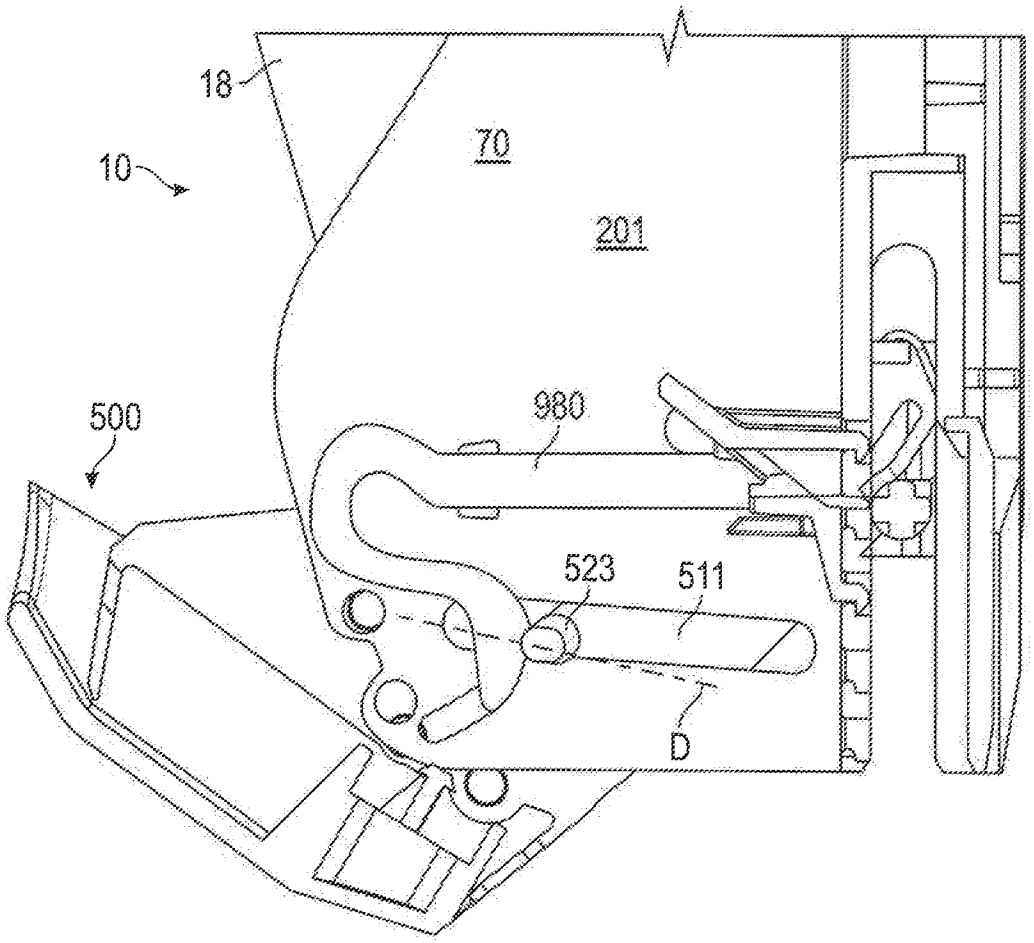
FIG. 36 is a view the same as FIG. 34 but with the lifter member and cover in a second partially open position.

FIG. 36 is a view the same as FIG. 35, however, with the lifting member 500 having been moved to a second partially open position which may be considered as representing positions between FIGS. 16 and 17. In moving from the first partially open position of FIG. 35 to the second partially open position of FIG. 36, the stub axle 523 has moved rearwardly within the slotway 511 and FIG. 36 represents the position in which the spring member 980 is in its inherent unbiased position the same as that, for example, shown in FIGS. 28 and 29. As seen on FIG. 36, the lifter member 500 has further been rotated counter-clockwise by reason of the longitudinal D being disposed rotated further clockwise compared to longitudinal D in FIG. 35.

Figure 37:
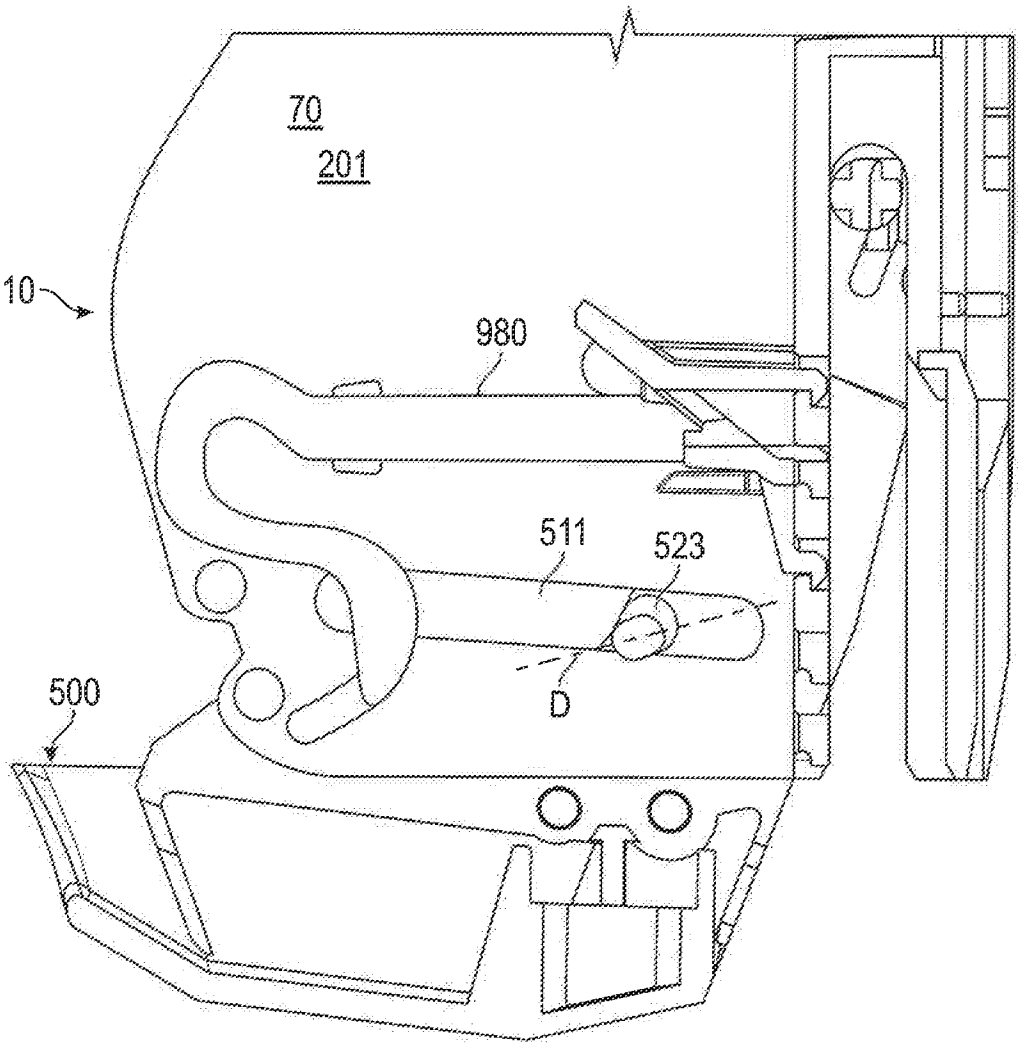
FIG. 37 is a view the same as FIG. 34 but with the lifter member and cover in a third open position.

FIG. 37 is a view the same as FIG. 36, however, shows the lifter member 500 as having been moved from the position of FIG. 36 to a third open position similar to a position that is between positions of FIGS. 17 and 18. As can be seen, the stub axle 523 has slid rearwardly in the slotway 511 away from the second arm 983 of the spring member 980 and the spring member 980 is in an unbiased inherent condition. As seen on FIG. 37, the lifter member 500 has further been rotated counter-clockwise as indicated by comparing the longitudinal D on FIG. 37 to the longitudinal D on FIG. 36.

In accordance with the present invention, it is preferable but not necessary that in the closed position as illustrated, for example, in FIG. 34, that the spring member 980 is in a deflected position and applies rearwardly directed forces to the stub axle 523 to bias the lifter member 500 and the cover 18 to the closed position relative to the housing 70. Alternatively in the closed position, the spring member 980 may be in its unbiased inherent position forward of the stub axle 523 with the stub axle 523 to merely engage the spring member 980 to deflect the spring member 980 as the lifter member 500 is moved from a closed position towards a partially open position.

On FIG. 29, the spring member 980 is in an inherent unbiased condition.

Therefore, it is to be appreciated that on FIG. 29, for the spring member 980 to assume its position and configuration in a closed position as shown on FIG. 34, the spring member 980 would need to be deflected from the unbiased position shown in solid lines in FIG. 29 to a deflected position in which the end surface 984 of the second arm 983 is to the right of and in engagement with a dashed circle 999 schematically representing the position of the forwardly directed cam surface 558 of the distal portion 556 of the left stub axle 523 in the closed position of FIG. 34.

In the second and third embodiments the end surface 984 of the second arm 983 of the spring member 980 is shown as rounded in a curve as seen in side view. The end surface 984 serves as a cam surface for engagement with the surface of the left stub axle 523. The curved shape is preferably selected such that the engagement between the end surface 984 and the left stub axle 523 will result in forces tending to urge the left stub axle 523 rearwardly parallel to the slotway 511 within which the left stub axle 523 slides. The end surface 984 of the second arm 983 need not be curved and may have other shapes as seen in side view as suitable, including a strait shape as seen in side view.

The third embodiment illustrates the spring member 980 as preferably formed as an integral member from plastic as by injection molding. The spring member 980 has been provided such that it may be easily assembled into a coupled arrangement with the left side wall 201 of the housing 70 without the use of tools and easily removable for replacement. However, it is not necessary that the spring member 980 is removable. Rather, as in the second embodiment of FIGS. 21 to 23, the spring member 980 may be secured to the side wall 201 of the housing 70 as by rivets or mechanical fasteners or other means such as by adhesive, welding and the like.

Figure 39:
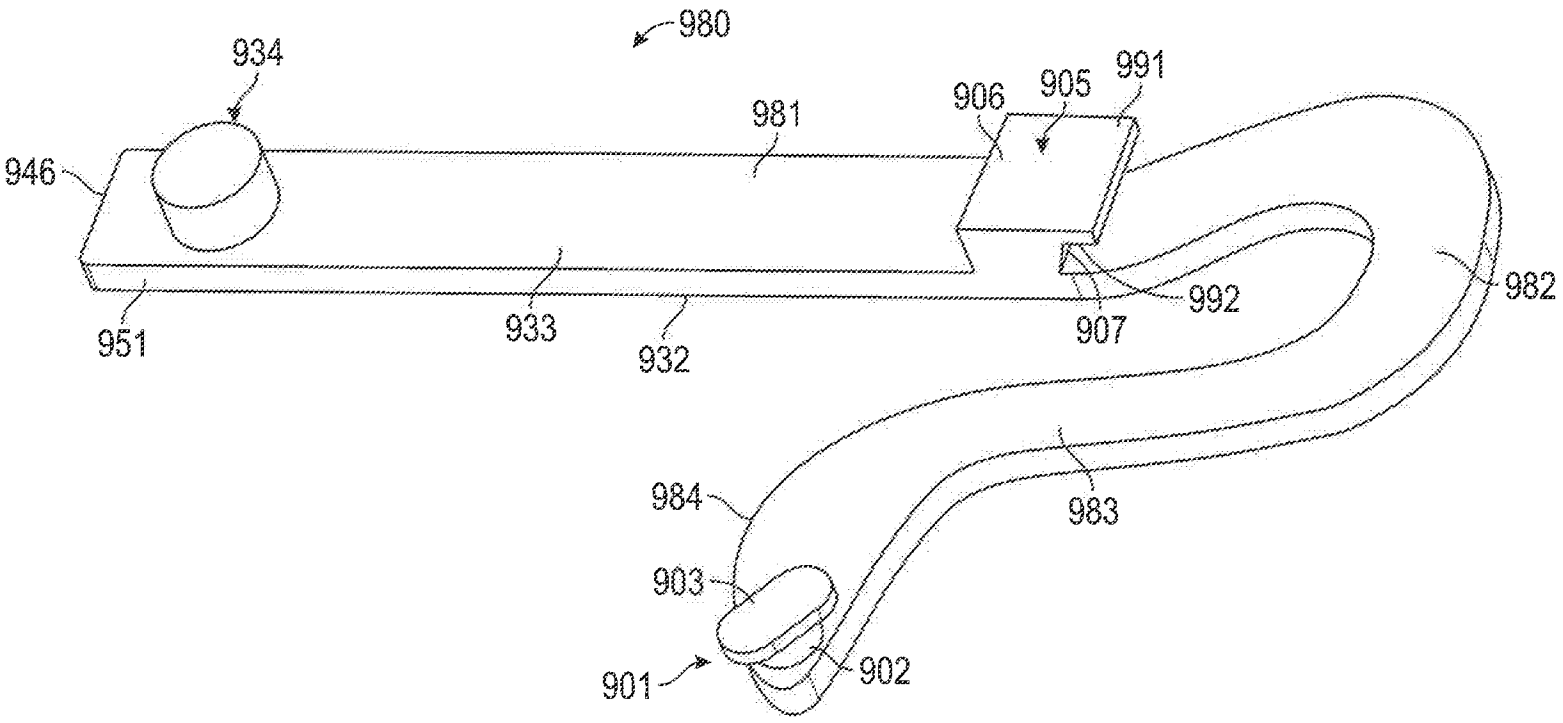
FIG. 39 is a pictorial left side view the same as FIG. 27 but showing an alternate embodiment of a spring member to that shown in FIG. 27.
Figure 40:
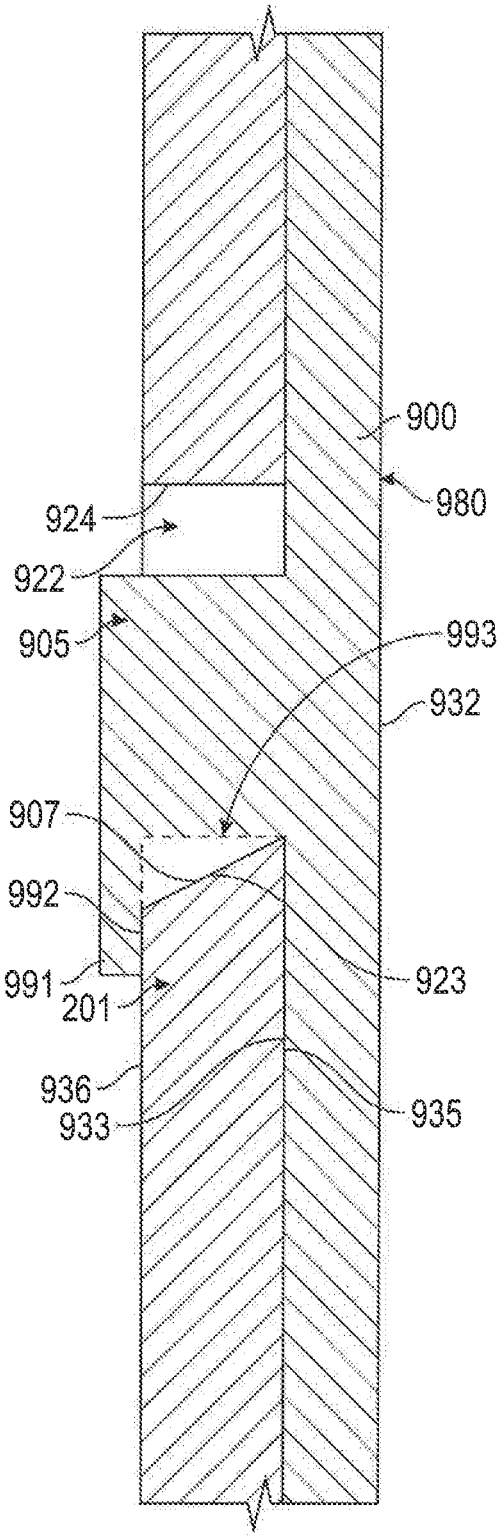
FIG. 40 is a cross-sectional top view the same as FIG. 31 but showing the spring member of FIG. 39.

Reference is made to FIGS. 39 and 40 which show views similar to FIGS. 27 and 31 but showing a spring member 980 which is identical to the spring member 980 of FIGS. 27 and 31 but for the inclusion on the dovetail boss 905 of a head member 991 that extends forwardly from the bevelled surface 907 and presents a laterally inwardly directed shoulder surface 992. As seen on FIG. 40, head member 991 extends forwardly beyond the socket opening 922 placing the laterally inwardly directed inner surface 992 laterally outwardly and in opposition to the exterior side surface 936 of the left side wall 201. Engagement between the inner surface 992 of the head member 991 of the dovetail boss 905 with the exterior side surface 936 of the left side wall 201 assists in maintaining the flat planar portion 900 of the spring member 980 adjacent to the left side wall 201 of the housing 70. In the arrangement of FIG. 40, each of the bevelled surface 907 of the dovetail boss 905 and the forward surface 923 of the socket opening 922 are shown as beveled at an angle to the outer side surface 923 of the spring member 980, however, this is not necessary and either or both may be provided at otherwise such as for example to lie normal to the outer side surface 993 of the spring member 980 as shown on FIG. 40 in the dotted line 993. While the preferred embodiments of the spring member 980 show a single dovetail boss 905 with or without a head member 991 engaged in a socket opening 922, more than one such dovetail boss 905 and socket opening 922 may be provided, with or without the dovetail bosses 905 including a head member 991.

Preferably, in accordance with the preferred embodiments, one or more features may be provided towards assisting the flat planar portion 900 of the spring member 980 being maintained adjacent to the left side wall 201 of the housing 70 in all positions that the spring member 980 may adopt including inherent unbiased positions and deflected positions. These features, preferably, prevent the flat planar portion 900 from deflecting laterally inwardly away from the side wall 201. However, the extent to which such features are to prevent deflection of the flat planar portion 900 out of its inherent flat central plane will vary dependent upon the nature of the spring member 980. One preferred feature to keep the flat planar portion 900 adjacent the side walls 200 and 201 of the housing 70 and against deflecting inwardly is the provision of the forwardly directed camming surface 558 on the stub axles 522 and 523 of the lifter member 500 to be bevelled towards urging the second arm 983 of the spring member 980 laterally outwardly into the respective side walls 200 and 201 of the housing 70. Other features to keep the flat planar portion adjacent the side walls 200 and 201 of the housing 70 and against deflecting inwardly include: the interaction of the bevelled forward surface 907 of the dovetail boss 905 on the spring member 980 with the forward surface 923 of the socket opening 922, the engagement of the headed spigot 901 in the guide slot 540, the interaction of the headed dovetail boss 905 in FIG. 40 with the socket opening 922 with engagement of the head member 993 of the dovetail boss 905 with exterior side surface 936 of the left side wall 201, and the engagement of the rear end 950 of the spring member 980 and the end slot 918 on the housing 70. One or more of these features may be provided. As well, it will be apparent to a person skilled in the art that other features by which the housing 70 will engage the spring member 980 to resist lateral inward deflection of the spring member 980 from the side wall 201 may be provided.

In the discussion of the third embodiment of the invention with FIGS. 24 to 38, typically merely the left side of the dispenser assembly 10 has been discussed, however as with the previous embodiments the right side of the dispenser assembly 10 is preferably a mirror image of the left side.

The spring member 980 is preferably made from a plastic material which provides desired resiliency to the spring member 980 that the spring member 980 will deflect from its inherent unbiased positions to deflected positions in a desired manner and a suitable number of times to meet the desired usages of the spring member 980 as, for example, may be represented for a spring member 980 used in the embodiments as shown in the second and third embodiments for a number of activations representing the number of openings of the dispenser assembly 10 in an expected life of the dispenser assembly 10, or if the spring member 980 is for some other use for an expected number of deflections of the spring member 980 over the life of the product within which the spring member 980 is to be used. For a typical dispenser 10 of a hand cleaning fluid as shown in the various embodiments, it is preferred that the spring member 980 is capable of being deflected between open and closed positions up to 500 times, more preferably up to 1,000 times under typical ambient conditions in which a hand cleaning fluid dispenser may be expected to operate.

As but an example, plastics from which the spring member 980 may be manufactured include plastics which have suitable mechanical properties imparting resiliency and may repeatedly be deflected from an inherent unbiased position to deflected positions and to return to the inherent unbiased position. As one example, molding compounds including polyoxymethylene thermal plastics can be formulated with suitable mechanical properties including suitable flexural modulus, tensile modulus, tensile stress and strain, tensile creep and impact strains which are suitable for use in forming the spring member 980 in accordance with the present invention. Suitable such polymer molding compounds are available under the trademarks CELANESE and HOSTAFORM as polyoxymethylene copolymers.

While four preferred forms of spring mechanisms 951 are shown, other spring mechanisms 951 may be used. The spring mechanisms 951 can be configured to bias the stub axles 522 and 523 rearwardly over the entire length of travel of the stub axles 522 and 523 in the slots 510 and 511 as in FIG. 19 or over merely a portion of the travel of the stub axles 522 and 523 such as in FIGS. 21 and 24 in which spring mechanisms 951 bias the stub axles 522 and 523 rearwardly over the merely a forward most portion length of travel of the stub axles 522 and 523 in the slots 510 and 511.

The four spring mechanisms 951 illustrated are configured to closely lie adjacent the interior surface of the side walls 200 and 201 and minimize the extent that they extend inwardly from the side walls 200 and 201 as is advantageous to provide between the side walls 200 and 201 an advantageously large side to side lateral width to the interior 46 within the housing 70 as can advantageously receive a bottle 101 with a correspondingly large lateral width. The flat spring member 980 is particularly advantageous in extending laterally inwardly from the side wall 210 but the thickness of the flat planar member 980. The flat spring member 980, particularly as constrained in its deflection by the cooperation of the spring stub axle 941 and the spring guide slot 940, extends inwardly from the side wall 210 a minimal extent and avoids providing surfaces or portions which may come to extend farther laterally inwardly as might disadvantageously become engaged by a bottle 101 on insertion or removal from the interior 46 of the housing 70. With the flat spring member 980 being formed from plastic material, it renders the dispenser 10 more easily recyclable and avoids the disadvantage of the metal torsion spring in FIGS. 19 and 20 in being metal awkward to remove from plastic for recycling and subject to possible rusting or corrosion.

As described above, two substantially identical mirror image spring mechanisms 951 are preferably provided to bias the right and left axles 252 and 523 towards the rear in the respective slotways 510 and 511. For example, a first spring member 980 could be positioned adjacent to the left side wall 201 of the housing 70, and a second spring member 980 could be positioned adjacent to the right side wall 200 of the housing 70, with the second spring member 980 being a mirror image of the first spring member 980. Preferably, the spring members 980 have a flat planar body 900 as in the second, third, and fourth embodiments of the invention, so as to minimize the extent that they extend inwardly from the side walls 200 and 201. This may be particularly advantageous in embodiments where, in at least some configurations of the fluid dispenser 10, the fluid reservoir 101 is positioned in the interior compartment 46 between the two spring members 980, so that the lateral extent that the first spring member 980 extends laterally inwardly from the left side wall 201 of the housing 70 and the lateral extent that the second spring member 980 extends laterally inwardly from the right side wall 200 of the housing 70 define a width of the interior compartment 46 available to accommodate the fluid reservoir 101 between the first and second spring members 980. Minimizing the extent that the spring members 980 extend inwardly from the side walls 200 and 201 helps to maximize the width in the interior compartment 46 that is available for receiving the reservoir 101, which may for example allow for a larger reservoir 101 to be accommodated by the housing 70.

The flat spring member 980 has been illustrated as advantageous configurations of a spring for use with a dispenser 10 as described in this application, however, the flat spring member 980 by itself provides a novel arrangement as is useful in other applications, particularly those where a spring mechanism 951 is desired to be accommodated to occupy a minimal space.

In the preferred configurations of the flat spring member 980 shown the first arm 981 and the second arm 983 are joined by the bight 982 forming a U-shape configuration. Other configurations are possible as with the first arm 981 and second arm 983 joined by an intermediate portion to provide an S-shape configuration. An advantage of the flat spring member 980 is that one anchoring portion 981 such as the first arm 981 may be fixed to a support and an engagement portion 983, such as a second distal end to carry an engagement surface 984, like the second arm 983, can be coupled to the anchoring portion 981 with an intermediate deflecting portion 982 equivalent in function to the flexing bight 982. However, the shape of the flat spring member 980 and each of the anchoring portion 981, deflecting portion 982 and engagement portion 983 as seen normal to the flat planar sheet of plastic material is not limited.

While the invention has been described with reference to preferred embodiments, many modifications and variations will now occur to persons skilled in the art.

As would be understood by a person skilled in the art, the terminology used herein to describe the invention could be replaced with any other suitable terminology having an equivalent meaning. For example, the lower closed position of the cover 18 as shown, for example, in FIG. 1 could be described as a first location of the cover 18, and the upper open position of the cover 18 as shown, for example, in FIG. 12 could be described as a second location of the cover 18. Similarly, the latched and closed position of the cover actuator member 500 as shown, for example, in FIG. 14 could be described as a first orientation of the cover actuator member 500, and the fully open position of the cover actuator member 500 as shown, for example, in FIG. 18 could be described as a second orientation of the cover actuator member 500.

The movement of the axle member 523 or engagement member 523 within the slotway 511 as the cover actuator member 500 moves from the latched and closed position to the fully open position as shown, for example, in FIGS. 14 to 18 could also be described using alternative terminology. For example, the position of the engagement member 523 within the slotway 511 when the cover actuator member 500 is at the latched and closed position, as shown in FIG. 14, could be described as a first position of the engagement member 523, and the position of the engagement member 523 within the slotway 511 when the cover actuator member 500 is at the fully open position, as shown in FIG. 18, could be described as a second position of the engagement member 523. The movement of the engagement member 523 between the first position and the second position as shown in FIGS. 14 to 18 could be described as the travel path of the engagement member 523, with for example the position of the engagement member 523 as shown in FIG. 15 being described as an intermediate position in the travel path between the first position and the second position. The portion of the travel path in which the engagement member 523 is at the first position or forward of the first position within the slotway 511 could be described as a first portion of the travel path. The forward direction and the rearward direction could also be described as a first direction and a second direction, respectively, and the forward end 513 and the rear end 515 of the slotway 511 could be described as a first end 513 and a second end 515, respectively. The forward direction and/or the rearward direction could also be referred to as longitudinal directions.

Additional alternative terminology that could be used to describe the invention include the following:

A) The laterally interior side surface 935 of the side wall 201 of the housing 70 could be referred to as a first surface 935 or a first side 935 of the side wall 201, and the laterally exterior side surface 936 of the side wall 201 of the housing 70 could be referred to as a second surface 936 or a second side 936 of the side wall 201. Alternatively, in embodiments in which a head slot 911 is provided, the laterally interior side surface 935 of the side wall 201 could be referred to as a first surface 935 of the side wall 201, the shoulder 912 that is formed by the head slot 911 could be referred to as a second surface 912 of the side wall 201, and the laterally exterior side surface 936 of the side wall 201 could be referred to as a third surface 936 of the side wall 201.

B) The spring rod 902 of the headed spigot 901 or guide member 901 could be described as a base 902, and the head member 903 of the headed spigot 901 or guide member 901 could be described as a head 903.

C) The rear end 946 of the anchoring portion 981 of the spring member 980 that is carried by the end socket 918 could also be described as a carried portion 946 of the anchoring portion 981.

It will be understood that, although various features of the invention have been described with respect to one or another of the embodiments of the invention, the various features and embodiments of the invention may be combined or used in conjunction with any of the other features and embodiments of the invention as described and illustrated herein.

We claim:

1. A fluid dispenser comprising:

a housing for carrying a fluid reservoir and a pump mechanism;

a cover coupled to the housing, the cover movable relative to the housing between a first location and a second location; and a cover actuator member coupled to the housing, the cover actuator member movable relative to the housing between a first orientation and a second orientation;

wherein, upon movement of the cover actuator member from the first orientation to the second orientation, the cover actuator member engages with the cover to effect movement of the cover from the first location to the second location;

wherein:

the fluid dispenser further comprises a biasing mechanism that biases the cover actuator member relative to the housing;

wherein the cover actuator member comprises an engagement member that travels in a travel path between a first position and a second position as the cover actuator member moves between the first orientation and the second orientation, the engagement member being at the first position when the cover actuator member is in the first orientation, and the engagement member being at the second position when the cover actuator member is in the second orientation;

wherein the biasing mechanism engages with the engagement member at least when the engagement member is positioned in a first portion of the travel path; and wherein the biasing mechanism biases the engagement member towards the first position when the engagement member is positioned in the first portion of the travel path.

2. The fluid dispenser according to claim 1, wherein the biasing mechanism engages with the engagement member when the cover actuator member is in the first orientation;

wherein, when the cover actuator member is in the first orientation, the biasing mechanism biases the cover actuator member towards the first orientation;

wherein, when the cover actuator member is in the first orientation, the cover actuator member engages with the cover to locate the cover at the first location; and wherein, when the cover actuator member is in the first orientation, the biasing mechanism biases the cover towards the first location, through engagement of the biasing mechanism with the cover actuator member, and engagement of the cover actuator member with the cover.

3. The fluid dispenser according to claim 1, wherein, during movement of the engagement member from the first position to the second position in the travel path, the engagement member travels at least in a first direction from the first position to an intermediate position, and then travels at least in a second direction from the intermediate position to the second position, the first direction being opposite to the second direction;

wherein the biasing mechanism biases the engagement member in the second direction when the engagement member is positioned in the first portion of the travel path; and wherein the first portion of the travel path comprises a portion of the travel path in which the engagement member is at the first position or is spaced in the first direction from the first position.

4. The fluid dispenser according to claim 1, wherein the housing has a slotway that extends between a first end of the slotway and a second end of the slotway;

wherein the cover actuator member comprises a sliding member that is slidably received by the slotway; and wherein the biasing mechanism biases the sliding member towards the second end of the slotway when the engagement member is positioned in the first portion of the travel path.

5. The fluid dispenser according to claim 4, wherein the sliding member comprises an axle member that is rotatable within the slotway;

wherein movement of the cover actuator member from the first orientation to the second orientation comprises sliding and rotating the axle member within the slotway; and wherein the engagement member comprises the axle member.

6. The fluid dispenser according to claim 5, wherein, during movement of the axle member from the first position to the second position in the travel path, the axle member travels from the first position towards the first end of the slotway, and then changes direction and travels towards the second end of the slotway to the second position;

wherein the first position is located between the first end of the slotway and the second end of the slotway;

wherein the first position is closer to the first end of the slotway than the second position is to the first end of the slotway; and wherein the biasing mechanism resists movement of the axle member from the first position towards the first end of the slotway, and, at least when the axle member is positioned in the first portion of the travel path, encourages movement of the axle member towards the second end of the slotway.

7. The fluid dispenser according to claim 1, wherein the biasing mechanism comprises a spring member, the spring member comprising:

an anchoring portion that is fixed to the housing;

an engagement portion with that is arranged for engagement with the engagement member; and a deflecting portion that is connected to the anchoring portion and the engagement portion, the deflecting portion being resiliently deformable between an unbiased condition, in which the engagement portion is arranged at an unbiased position relative to the anchoring portion, and a deflected condition, in which the engagement portion is arranged at a deflected position relative to the anchoring portion;

wherein the deflecting portion has an inherent bias to return to the unbiased condition.

8. The fluid dispenser according to claim 7, wherein the spring member has a flat planar body with a first lateral side and a second lateral side lying in parallel planes;

wherein the anchoring portion comprises a first portion of the flat planar body;

wherein the engagement portion comprises a second portion of the flat planar body; and wherein the deflecting portion comprises a third portion of the flat planar body.

9. The fluid dispenser according to claim 8, wherein the first lateral side and the second lateral side of the flat planar body remain lying in the parallel planes as the deflecting portion deflects from the unbiased condition to the deflected condition.

10. The fluid dispenser according to claim 9, wherein the spring member is formed from a resilient plastic material;

wherein the engagement surface extends from the first lateral side to the second lateral side of the flat planar body;

wherein the spring member has a hook-like shape with a first arm connected by a resilient bight to a second arm;

wherein the first arm comprises the anchoring portion;

wherein the second arm comprises the engagement portion; and wherein the resilient bight comprises the deflecting portion.

11. The fluid dispenser according to claim 8, wherein the housing has a first side wall, a second side wall, and an interior compartment that is defined between the first side wall and the second side wall;

wherein, when the fluid dispenser is in an operative condition, the fluid reservoir is received in the interior compartment of the housing between the first side wall and the second side wall; and wherein the flat planar body of the spring member is positioned in the interior compartment of the housing, with the first lateral side of the flat planar body positioned adjacent to the first side wall of the housing.

12. The fluid dispenser according to claim 11, wherein, when the fluid dispenser is in the operative condition, at least part of the flat planar body of the spring member is positioned between the fluid reservoir and the first side wall; and wherein the spring member deflects from the unbiased condition to the deflected condition without any portion of the spring member moving laterally towards the second side wall of the housing.

13. The fluid dispenser according to claim 11, wherein the anchoring portion is secured to the first side wall of the housing;

wherein, when the deflecting portion is in the unbiased condition, an engagement surface of the engagement portion is disposed in the travel path of the engagement member, the engagement surface engaging with the engagement member at least when the engagement member is positioned in the first portion of the travel path;

wherein the engagement of the engagement member with the engagement surface, during movement of the engagement member between the first position and the second position, deflects the deflecting portion against the inherent bias of the deflecting portion from the unbiased condition towards the deflected condition; and wherein, when the engagement member is positioned in the first portion of the travel path, the inherent bias of the deflecting portion biases the engagement member towards the first position.

14. The fluid dispenser according to claim 13, wherein the first side wall of the housing has a spring guide slot;

wherein a guide member extends laterally from the engagement portion of the spring member, the guide member slidably engaging with the spring guide slot;

wherein the engagement of the guide member with the spring guide slot guides the deflection of the spring member between the unbiased condition and the deflected condition;

wherein the spring guide slot extends laterally through the first side wall from a first surface of the first side wall to a second surface of the first side wall;

wherein the engagement portion is positioned adjacent to the first surface of the first side wall, with the guide member extending laterally from the engagement portion through the spring guide slot;

wherein the guide member has a head that is positioned adjacent to the second surface of the first side wall, the head being configured to engage with the second surface of the first side wall to prevent the engagement portion from moving laterally away from the first surface of the first side wall;

wherein the head has a length and a width, the length of the head being smaller than a length of the spring guide slot and larger than a width of the spring guide slot, and the width of the head being smaller than the length of the spring guide slot and smaller than the width of the spring guide slot;

wherein, when the spring member is in an operative position, the length of the head is out of alignment with the length of the spring guide slot, which prevents the head from passing through the spring guide slot;

wherein the spring member is rotatable relative to the housing from the operative position to an insertion or removal position in which the length of the head is aligned with the length of the spring guide slot, which allows the head to pass through the spring guide slot;

wherein the first side wall of the housing has a head slot for slidably receiving the head of the guide member, the head slot extending laterally from the second surface of the first side wall to a third surface of the first side wall;

wherein the head slot has a width that is larger than the length of the head; and wherein a thickness of the head is smaller than a lateral distance from the second surface of the first side wall to the third surface of the first side wall.

15. The fluid dispenser according to claim 13, wherein the first side wall of the housing has an anchoring opening that extends from a first side of the first side wall to a second side of the first side wall;

wherein an anchor member extends laterally from the anchoring portion of the spring member for engagement with the anchoring opening;

wherein the anchor member has a bevelled surface that extends in a longitudinal direction as the bevelled surface extends laterally away from the anchoring portion;

wherein the anchoring opening has a catch surface that extends in the longitudinal direction as the catch surface extends laterally away from the first side of the first side wall;

wherein the anchoring portion is positioned adjacent to the first side of the first side wall, with the anchor member extending laterally through the anchoring opening;

wherein the engagement of the engagement member of the cover actuator member with the engagement surface of the spring member, during movement of the engagement member between the first position and the second position, exerts a longitudinal force on the anchoring portion that biases the anchor member in the longitudinal direction relative to the anchoring opening;

wherein the bevelled surface of the anchor member engages with the catch surface of the anchoring opening at least when the longitudinal force biases the anchor member in the longitudinal direction relative to the anchoring opening;

wherein the engagement of the bevelled surface with the catch surface under the bias of the longitudinal force generates a lateral force that biases the anchoring portion laterally towards the first side of the first side wall;

wherein the anchor member has a head member that extends in the longitudinal direction from the bevelled surface, the head member being configured to engage with the second side of the first side wall to prevent the anchoring portion from moving laterally away from the first side of the first side wall;

wherein the housing comprises a socket that carries a carried portion of the anchoring portion of the spring member, the socket preventing the carried portion of the anchoring portion from moving laterally away from the first side wall;

wherein the engagement member has a camming surface for engaging with the engagement surface of the engagement portion; and wherein the camming surface is angled so that, at least when the engagement member is positioned in the first portion of the travel path, the engagement of the camming surface with the engagement surface urges the engagement portion towards the first side wall of the housing.

16. The fluid dispenser according to claim 6, wherein the biasing mechanism comprises a spring member, the spring member comprising:

an anchoring portion that is fixed to the housing;

an engagement portion that is arranged for engagement with the engagement member; and a deflecting portion that is connected to the anchoring portion and the engagement portion, the deflecting portion being resiliently deformable between an unbiased condition, in which the engagement portion is arranged at an unbiased position relative to the anchoring portion, and a deflected condition, in which the engagement portion is arranged at a deflected position relative to the anchoring portion;

wherein the deflecting portion has an inherent bias to return to the unbiased condition;

wherein the spring member has a flat planar body with a first lateral side and a second lateral side lying in parallel planes;

wherein the anchoring portion comprises a first portion of the flat planar body;

wherein the engagement portion comprises a second portion of the flat planar body;

wherein the deflecting portion comprises a third portion of the flat planar body;

wherein the housing has a first side wall, a second side wall, and an interior compartment that is defined between the first side wall and the second side wall;

wherein, when the fluid dispenser is in an operative condition, the fluid reservoir is received in the interior compartment of the housing between the first side wall and the second side wall; and wherein the flat planar body of the spring member is positioned in the interior compartment of the housing, with the first lateral side of the flat planar body positioned adjacent to the first side wall of the housing.

17. The fluid dispenser according to claim 16, wherein the spring member has a hook-like shape with a first arm connected by a resilient bight to a second arm;

wherein the first arm comprises the anchoring portion;

wherein the second arm comprises the engagement portion; and wherein the resilient bight comprises the deflecting portion.

18. The fluid dispenser according to claim 17, wherein the anchoring portion is secured to the first side wall of the housing;

wherein, when the deflecting portion is in the unbiased condition, an engagement surface of the engagement portion is disposed in the travel path of the engagement member, the engagement surface engaging with the engagement member at least when the engagement member is positioned in the first portion of the travel path;

wherein the engagement of the engagement member with the engagement surface, during movement of the engagement member between the first position and the second position, deflects the deflecting portion against the inherent bias of the deflecting portion from the unbiased condition towards the deflected condition; and wherein, when the engagement member is positioned in the first portion of the travel path, the inherent bias of the deflecting portion biases the engagement member towards the first position.

19. The fluid dispenser according to claim 2, wherein, during movement of the engagement member from the first position to the second position in the travel path, the engagement member travels at least in a first direction from the first position to an intermediate position, and then travels at least in a second direction from the intermediate position to the second position, the first direction being opposite to the second direction;

wherein the biasing mechanism biases the engagement member in the second direction when the engagement member is positioned in the first portion of the travel path;

wherein the first portion of the travel path comprises a portion of the travel path in which the engagement member is at the first position or is spaced in the first direction from the first position;

wherein the housing has a slotway that extends between a first end of the slotway and a second end of the slotway;

wherein the cover actuator member comprises a sliding member that is slidably received by the slotway;

wherein the biasing mechanism biases the sliding member towards the second end of the slotway when the engagement member is positioned in the first portion of the travel path;

wherein the sliding member comprises an axle member that is rotatable within the slotway;

wherein movement of the cover actuator member from the first orientation to the second orientation comprises sliding and rotating the axle member within the slotway; and wherein the engagement member comprises the axle member.

20. The fluid dispenser according to claim 19, wherein the biasing mechanism comprises a spring member, the spring member comprising:

an anchoring portion that is fixed to the housing;

an engagement portion that is arranged for engagement with the engagement member; and a deflecting portion that is connected to the anchoring portion and the engagement portion, the deflecting portion being resiliently deformable between an unbiased condition, in which the engagement portion is arranged at an unbiased position relative to the anchoring portion, and a deflected condition, in which the engagement portion is arranged at a deflected position relative to the anchoring portion;

wherein the deflecting portion has an inherent bias to return to the unbiased condition;

wherein the spring member has a flat planar body with a first lateral side and a second lateral side lying in parallel planes;

wherein the anchoring portion comprises a first portion of the flat planar body;

wherein the engagement portion comprises a second portion of the flat planar body;

wherein the deflecting portion comprises a third portion of the flat planar body;

wherein the housing has a first side wall, a second side wall, and an interior compartment that is defined between the first side wall and the second side wall;

wherein, when the fluid dispenser is in an operative condition, the fluid reservoir is received in the interior compartment of the housing between the first side wall and the second side wall;

wherein the flat planar body of the spring member is positioned in the interior compartment of the housing, with the first lateral side of the flat planar body positioned adjacent to the first side wall of the housing;

wherein the spring member is formed from a resilient plastic material;

wherein the anchoring portion is secured to the first side wall of the housing;

wherein the first lateral side and the second lateral side of the flat planar body remain lying in the parallel planes as the deflecting portion deflects from the unbiased condition to the deflected condition;

wherein, when the deflecting portion is in the unbiased condition, an engagement surface of the engagement portion is disposed in the travel path of the engagement member, the engagement surface engaging with the engagement member at least when the engagement member is positioned in the first portion of the travel path;

wherein the engagement of the engagement member with the engagement surface, during movement of the engagement member between the first position and the second position, deflects the deflecting portion against the inherent bias of the deflecting portion from the unbiased condition towards the deflected condition;

wherein, when the engagement member is positioned in the first portion of the travel path, the inherent bias of the deflecting portion biases the engagement member towards the first position;

wherein the first side wall of the housing has a spring guide slot;

wherein a guide member extends laterally from the engagement portion of the spring member, the guide member slidably engaging with the spring guide slot;

wherein the engagement of the guide member with the spring guide slot guides the deflection of the spring member between the unbiased condition and the deflected condition;

wherein the first side wall of the housing has an anchoring opening that extends from a first side of the first side wall to a second side of the first side wall;

wherein an anchor member extends laterally from the anchoring portion of the spring member for engagement with the anchoring opening;

wherein the anchor member has a bevelled surface that extends in a longitudinal direction as the bevelled surface extends laterally away from the anchoring portion;

wherein the anchoring opening has a catch surface that extends in the longitudinal direction as the catch surface extends laterally away from the first side of the first side wall;

wherein the anchoring portion is positioned adjacent to the first side of the first side wall, with the anchor member extending laterally through the anchoring opening;

wherein the engagement of the engagement member of the cover actuator member with the engagement surface of the spring member, during movement of the engagement member between the first position and the second position, exerts a longitudinal force on the anchoring portion that biases the anchor member in the longitudinal direction relative to the anchoring opening;

wherein the bevelled surface of the anchor member engages with the catch surface of the anchoring opening at least when the longitudinal force biases the anchor member in the longitudinal direction relative to the anchoring opening;

wherein the engagement of the bevelled surface with the catch surface under the bias of the longitudinal force generates a lateral force that biases the anchoring portion laterally towards the first side of the first side wall;

wherein the housing comprises a socket that carries a carried portion of the anchoring portion of the spring member, the socket preventing the carried portion of the anchoring portion from moving laterally away from the first side wall;

wherein the engagement member has a camming surface for engaging with the engagement surface of the engagement portion;

wherein the camming surface is angled so that, at least when the engagement member is positioned in the first portion of the travel path, the engagement of the camming surface with the engagement surface urges the engagement portion towards the first side wall of the housing.

21. A fluid dispenser as claimed in claim 9 wherein the spring member is formed from a resilient plastic material.

22. The fluid dispenser according to claim 11, wherein:

when the fluid dispenser is in the operative condition, at least part of the flat planar body of the spring member is positioned between the fluid reservoir and the first side wall.

23. The fluid dispenser according to claim 22 wherein the fluid dispenser further comprises a second spring member having a flat planar body;

wherein the flat planar body of the second spring member is positioned adjacent to the second side wall of the housing in the interior compartment of the housing;

wherein, in at least some configurations of the fluid dispenser, the fluid reservoir is positioned in the interior compartment between the spring member and the second spring member;

wherein the spring member has a first lateral extent by which the spring member extends laterally inwardly from the first side wall of the housing;

wherein the second spring member has a second lateral extent by which the second spring member extends laterally inwardly from the second side wall of the housing; and wherein the first lateral extent of the spring member and the second lateral extent of the second spring member define a width of the interior compartment available to accommodate the fluid reservoir between the spring member and the second spring member.

24. The fluid dispenser according claim 9 wherein the cover is vertically slidable relative the housing between the first location and the second location, in the first location, the cover provides access to the interior compartment within the housing for insertion of the fluid reservoir into the interior compartment and removal of the fluid reservoir from the interior compartment.

* * * * *